US006063555A

United States Patent [19]

Uezawa et al.

[11] Patent Number: 6,063,555

[45] Date of Patent: May 16, 2000

[54] SILVER HALIDE COLOR PHOTOGRAPHIC LIGHT-SENSITIVE MATERIAL

[75] Inventors: Kuniaki Uezawa; Kaoru Onodera; Hideaki Haraga, all of Hino, Japan

[73] Assignee: Konica Corporation, Japan

[21] Appl. No.: 09/006,989

[22] Filed: Jan. 15, 1998

[30] Foreign Application Priority Data

Jan. 21, 1997 [JP] Japan ..... 9-008672
Jul. 4, 1997 [JP] Japan ..... 9-179656

[51] Int. Cl.[7] ..... G03C 1/46

[52] U.S. Cl. ..... 430/505; 430/502; 430/503; 430/504; 430/544; 430/508; 430/944; 430/543

[58] Field of Search ..... 430/543, 544, 430/508, 505, 504, 944, 502, 503

[56] References Cited

U.S. PATENT DOCUMENTS 2,403,722 7/1946 Jelley et al. ..... 430/502
4,830,954 5/1989 Matejec ..... 430/505
5,154,995 10/1992 Kawai ..... 430/944
5,413,902 5/1995 Hara et al. ..... 430/944

FOREIGN PATENT DOCUMENTS 0588639 3/1994 European Pat. Off. .
0713137 5/1996 European Pat. Off. .
0737889 10/1996 European Pat. Off. .

*Primary Examiner*—Geraldine Letscher
*Attorney, Agent, or Firm*—Jordan B. Bierman; Bierman, Muserlian and Lucas

[57] ABSTRACT

A silver halide color photographic light-sensitive material is disclosed. The light-sensitive material comprises a transparent support having on one side thereof a cyan dye-forming coupler-containing red-sensitive silver halide emulsion layer, a magenta dye-forming coupler-containing green-sensitive silver halide emulsion layer, a yellow dye-forming coupler-containing blue-sensitive silver halide emulsion layer, a non-light-sensitive hydrophilic colloid layer and an invisible light-sensitive silver halide emulsion layer containing a dye forming coupler, a colored coupler or a DIR compound.

19 Claims, No Drawings

SILVER HALIDE COLOR PHOTOGRAPHIC LIGHT-SENSITIVE MATERIAL

FIELD OF THE INVENTION

The present invention relates to a silver halide color photographic light-sensitive material improved in the color reproducibility, particularly relates to a silver halide color photographic light-sensitive material which is excellent in an ability of distinguish of the lightness of red color, a reproducibility of green color of vegetation, or a description ability of blue sky and a distant view, and the reproducibility of hue of skin color of the light-sensitive material is stabilized with respect to a lightness variation of skin color.

Since Kodachrom has been put on the market by Eastman Kodak in 1935, improvement in the color photography has been continued, and the characteristics of the color photography are raised continuously. The improvement of the color photography includes minifying in the image structure or improving in the graininess and sharpness and in the color reproducibility. As to improvement of the color reproducibility, some techniques have been developed in past years, by which the reproducibility has been considerably raised. One of the techniques is the use of a colored coupler having an automasking function, described in U.S. Pat. No. 2,455,170.

The colored coupler is princiaplly used for raising the color reproducibility of a color negative film. The colored coupler is effective to compensate the unnecessary absorption of a dye formed from a yellow, magenta or cyan coupler used in the color negative film. It is made possible to considerably raise the color reproducibility by reducing impurity of reproduced color by imagewise compensating the unnecessary absorption of dye formed in the color negative film by the use of the colored coupler.

As to color negative film, a technique of a development effect or an interlayer effect for raising the saturation of reproduced color has been proposed in, for example, Belgian Patent No. 710,344 and German Patent No. 2,043,934 for satisfying the requirement of more bright color reproduction.

Furthermore, DIR compound is developed, for example U.S. Pat. No. 3,277,554, as an application of the interlayer effect. The color saturation of the reproduced image is greatly improved by the DIR compound.

Besides the improvement for realizing the color reproduction having a high chroma, some techniques have been proposed for accurately reproducing color just as it seen by human eyes. One of the techniques is based on the control of the spectral sensitivity distribution of the blue-, green- and red-sensitive layers, which is described in Japanese Patent Open to Public Inspection (JP O.P.I.) No. 5-150411.

Some techniques have been proposed which are based on the different between the spectral sensitivity distribution of the cone of human eye and that of the color film. Generally, in color film, the distribution of spectral sensitivity of blue-sensitive layer has the maximum sensitivity at a wavelength longer than that of human eye, the distribution of spectral sensitivity of the green-sensitive layer has the maximum sensitivity at a wavelength a little longer than that of human eye and the distribution of spectral sensitivity of the red-sensitive layer has the maximum sensitivity at a wavelength considerably longer than that of human eye. Furthermore, the red-sensitive cone of human eye has a negative sensitivity at about 500 nm. A color intervening between the primary colors can be reproduced to some degree of accuracy by finely controlling the spectral sensitivity distribution by selection of sensitizing dye and the interlayer effect by the use of a donor layer for adjusting the spectral sensitivity distribution of the color film to that of human eye, cf. JP O.P.I. No. 61-34541. The color intervening between the primary colors is difficultly reproduced by usual color films.

The reproducibility of the color film is improved so that the hue of the object can be accurately reproduced by these techniques.

As above-mentioned, the color reproducibility of color photography is steadily progressed. However, it is a fact that a further improvement in the color reproducibility is required to a next generation of color light-sensitive material which is on a different level from usual light-sensitive materials.

The reason of such the fact is that a consumer possibly disappoints about a print of a photograph taken by him. The consumer often disappoints about a photograph of tender green leaves of trees, red flowers or distant view of mountains. When the consumer looks at the finished print of such the scenes, the consumer often disappoints since in the printed picture the color of the tender green leaves is darken, the detailed gradation of the petals of red flower is lost, and the distant mountains are made hazy and the cubic effect of them is lost, which are different from the scenes expected or remembered by the consumer.

Further, a light-sensitive material for preparation of a color proof is described in European Patent Publication No. 0 737 889 A2. The light sensitive material has infrared-sensitive layer further than visible light-sensitive emulsion layers on a reflective support. such the light-sensitive material is different from the light-sensitive material of the invention in the function and constitution thereof.

As above-mentioned, requirements to color photography have not been satisfied only by the accurate reproduction of vivid color, and an ability of depiction capable of forming an image more than the expectation of the consumer so that the scene remembered by the consumer at the time of taking photograph is clearly reproduced, has been recently demanded.

SUMMARY OF THE INVENTION

The object of the invention is to provide a silver halide color photographic light-sensitive material which is excellent in the scene depiction ability. In concrete, the object is to provided a silver halide color photographic light-sensitive material by which the tender green of tree leaves can be vividly reproduced, the scene of distant mountains can be clearly reproduced, blue color of blue sky and sea-surface can be really reproduced, and the light sensitive material is excellent in the ability of depiction of the detail of red flowers and in the color reproducibility of skin-color having a low lightness.

The above-mentioned object of the invention is attained by a silver halide color photographic light-sensitive material comprising a transparent support having on one side thereof a cyan dye-forming coupler-containing red-sensitive silver halide emulsion layer, a magenta dye-forming coupler-containing green-sensitive silver halide emulsion layer, a yellow dye-forming coupler-containing blue-sensitive silver halide emulsion layer, a non-light-sensitive hydrophilic colloid layer and an invisible light-sensitive silver halide emulsion layer which contains a dye forming coupler, a colored coupler or a DIR compound.

DETAILED DESCRIPTION OF THE INVENTION

In the invention, the invisible light-sensitive color reproducibility improving layer is a silver halide emulsion layer sensitive to light having a wavelength without the range of from 400 nm to 700 nm. The sensitive wavelength of the invisible light-sensitive color reproducibility improving layer is preferably not less than 680 nm and not more than 850 nm, more preferably not less than 730 nm and not more than 780 nm.

The invisible light-sensitive emulsion layer contains a dye forming coupler, a colored coupler or a DIR compound. It is preferable that the invisible light-sensitive silver halide emulsion layer contains at least one of the following (a), (b) and (c);

(a) not more than two of a yellow dye-forming coupler, a magenta dye-forming coupler and a cyan dye-forming coupler, (b) a colored coupler, and (c) a DIR compound.

The invisible light-sensitive color reproducibility improving layer is preferably provided at a position nearer the support than that of a green-sensitive layer.

In the invention, the invisible light-sensitive color reproducibility improving layer capable of forming an image is a silver halide emulsion layer capable of imagewise forming color having absorption within the visible range of 400 to 700 nm by exposing to light.

The color reproducibility of an image formed by visible light can be improved by adding a color forming coupler to the invisible light sensitive color reproducibility improving layer, hereinafter simply referred to invisible light-sensitive layer. In such the case, a color image is formed in the invisible light-sensitive layer corresponding to incident invisible light from the object so that the reproducibility of color formed by a yellow, magenta and cyan coupler according to visible-light exposure.

For example, when a yellow coupler is added into an infrared-sensitive layer, a yellow image is formed in the infrared-sensitive layer corresponding to infrared rays come from a purple flower, and the reproduced color of the purple flower can be improved.

For example when a magenta coupler is added to an infrared-sensitive layer, a magenta image is formed according to infrared rays come from vegetation having green leaves in the infrared-sensitive layer. Consequently, the reproduction of green color of leaves of trees and grasses can be improved.

For example, when a cyan coupler is added to an infrared-sensitive layer, a cyan image is formed according to infrared rays come from original objects. However, an amount of infrared rays reflected from water surface is smaller than that come from another object. Consequently, reproduction of blue color of water surface such as sea surface can be improved.

The color reproducibility of the light-sensitive material can be improved also by adding two or more of a yellow, magenta and cyan coupler in combination to the invisible light-sensitive layer so that an image composed of such the couplers is formed corresponding to invisible light come from objects. For example, when yellow, magenta and cyan couplers are added into an infrared-sensitive layer, yellow, magenta and cyan images are formed according to infrared rays come from a fazed distant mountains. Consequently, the clearness of the distant view can be raised.

The color reproducibility of the light-sensitive material can be improved also by adding a colored coupler to the invisible light-sensitive layer so that a color image is formed corresponding to invisible light come from objects. For example, when a yellow-colored magenta coupler is added into an infrared-sensitive layer, a magenta image is formed according to infrared rays come from vegetation having green leaves. Consequently, the reproduction of green color of the leaves of tree and grasses can be improved.

The color reproducibility of the light-sensitive material can be improved by adding a coupler and a colored coupler to the invisible light-sensitive layer so that a color image is formed corresponding to invisible light come from objects. For example, when a magenta coupler and a yellow-colored magenta coupler is added into an infrared-sensitive layer, a color image is formed according to infrared rays come from a yellow flower. Consequently, the reproduction of yellow color of the flower can be improved.

The color reproducibility of the light-sensitive material can be improved by adding a coupler and a DIR coupler to the invisible light-sensitive layer so that a color image is formed and an interimage effect is generated corresponding to invisible light come from objects. For example, when a magenta coupler and a DIR coupler is added into an infrared-sensitive layer, a magenta image is formed and an interimage effect is generated according to infrared rays come from green vegetation. Consequently, the reproduction of green color of the vegetation can be improved.

The color reproducibility of the light-sensitive material can be improved by adding a colored coupler and a DIR coupler to the invisible light-sensitive layer so that a color image is formed and an interimage effect is generated corresponding to invisible light come from objects. For example, when a yellow-colored magenta coupler and a DIR coupler is added into an infrared-sensitive layer, a magenta image is formed and an interimage effect is generated according to infrared rays come from green leaves of vegetation with a low lightness. Consequently, the reproduction of green color of the vegetation can be improved.

The color reproducibility of the light-sensitive material can be improved by adding a DIR coupler to the invisible light-sensitive layer so that an interimage effect is generated corresponding to invisible light come from objects. For example, when a DIR coupler is added into an infrared-sensitive layer, an interimage effect is generated according to infrared rays come from human skin with a low lightness or tanned skin. Consequently, the reproduction of skin color can be improved.

In the invention, the layer for improving a reproducibility of green color of vegetation is a layer containing a silver halide emulsion which is invisible light-sensitive and sensitive to reflective light from vegetation to improve the reproducibility of green color of vegetation. Although a coupler, a colored coupler or a DIR compound may be contained in the vegetation green color reproducibility improving layer, a magenta coupler is preferably contained. The layer is affected by light of not less than 720 nm of inherent green color of vegetation and forms a magenta image thereof so that the lightness and saturation of green color can be raised. Such the vegetation green color reproducibility improving layer has not been disclosed nor suggested in the past.

In the invention, the color reproducibility improving layer for improving a reproducibility of lightness of red color is an invisible light-sensitive color reproducibility improving layer containing a silver halide emulsion and a DIR compound, which is sensitive to infrared rays and gives an inter-layer effect (IIE) by imagewise releasing a development inhibitor so as to inhibit the development in another layer. The reproducibility of the lightness of red color can be improved by the effect of this layer. For example, the invisible light-sensitive layer is sensible to infrared rays reflected from a red object such as red tulip flower and imagewise releases a development inhibitor. Thus unnecessary emphasize of red color can be inhibited. As a result of that, the reproduction of the detailed gradation in red color can be realized and the accuracy of the red color reproduction can be raised. Such the red color lightness improving layer has not been disclosed nor suggested in the past.

In the invention, the color reproducibility improving layer for improving a reproducibility of hue of skin color is an invisible light-sensitive color reproducibility improving layer containing a silver halide emulsion and a DIR compound, which is sensitive to infrared rays and gives an inter layer effect (IIE) by imagewise releasing a development inhibitor so as to inhibit the development in another layer. Generally, the skin of a male strongly reflects light in the region of red to infrared compared with the skin of female. The invisible light-sensitive layer is sensible to infrared rays reflected from the male skin and imagewise releases a development inhibitor. By the effect of this layer, turning reddish-brown of male skin color can be avoided and skin colors of male and female which are different in the lightness form each other can be naturally reproduced. Such the skin color reproducibility improving layer has not been disclosed nor suggested in the past.

In the invention, the color reproducibility improving layer for improving a reproducibility of color of blue sky is a layer containing a silver halide emulsion which is sensible to infrared rays contained in ordinary sunlight and almost not sensible to blue sky light, and improves the reproducibility of color of sky. Although a coupler, a colored coupler or a DIR compound may be contained in the sky blue color reproducibility improving layer, a colored coupler is preferably contained. For example, when a yellow-colored cyan coupler and a yellow-colored magenta coupler are contained in this layer, a cyan image and a magenta image of the object other than blue sky reflecting sunlight are formed since ordinary sunlight has energy in infrared region. In contrast, yellow color of the colored couplers is remained in the portion of blue sky since energy in infrared region of blue sky or skylight is low. As a result of that, the reproduction of pure and deep color of blue sky can be realized. Such the blue sky color reproducibility improving layer has not been disclosed nor suggested in the past.

In the invention, the color reproducibility improving layer for improving a reproducibility of color of sea surface or water surface is a layer containing a silver halide emulsion which is invisible light-sensitive color reproducibility improving layer, a colored coupler is preferably contained. For example, when a yellow-colored cyan coupler and a yellow-colored magenta coupler are contained in this layer, a cyan image and a magenta image of the object reflecting sunlight other than sea or water surface are formed since ordinary sunlight has energy in infrared region. In contrast in the portion of sea or water surface, yellow color of the colored couplers is remained since energy in infrared region of light reflected by sea surface of water surface is low. As a result of that, the densities of magenta and cyan of the image the sea or water surface are raised and the lightness of that is lowered on the finished print. Accordingly the reproduction of pure and deep color of sea surface or water surface can be realized. Such the sea surface or water surface color reproducibility improving layer has not been disclosed nor suggested in the past.

In the invention, the color reproducibility improving layer for improving a reproducibility of clarity of a distant view is a layer containing a silver halide emulsion which is invisible light-sensitive and sensitive to infrared rays reflected by a distant view so as to improve the reproducibility of the distant view. Although a coupler, a colored coupler or a DIR compound may be contained in the distant view clarity reproducibility improving layer, a coupler is preferably contained. The effect of this layer is based on the fact that scattering of infrared rays is low. For example, when a yellow coupler, magenta coupler and cyan coupler are contained in this layer, a distant view hazed by scattered light is clearly photographed in this layer by infrared rays accompanied with a little scattering and a yellow, magenta and cyan images are formed in the layer. As a result of that, hazing of the distant mountains can be avoided and a scene of distant mountains can be clearly reproduced with a cubic effect of appearance. Such the distant view clarity reproducibility improving layer has not been disclosed nor suggested in the past.

In the invention, the silver halide emulsion to be contained in the invisible light-sensitive color reproducibility improving layer has the maximum spectral sensitivity at a wavelength within the range of from not less than 680 nm and nor more than 850 nm. Preferably usable sensitizing dye is one represented by the following Formula I-a or I-b.

Formula I-a

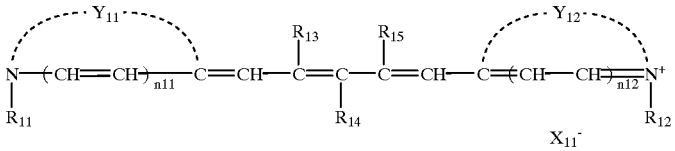

Formula I-b

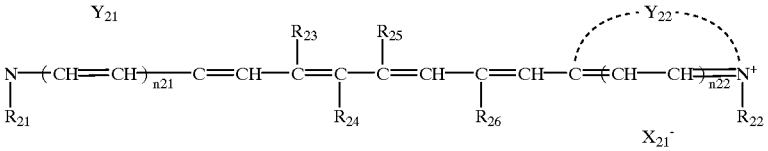

which is sensitive to invisible light, sensitive to ordinary sunlight and almost not sensitive to light reflected by sea surface or water surface, and improves the reproducibility of color of the sea surface or water surface. Although a coupler, a colored coupler or a DIR compound may be contained in In the formula, $Y_{11}$, $Y_{12}$, $Y_{21}$, $Y_{22}$ represent each a group of atoms necessary for completing a 5- or 6-member nitrogen-containing heterocyclic ring, such as a benzothiazole ring, a naphthothiazole ring, a benzoselenazole ring, a naphtho-selenazole ring, a benzoxazole ring, a naphthoxazole ring, quinoline ring, a 3,3-dialkylindolenine ring, a benzimidazole ring or a pyridine ring.

These heterocyclic ring each may be substituted with a lower alkyl group, an alkoxy group, a hydroxy group, an aryl group, an alkoxycarbonyl group or a halogen atom.

$R_{11}$, $R_{12}$, $R_{21}$ and $R_{22}$ represent each a substituted or unsubstituted alkyl, aryl or aralkyl group.

$R_{13}$, $R_{14}$, $R_{15}$, $R_{23}$, $R_{24}$, $R_{25}$ and $R_{26}$ represent each a hydrogen atom, a substituted or unsubstituted alkyl, alkoxy, phenyl, benzyl or

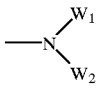

group, in which $W_1$ and $W_2$ represent each a substituted or unsubstituted alkyl group having 1 to 18, preferably 1 to 4, carbon atom in the alkyl moiety thereof or an aryl group, and $W_1$ and $W_2$ may be bonded with each other to form a 5- or 6-member nitrogen-containing heterocyclic ring.

$R_{13}$ and $R_{15}$, or $R_{23}$ and $R_{25}$ each may be bonded to form a 5- or 6-member ring. $X_{11}$ and $X_{21}$ represent each an anion. $n_{11}$, $n_{12}$, $n_{21}$ and $n_{22}$ represent each 0 or 1.

As concrete examples of the compound represented by Formula I-a or I-b, Exemplified Compounds A-1 to A-14, B1 to B25 and those described in [0031] of JP O.P.I. No. 7-13289 can be cited. These sensitizing dyes can be used solely or in combination. A combination of sensitizing dyes is frequently used for the purpose of super sensitization. A dye having no sensitizing effect itself or a compound which substantially does not absorb visible light each having a super sensitizing effect can be contained in the emulsion. Effectively usable dyes, combinations of dyes showing the super sensitizing effect and substances showing the super-sensitizing effect are described in Research Disclosure 176, 17643, December 1978, page 23, IV J, Japanese Patent Nos. 49-25500 and 43-4933, and JP O.P.I. Nos. 59-19032, 59-192242, 3-15049 and 61-123454. The above-mentioned dye is used usually in an amount of $10^{-7}$ moles to $1\times10^{-2}$ moles, preferably $10^{-6}$ moles to $5\times10^{-3}$ moles, per mole of silver halide.

Typical compounds represented by Formula I-a or I-b are shown below.

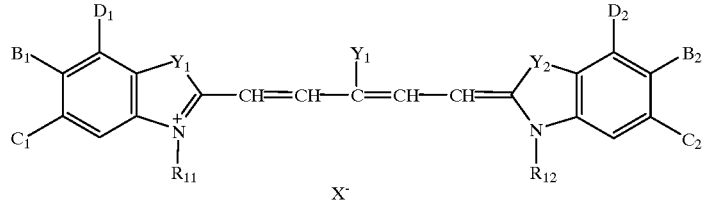

| Exemplified No. | $Y_1$ | $Y_2$ | $B_1$ | $C_1$ | $B_2$ | $C_2$ | $R_{11}$ | $R_{12}$ | $V_1$ | $X^-$ | $D_1$ | $D_2$ |
|---|---|---|---|---|---|---|---|---|---|---|---|---|
| 1-1 | Se | Se | H | H | H | H | $C_2H_5$ | $C_2H_5$ | H | I | H | H |
| 1-2 | S | S | H | H | H | H | $C_2H_5$ | $C_2H_5$ | H | I | H | H |
| 1-3 | Se | Se | H | H | H | H | $(CH_2)_2OCH_3$ | $(CH_2)_2OCH_3$ | H | Br | H | H |
| 1-4 | Se | S | H | H | H | H | $(CH_2)_3SO_3H$ | $C_2H_5$ | H | — | H | H |
| 1-5 | S | S | H | $OCH_3$ | H | H | $C_2H_5$ | $C_2H_4OH$ | $C_2H_5$ | Br | H | H |
| 1-6 | S | S | $C_2H_5$ | H | $C_2H_5$ | H | $C_5H_{11}$ | $C_5H_{11}$ | $C_2H_5$ | Br | H | H |
| 1-7 | S | S | $C_2H_5$ | H | $C_2H_5$ | H | $C_5H_{11}$ | $C_5H_{11}$ | $C_4H_9$ | Br | H | H |
| 1-8 | S | S | $OCH_3$ | $OCH_3$ | $OCH_3$ | $OCH_3$ | $C_2H_5$ | $C_2H_5$ | $CH_3$ | I | H | H |
| 1-9 | S | S | $OCH_3$ | H | $OCH_3$ | H | $C_2H_5$ | $C_2H_5$ | H | I | $OCH_3$ | $OCH_3$ |
| 1-10 | S | S | $OCH_3$ | H | $OCH_3$ | H | $CH_2CH{=}CH_2$ | $CH_2CH{=}CH_2$ | H | I | $OCH_3$ | $OCH_3$ |
| 1-11 | S | S | $OCH_3$ | H | $OCH_3$ | H | $CH_2CH{=}CH_2$ | $CH_2CH{=}CH_2$ | $C_2H_5$ | Br | $OCH_3$ | $OCH_3$ |

1-12

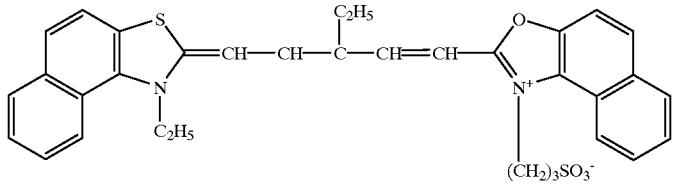

1-13

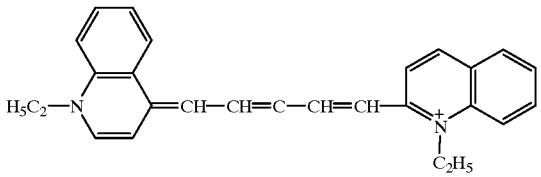

-continued 1-14

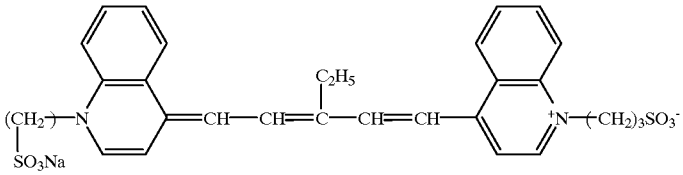

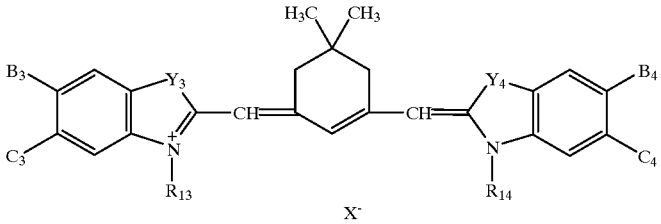

| Exemplified No. | $Y_3$ | $Y_4$ | $B_3$ | $C_3$ | $B_4$ | $C_4$ | $R_{13}$ | $R_{14}$ | $X^-$ |
|---|---|---|---|---|---|---|---|---|---|
| 2-1 | S | S | H | H | H | H | $C_2H_5$ | $C_2H_5$ | Br |
| 2-2 | S | S | $CH_3$ | H | H | H | $C_2H_5$ | $C_2H_5$ | Br |
| 2-3 | S | S | $CH_3$ | H | $CH_3$ | H | $C_2H_5$ | $C_2H_5$ | I |
| 2-4 | S | S | H | H | H | H | $C_2H_5$ | $C_3H_7$ | I |
| 2-5 | S | S | H | H | H | H | $C_2H_5$ | $C_4H_9$ | I |
| 2-6 | S | S | H | H | H | H | $C_2H_5$ | $C_5H_{11}$ | Br |
| 2-7 | S | S | H | H | H | H | $C_2H_5$ | $C_7H_{15}$ | Br |
| 2-8 | S | S | H | H | H | H | $C_2H_5$ | $C_{10}H_{21}$ | Br |
| 2-9 | S | S | H | H | H | H | $C_3H_7$ | $C_3H_7$ | Br |
| 2-10 | S | S | H | H | H | H | $C_4H_9$ | $C_4H_9$ | $PTS^{-*}$ |
| 2-11 | S | S | H | H | H | H | $C_5H_{11}$ | $C_5H_{11}$ | Br |
| 2-12 | S | S | H | H | H | H | $C_7H_{15}$ | $C_7H_{15}$ | Br |
| 2-13 | S | S | $CH_3$ | H | H | H | $C_2H_5$ | $C_5H_{11}$ | Br |
| 2-14 | S | S | $CH_3$ | H | $CH_3$ | H | $C_2H_5$ | $C_5H_{11}$ | Br |
| 2-15 | S | S | $OCH_3$ | H | H | H | $C_2H_5$ | $C_2H_5$ | Br |
| 2-16 | S | S | $OCH_3$ | H | H | H | $C_2H_5$ | $C_5H_{11}$ | Br |
| 2-17 | S | S | $CH_3$ | $CH_3$ | $CH_3$ | $CH_3$ | $C_2H_5$ | $C_2H_5$ | Br |
| 2-18 | S | S | $C_3H_7$(i) | H | $C_3H_7$(i) | H | $C_2H_5$ | $C_2H_5$ | Br |
| 2-19 | S | S | H | H | H | H | $C_2H_5$ | $(CH_2)_3SO_3^-$ | — |
| 2-20 | S | S | $CH_3$ | H | $CH_3$ | H | $C_2H_5$ | $(CH_2)_4SO_3^-$ | — |
| 2-21 | S | S | $CH_3$ | H | $CH_3$ | H | $(CH_2)_3SO_3HN(C_2H_5)_3$ | $(CH_2)_3SO_3^-$ | — |
| 2-22 | S | S | H | H | H | H | $C_2H_5$ | $(CH_2)_3SO_4^-$ | — |
| 2-23 | S | S | $CH_3$ | H | $CH_3$ | H | $C_2H_5$ | $C_5H_{11}$ | Br |
| 2-24 | Se | Se | H | H | H | H | $C_2H_5$ | $C_2H_5$ | Br |
| 2-25 | Se | Se | $CH_3$ | H | $CH_3$ | H | $C_2H_5$ | $C_2H_5$ | Br |

2-26

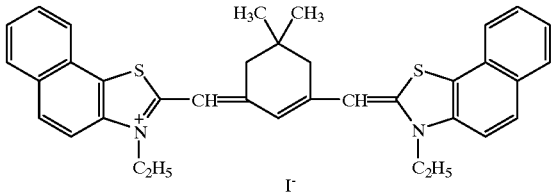

2-27

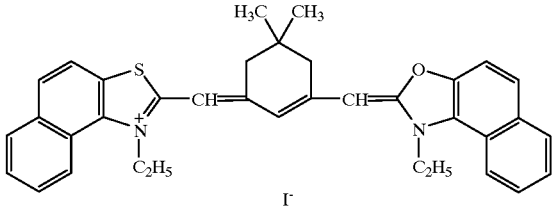

-continued
3-1
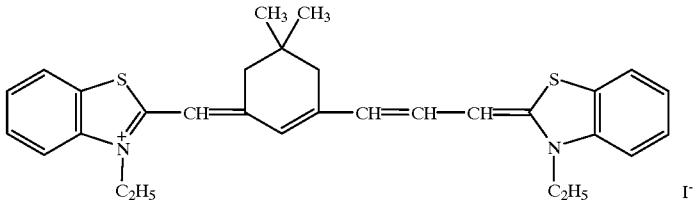
3-2
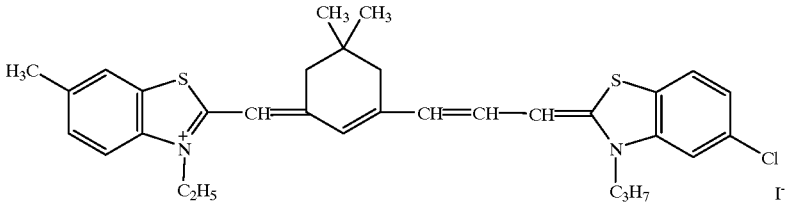
3-3
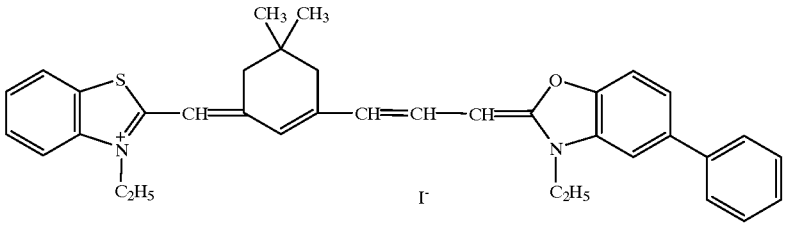
3-4
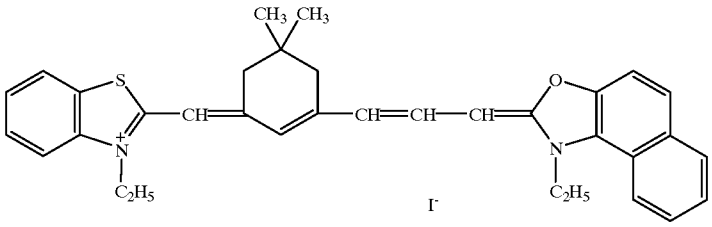
3-5
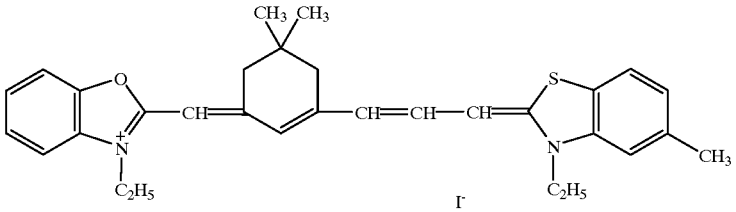
3-6
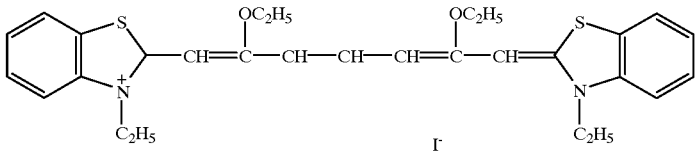
3-7
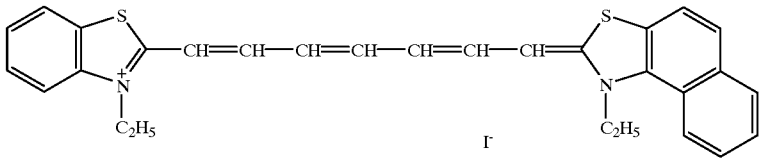

-continued
3-8
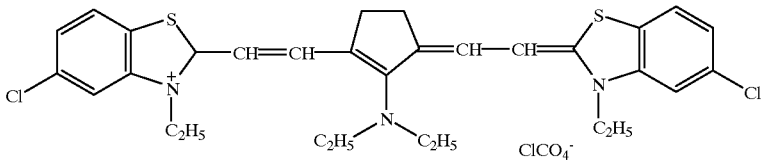
3-9
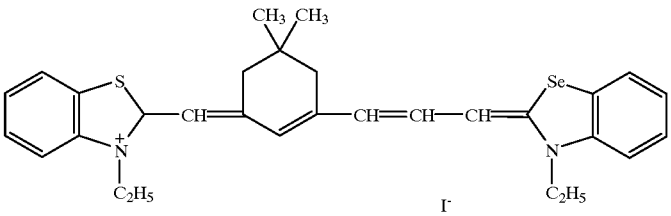
3-10
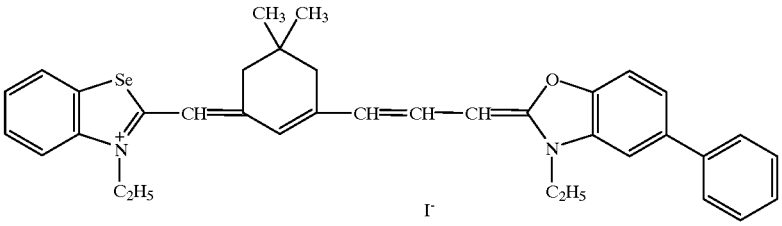
3-11
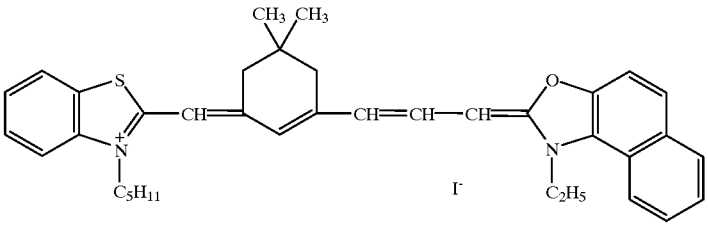
3-12
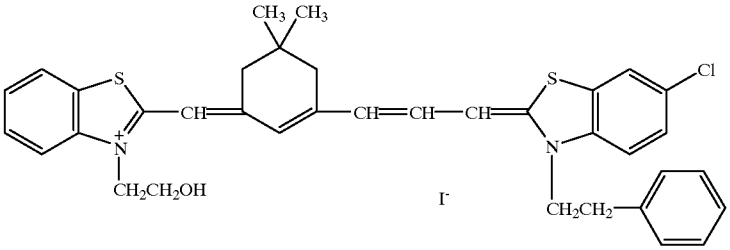
3-13
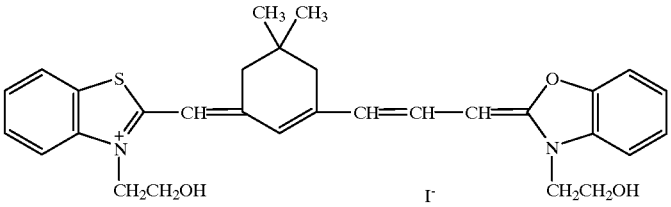
3-14
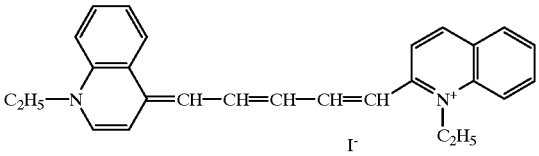

-continued
3-15
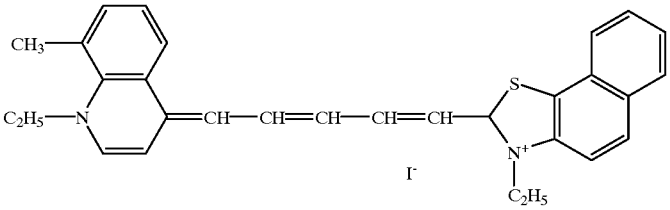
3-16
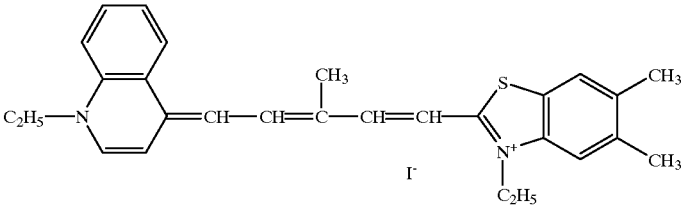
3-17
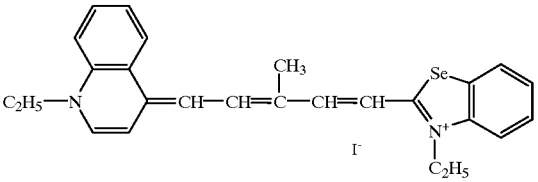
3-18
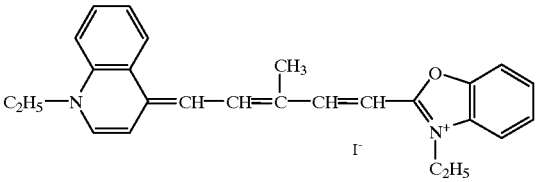
3-19
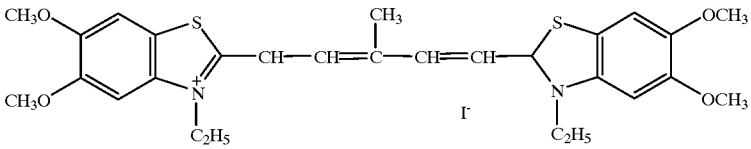
3-20
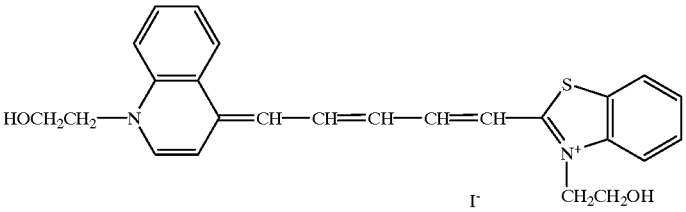
3-21
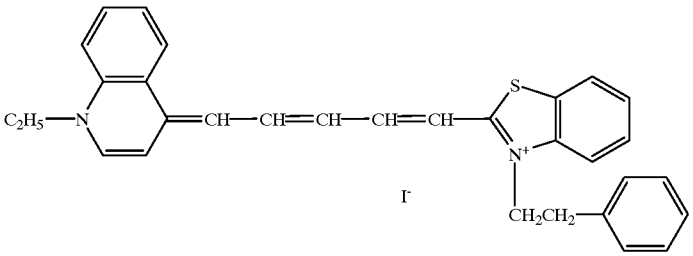
PTS⁻*: Paratoluenesulfonic acid The above-mentioned red-sensitive sensitizing dyes can be easily synthesized according to the method described in, for example, F. M. Harmer, The Chemistry of Heterocyclic Compounds, vol. 18, and The Cyanine Dyes and Related Compound, edited by A. Weissberger, Interscience, New York, 1964.

As the color forming coupler to be added in the invisible light-sensitive layer of the invention, a conventional coupler usually used in the field of color photographic light-sensitive material are usable. The coupler is a compound capable of forming color such as yellow, magenta or cyan by reacting with the oxidation product of a color developing agent such as a paraphenylenediamine compound. The coupler includes four equivalent couplers and two-equivalents coupler, and the two equivalent couplers are preferably used. The above-mentioned two-equivalent couplers preferably used in the present invention are represented by the following Formula II.

Formula II

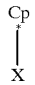

wherein $C_p$ represents a coupler residual group; * represents the coupling position of the coupler; X represents an atom or a group being split off when the oxidized product of an aromatic primary amine color developing agent is coupled to form a dye.

In a coupler residual group represented by $C_p$, typical yellow coupler residual groups are described in U.S. Pat. Nos. 2,298,443, 2,407,210, 2,875,057, 3,048,194, 3,265,506 and 3,447,928 and Farbkupplereine Literaturubersiecht Agfa Mitteilung (B and II), pp. 112 through 126 (1961). Of these, acylacetanilides, for example, benzoylacetanilides and pyvaloylacetanilides are preferable.

Typical magenta couplers are described in U.S. Pat. Nos. 2,369,489, 2,343,703, 2,311,082, 2,600,788, 2,908,573, 3,062,653, 3,152,896,3,519,429, 3,725,067 and 4,540,654, Japanese Patent O.P.I. Publication Nos. 162548/1984 and the above-mentioned Agfa Mitteilung (B and II), pp. 126 through 156 (1961). Of these, pyrazolones or pyrazoloazoles, for example, pyrazoloimidazole and pyrazolotriazole are preferable.

Typical cyan coupler residual groups are described in U.S. Pat. Nos. 2,367,531, 2,423,730, 2,474,293, 2,772,162, 2,895,826, 3,002,836, 3,034,892 and 3,041,236 and the above-mentioned Agfa Mitteilung (B and II), pp. 156 through 175. Of these, the preferable ones are phenols or naphthols.

As a split-off atom or group represented by X, are for example, a halogen atom, an alkoxy group, an aryloxy group, a heterocyclic oxy group, an acyloxy group, an alkylthio group, an arylthio group, a heterocyclic thio group, and

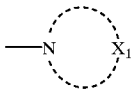

wherein $X_1$ represents atoms necessary to form a 5-member or 6-member ring together with at least one atom selected from a nitrogen atom, a carbon atom, an oxygen atom, a nitrogen atom and a sulfur atom in the formula, a monovalent group such as an acylamino group and a sulfonamide group and a divalent group such as an alkylene group. In the case of a divalent group, X forms a dimmer with an X.

Hereinafter, practical examples will be cited. A halogen atom: a chlorine atom, a bromine atom and a fluorine atom.

Alkoxy group:

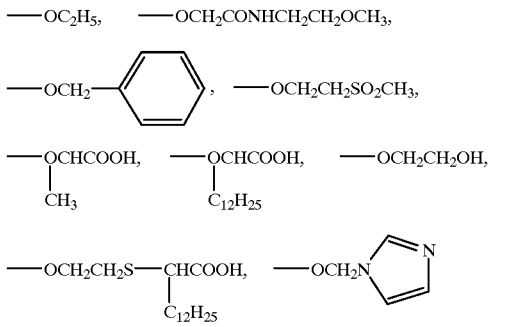

Aryloxy group:

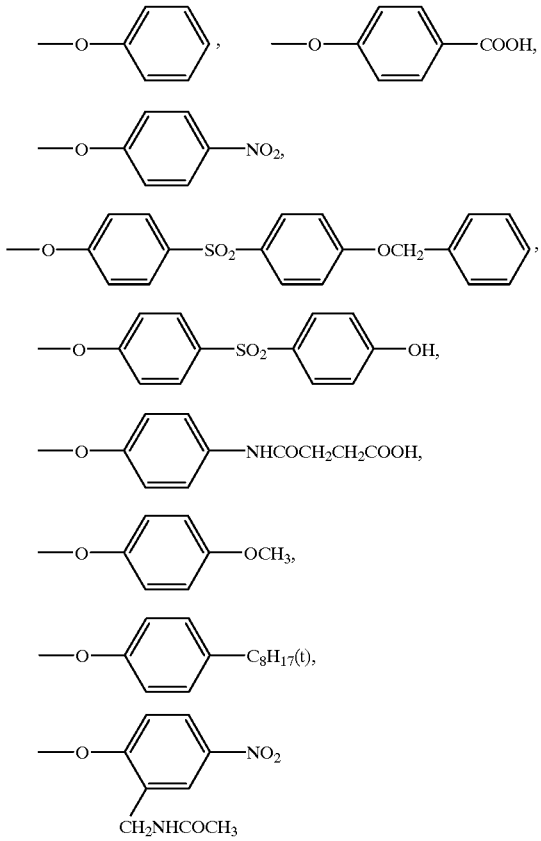

Heterocyclic oxy group:

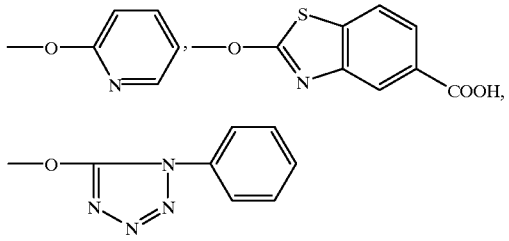

Acyloxy group

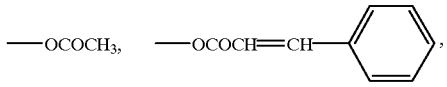

-continued
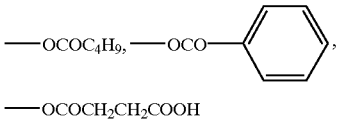
Alkylthio group
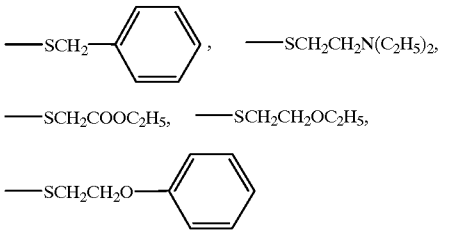
Arylthio group:
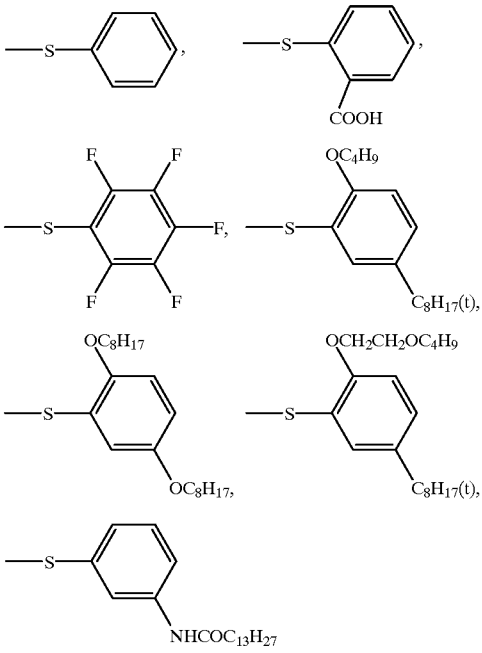
Heterocyclic thio group
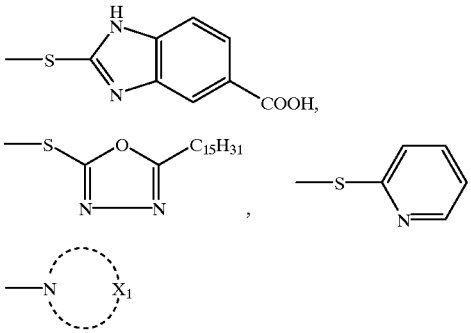
a pyrazolyl group, an imidazolyl group, a triazolyl group and a tetrazolyl group,
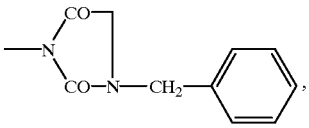
-continued
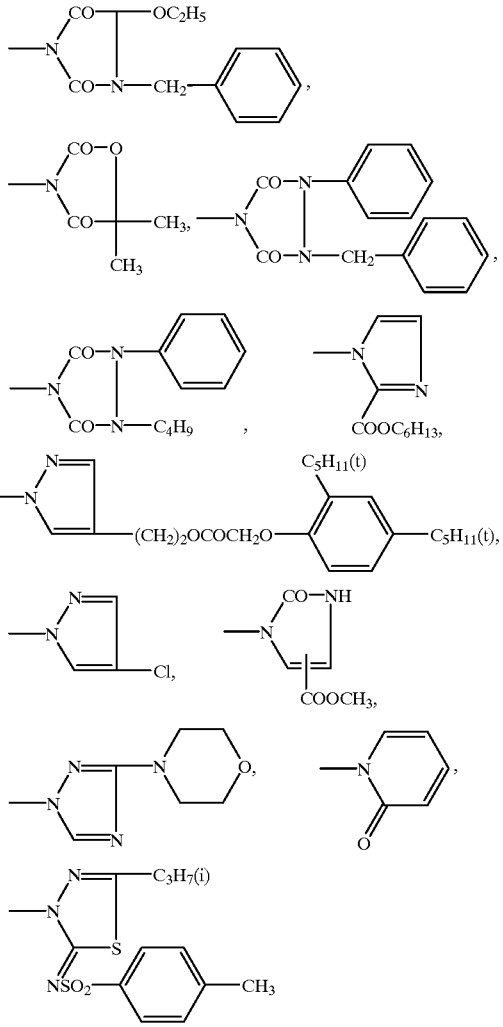
Acylamino group:
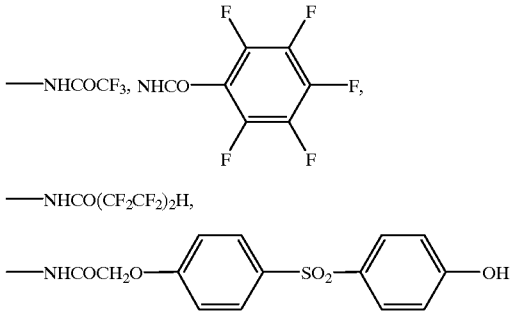
Sulfonamide group:
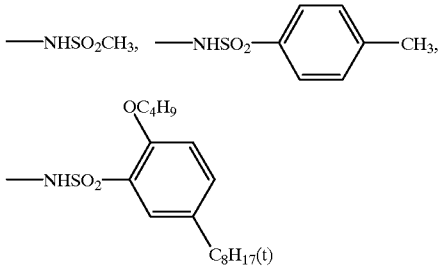

-continued

Alkylene group:

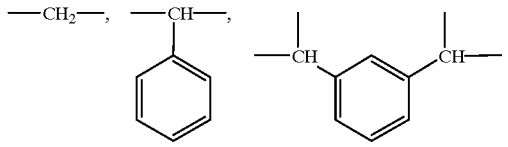

As a two-equivalent yellow coupler, those represented by the following Formulas III and IV are preferable.

Formula III

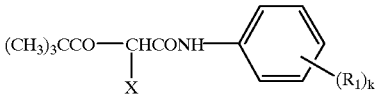

Formula IV

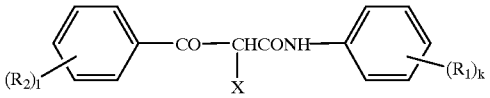

In Formulas III and IV, $R_1$ and $R_3$ independently represent a hydrogen atom or a substituent. k and l independently represent an integer of 1 to 5. When both of k and l are 2 or more, $R_1$ and $R_2$ may be the same or different. X represents the same as that of Formula II.

As a substituting atom and a substituent represented by $R_1$ and $R_2$, for example, a halogen atom and an alkyl group, a cycloalkyl group, an aryl group and a heterocycle which directly combine or which combine through a divalent atom or a group are cited.

As the above-mentioned divalent atom or a group, for example, a halogen atom, a nitrogen atom, a sulfur atom, a carbonylamino group, an aminocarbonyl group, a sulfonylamino group, an aminosulfonyl group, an amino group, a carbonyl group, a carbonyloxy group, an oxycarbonyl group, a ureilene group, a thioureilene group, a thiocarbonylamino group, a sulfonyl group and a sulfonyloxy group are cited.

The above-mentioned alkyl group, cycloalkyl group, aryl group and heterocycle which are examples of a substituent represented by $R_1$ and $R_2$. Aforesaid substituents include a halogen atom, a nitro group, a cyano group, an alkyl group, an alkenyl group, a cycloalkyl group, an aryl group, an alkoxy group, an aryloxy group, an alkoxycarbonyl group, an aryloxycarbonyl group, a carboxy group, a sulfo group, a sulfamoyl group, a carbamoyl group, an acylamino group, an ureido group, an urethane group, a sulfonamide group, a heterocycle, an arylsulfonyl group, an alkylsulfonyl group, an arylthio group, an alkylthio group, an alkylamino group, an anilino group, a hydroxy group, an imido group and an acyl group.

In a two-equivalent yellow coupler, as an X, those illustrated in Formula II are cited. Specifically, an aryloxy group and

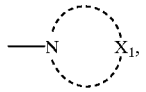

wherein $X_1$ represents the same as the above-mentioned $X_1$, are preferable.

In addition, Formula III includes a case when $R_1$ or X forms a dimmer or a higher polymer.

In addition, Formula IV includes a case when $R_1$, $R_2$ or X forms a dimmer or a higher polymer.

As a two-equivalent magenta coupler, those represented by the following Formulas V, VI, VII and VIII are cited.

Formula V

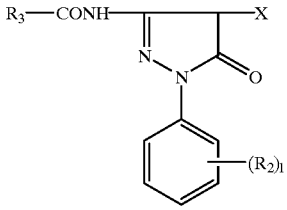

Formula VI

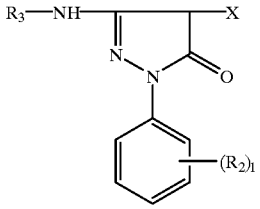

Formula VII

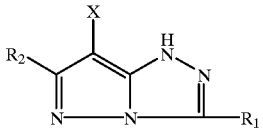

Formula VIII

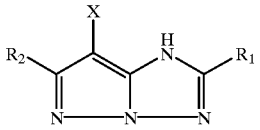

In the above-mentioned Formulas V through VIII, $R_3$ represents a substituent. $R_1$, $R_2$, X and l respectively represent the same as those in Formulas III and IV. When l is 2 or more, each $R_2$ may be the same or different.

As examples of $R_1$ and $R_2$, those illustrated as $R_1$ and $R_2$ in Formula IV are cited. As $R_3$, each of an alkyl group, a cycloalkyl group, an aryl group and a heterocycle are cited. These include those having a substituent. As examples of aforesaid substituents, those illustrated as substituents which each group cited as examples of $R_1$ and $R_2$ in Formula III are cited.

In a two-equivalent magenta coupler, as examples of an X, those illustrated in Formula II are cited, in which an alkylthio group, an arylthio group, an aryloxy group, an acyloxy group, and

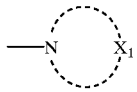

wherein $X_1$ represents the same as the above-mentioned $X_1$ and an alkylene group are specifically preferable.

In addition, Formulas V and VI include cases when a polymer including a dimmer or a higher polymer is included by means of $R_2$, $R_3$ and X. Formulas VII and VIII include cases when a polymer including a dimmer or a higher polymer is included by means of $R_1$, $R_2$ and X.

As a two-equivalent cyan coupler, those represented by the following Formulas IX, X and XI are preferable.

Formula IX

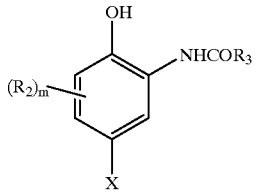

Formula X

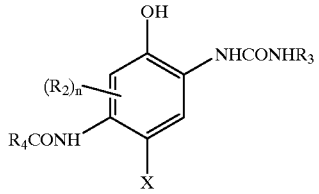

-continued

Formula XI

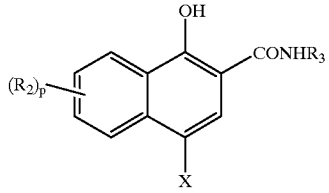

In Formulas IX, X and X, $R_2$ and $R_3$ represent the same as $R_2$ and $R_3$ in Formula V. $R_4$ represents a substituent. m represents 1 through 3. n represents 1 or 2. p represents 1 through 5. When all of m, n and p are 2 or more, each of $R_2$ may be the same or different.

As $R_2$ and $R_3$, those illustrated in Formula V are cited. As $R_4$, those illustrated as $R_3$ in Formula V are cited. In a two-equivalent cyan coupler, as an example of X, those illustrated by Formula II are cited. A halogen atom, an alkoxy group, an aryloxy group and a sulfonamide group are specifically preferable.

In addition, Formulas IX and XI include cases when a dimmer or a higher polymer is formed with $R_2$, $R_3$ or X. Formula X include cases when a dimmer or a higher polymer is formed with $R_2$, $R_3$, $R_4$ or X.

Practical examples of a two-equivalent coupler preferably used in the present invention will be cited as below.

Y-1

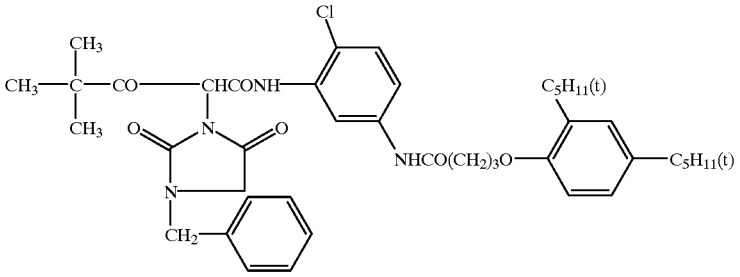

Y-2

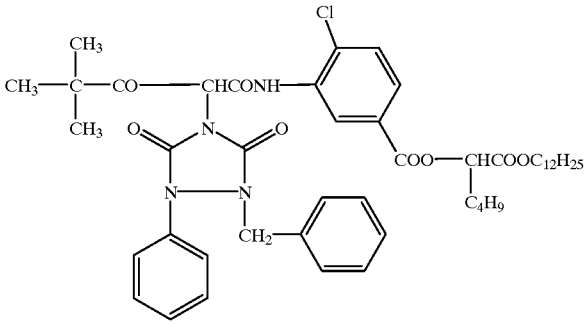

-continued
Y-3
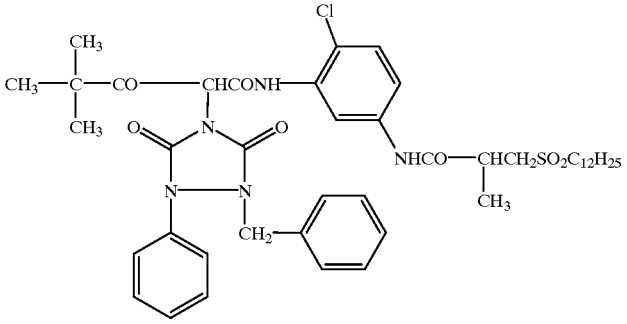
Y-4
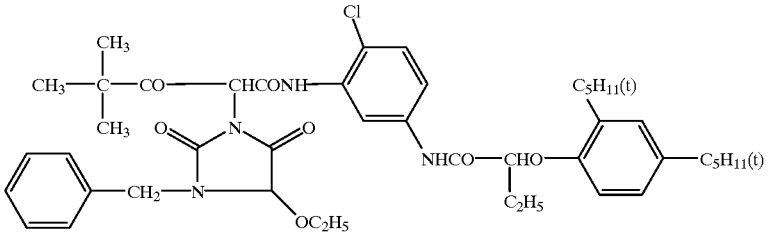
Y-5
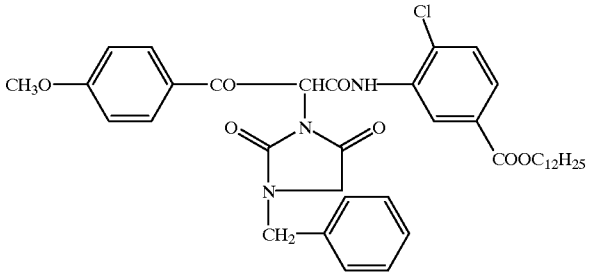
Y-6
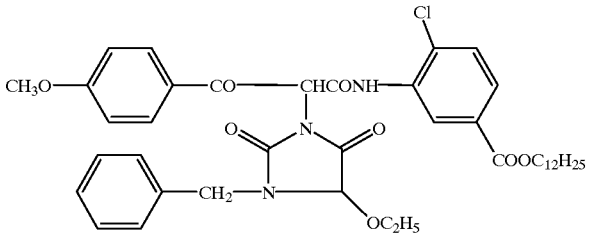
Y-7
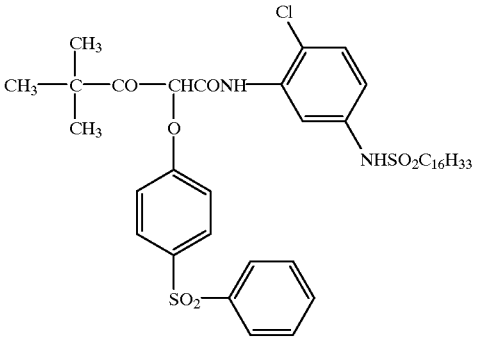

-continued
Y-8
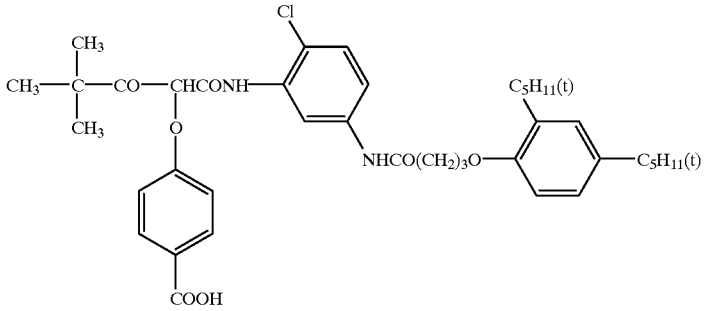
Y-9
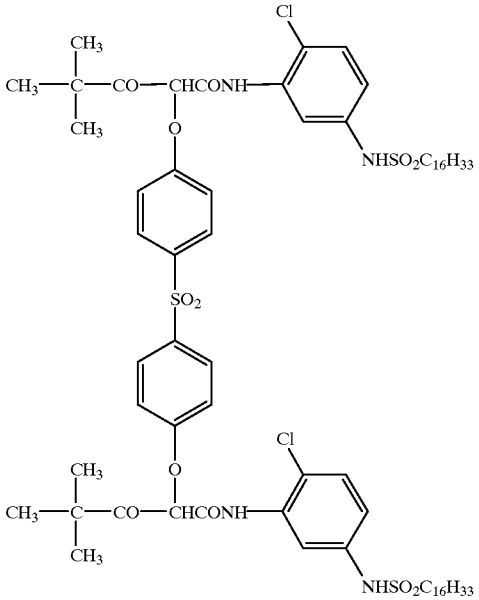
Y-10
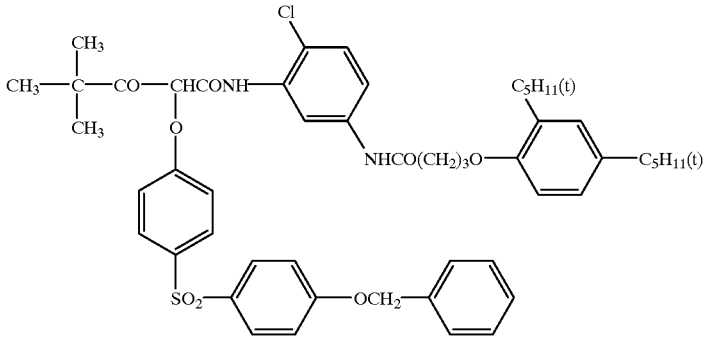
Y-11
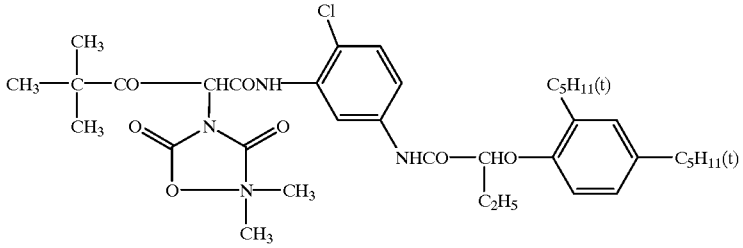

-continued
Y-12
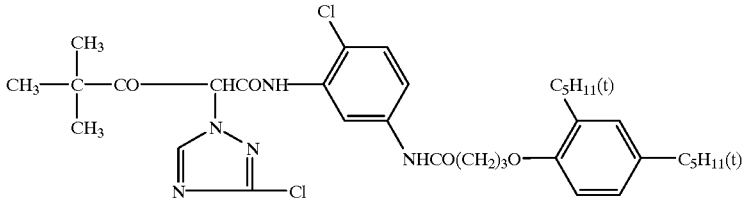
Y-13
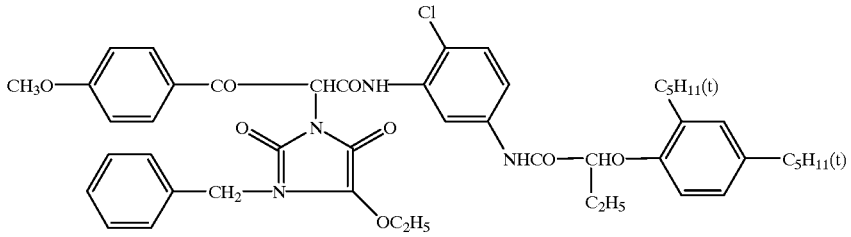
Y-14
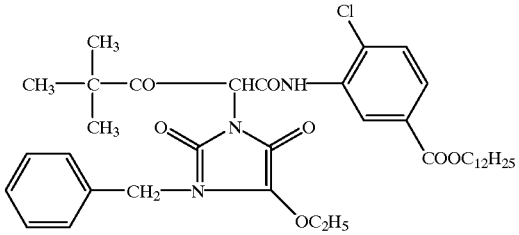
Y-15
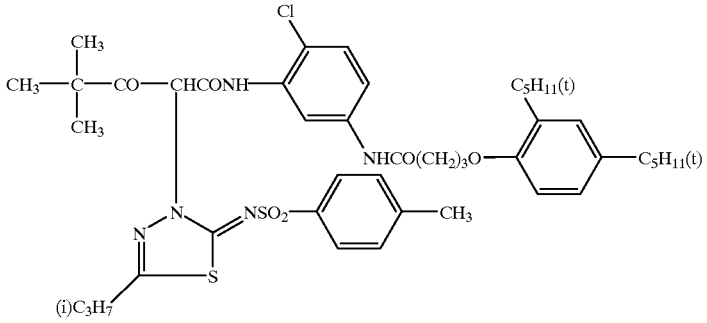
Y-16
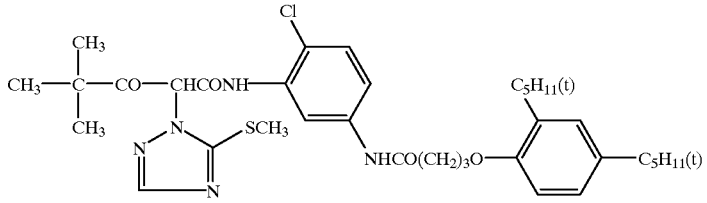
Y-17
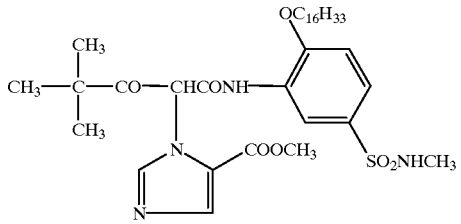

-continued
Y-18
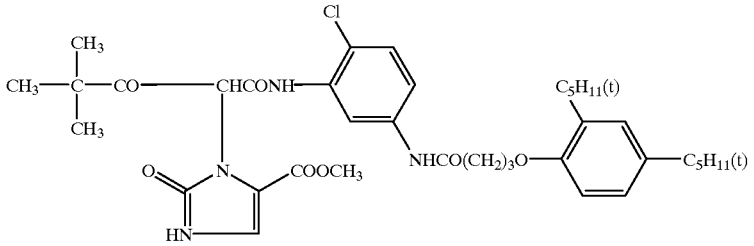
Y-19
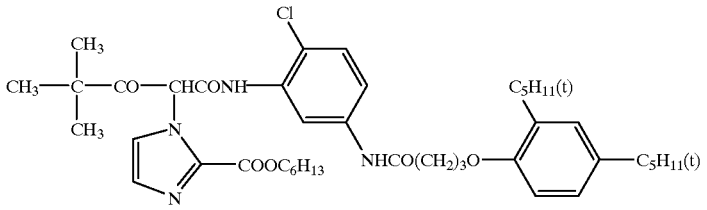
Y-20
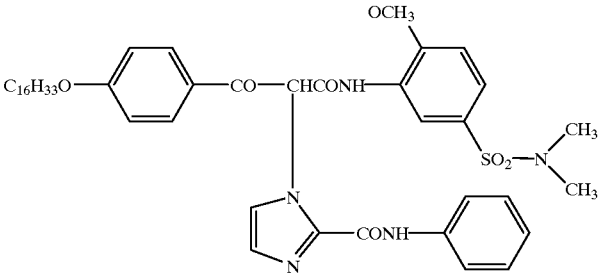
Y-21
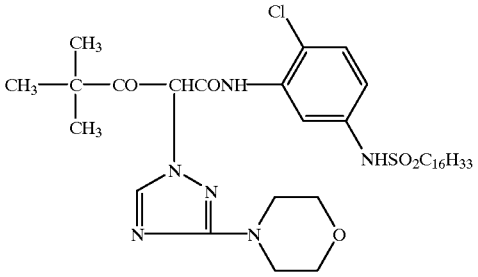
Y-22
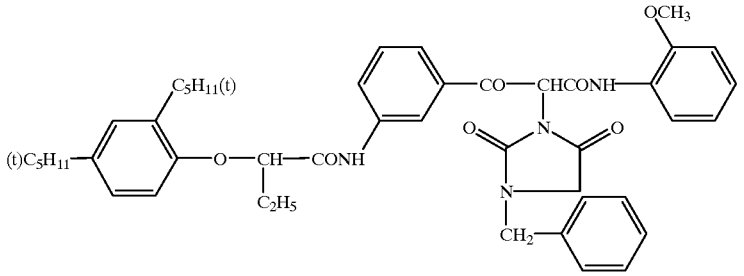
Y-23
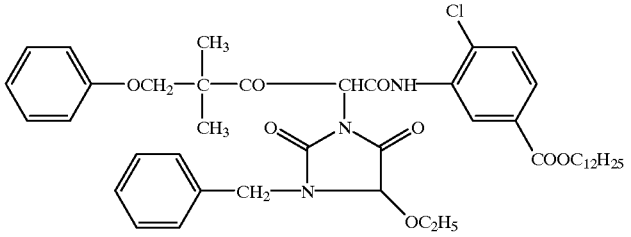

-continued
Y-24
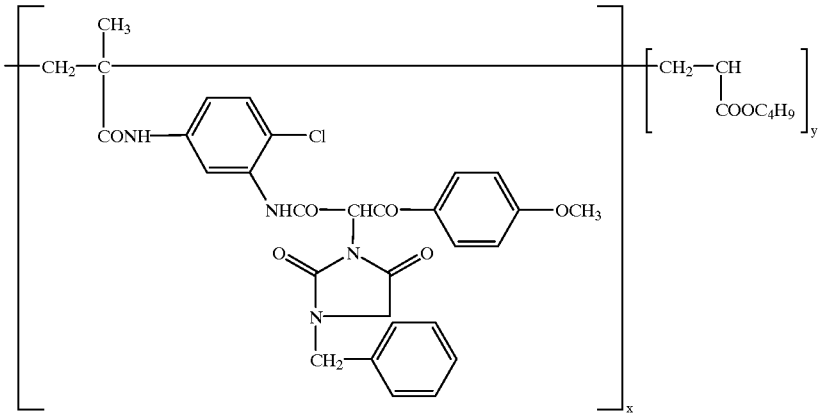
x:y = 50:50
(weight ratio)
Y-25
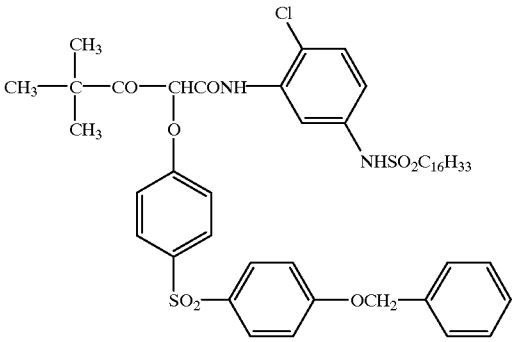
Y-26
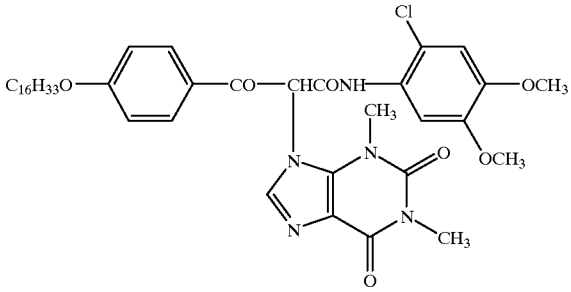
Y-27
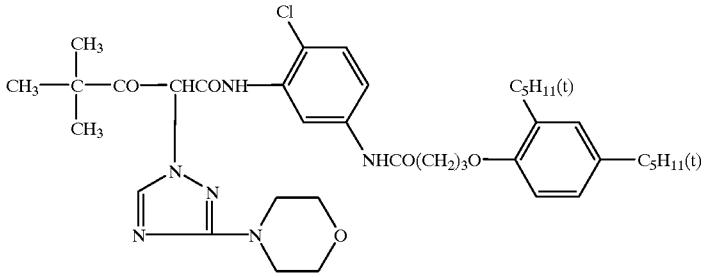

-continued
Y-28
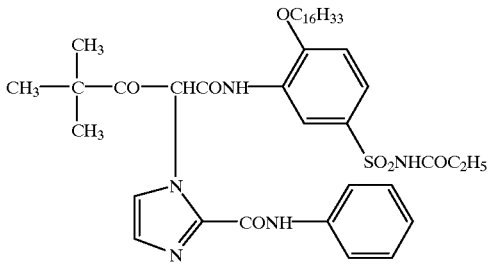
Y-29
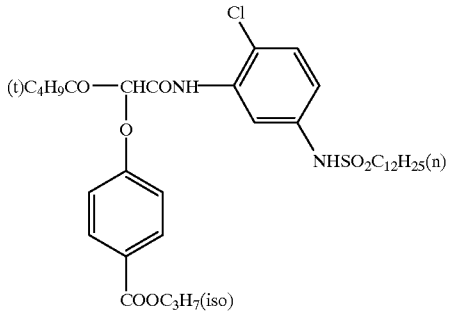
Y-30
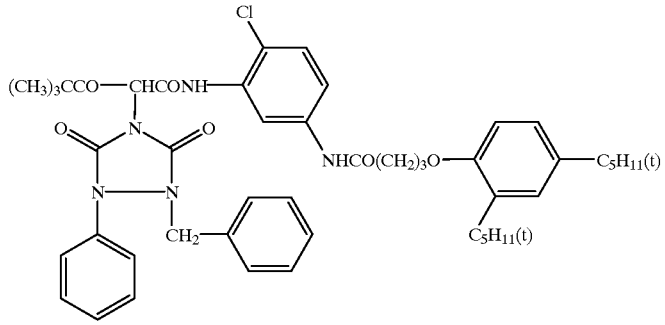
Y-31
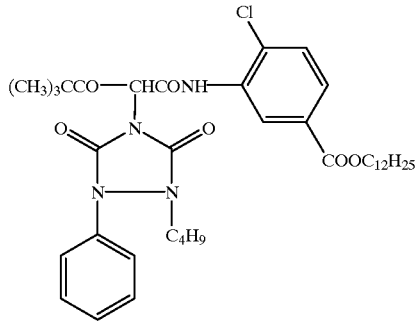
Y-32
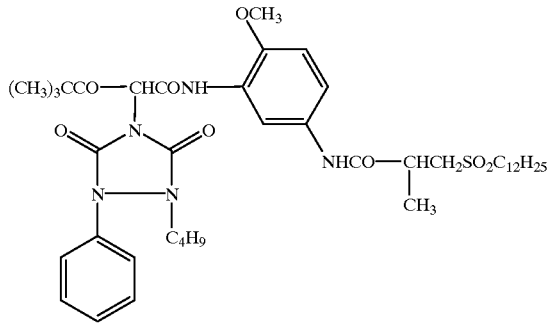

-continued
Y-33
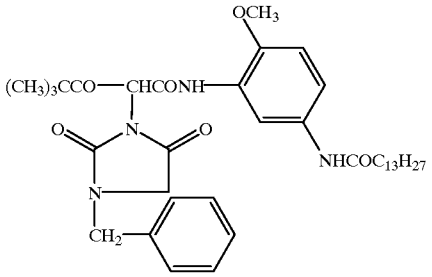
Y-34
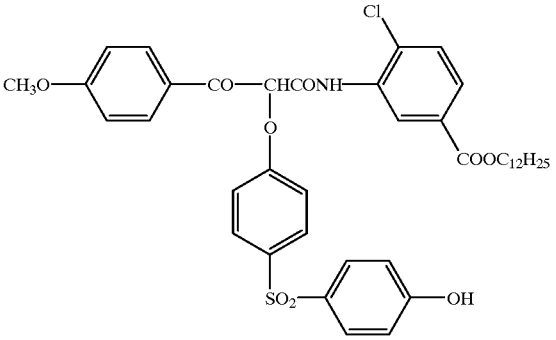
Y-35
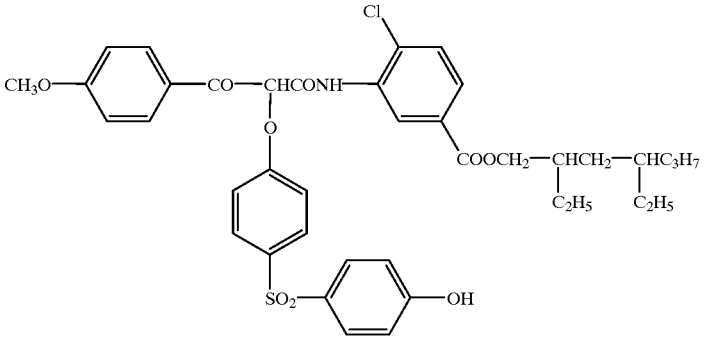
Y-36
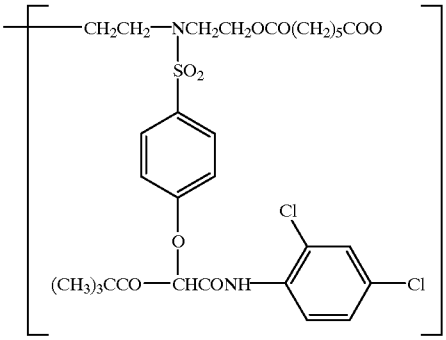

-continued
Y-37
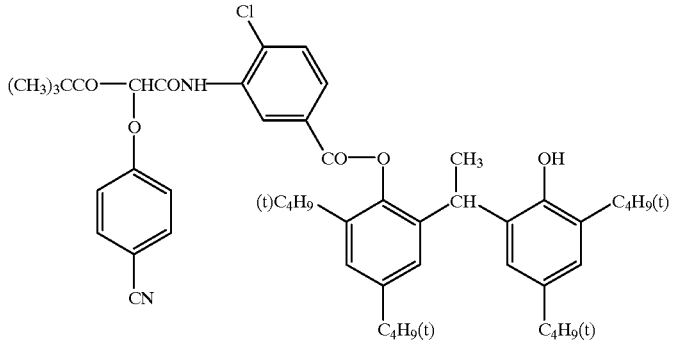
Y-38
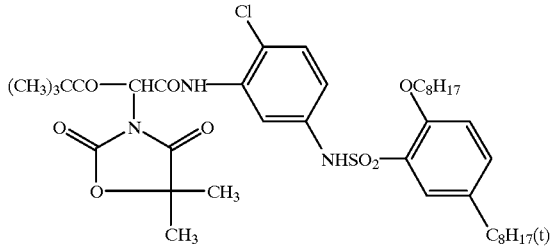
Y-39
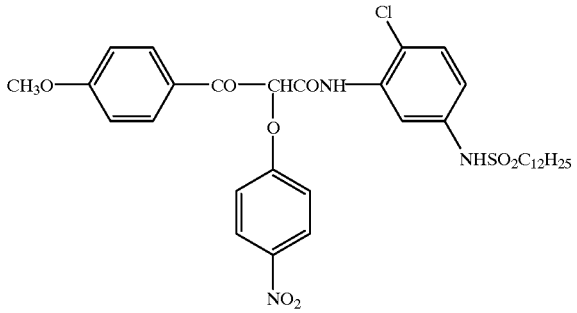
M-1
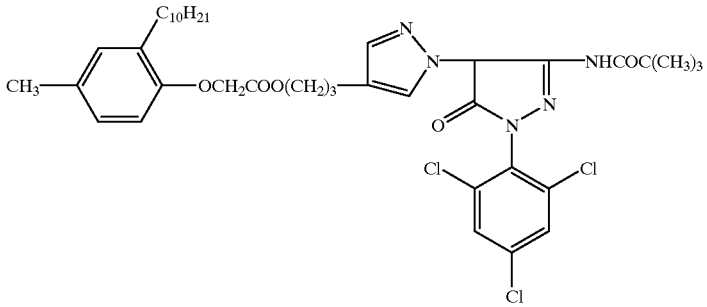
M-2
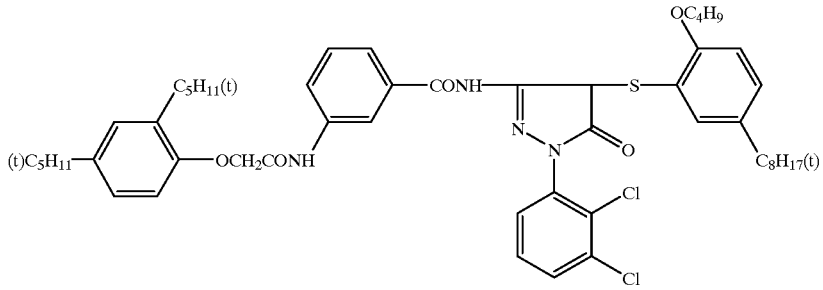

-continued
M-3
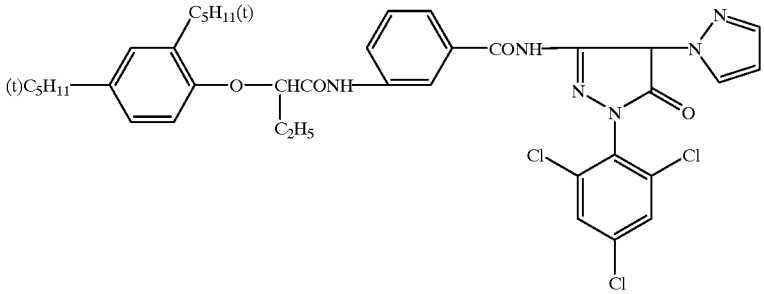
M-4
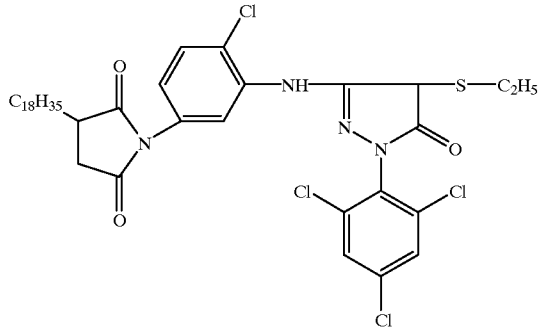
M-5
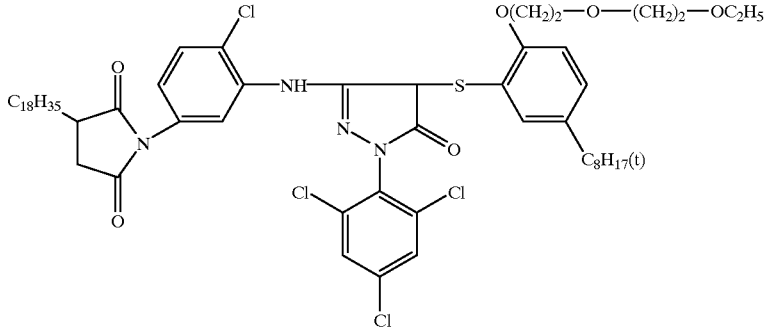
M-6
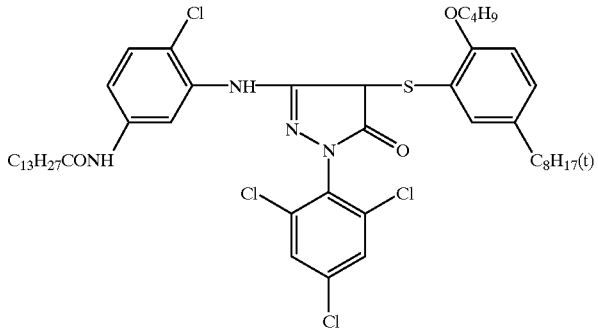

-continued
M-7
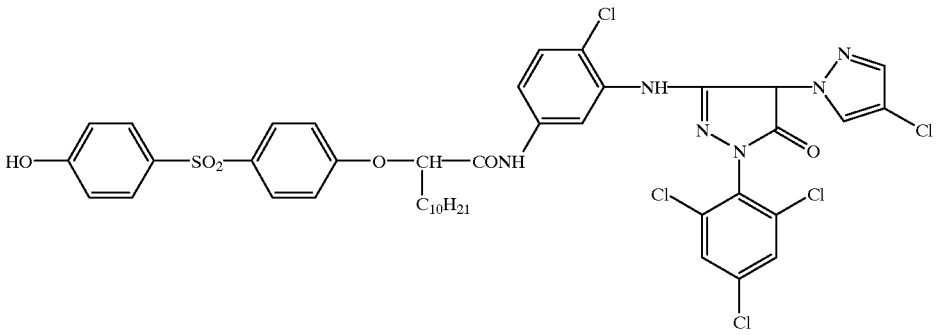
M-8
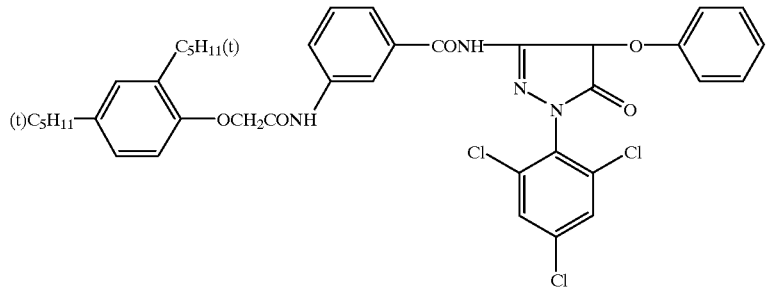
M-9
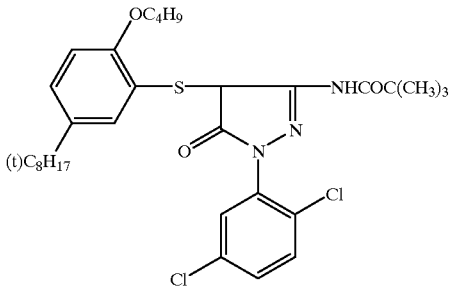
M-10
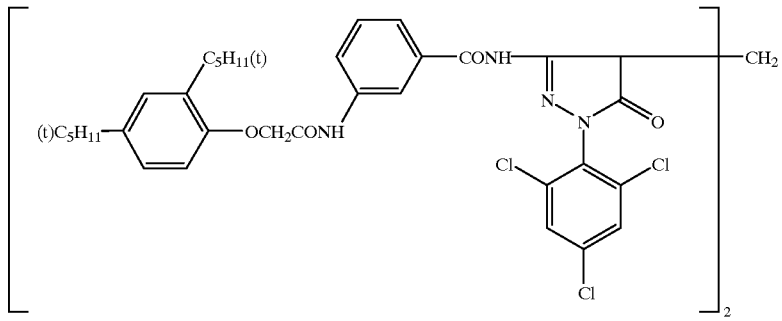
M-11
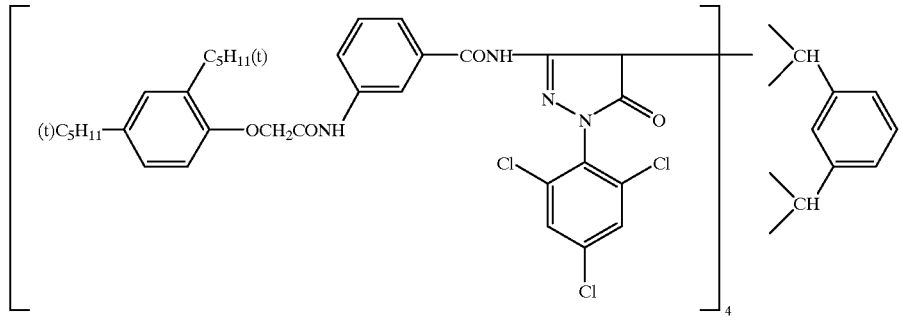

-continued
M-12
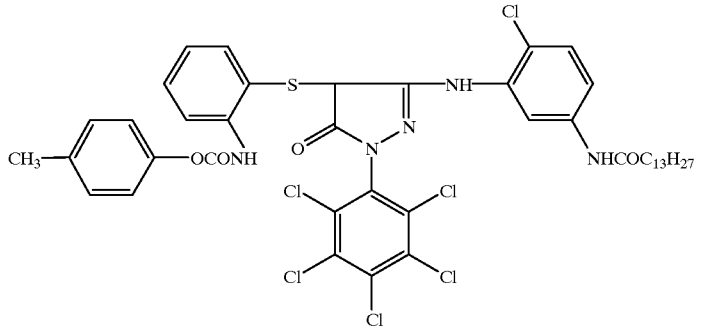
M-13
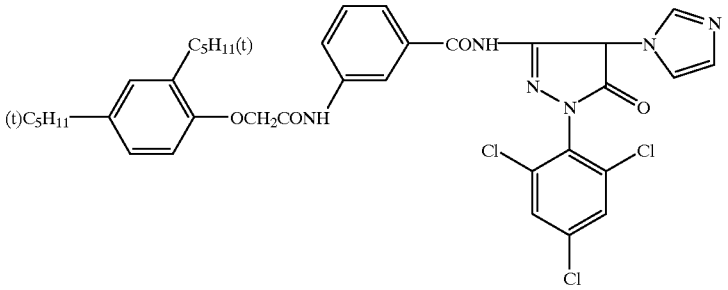
M-14
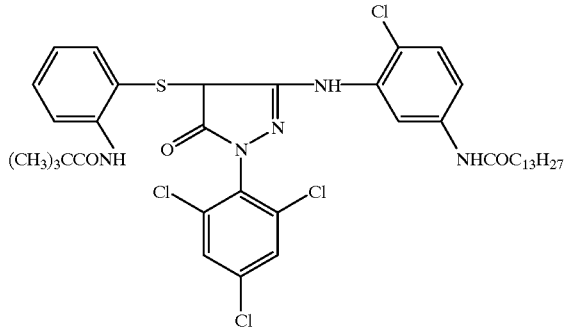
M-15
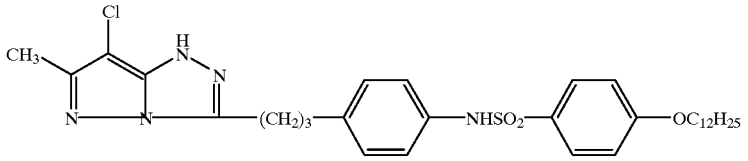
M-16
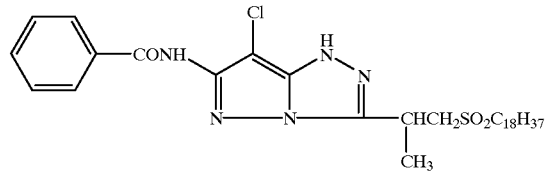
M-17
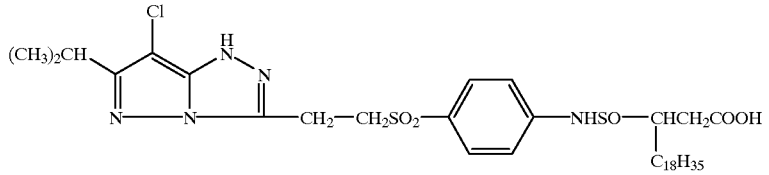

-continued
M-18
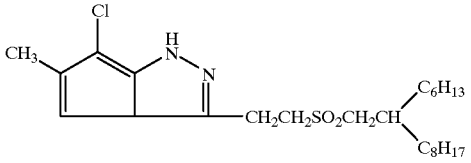
M-19
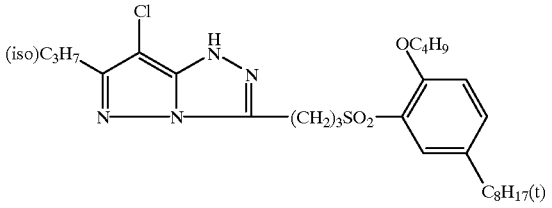
M-20
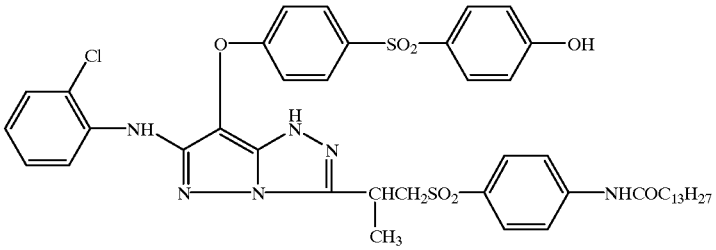
M-21
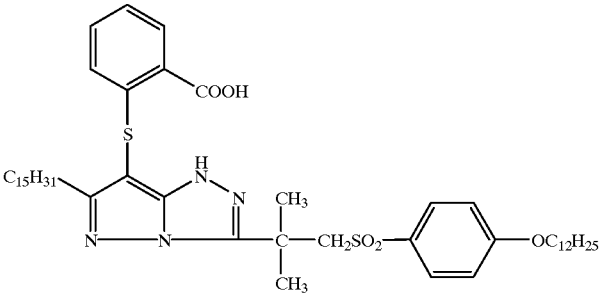
M-22
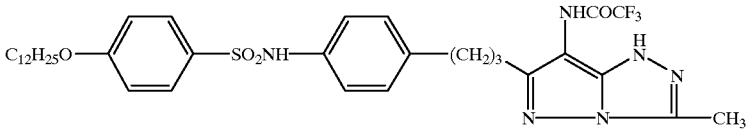
M-23
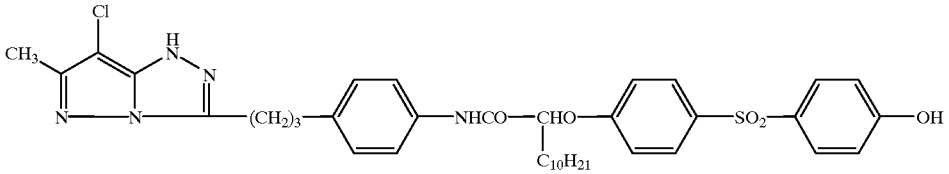
M-24
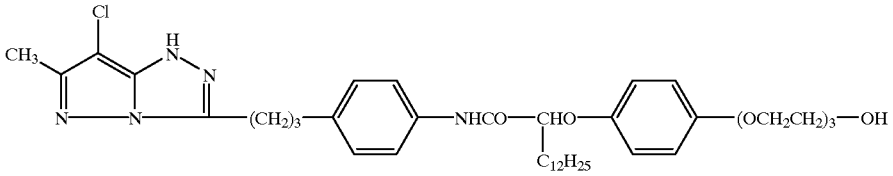

-continued
M-25
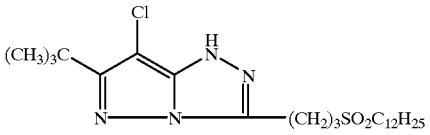
M-26
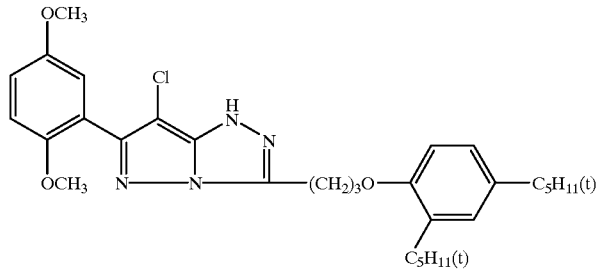
M-27
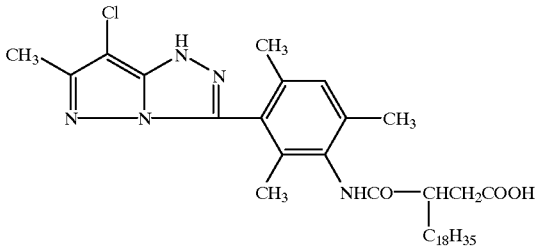
M-28
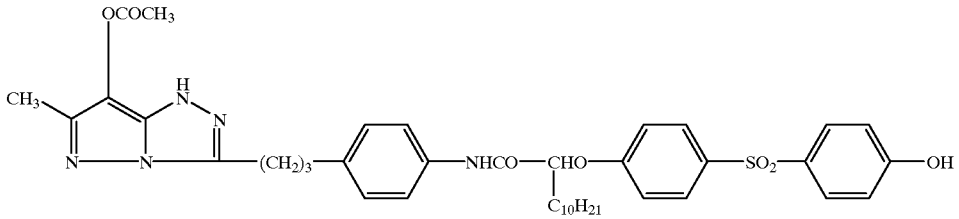
M-29
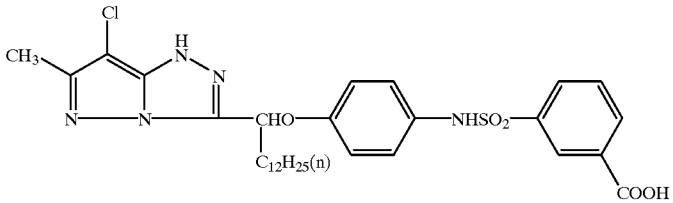

-continued
M-30
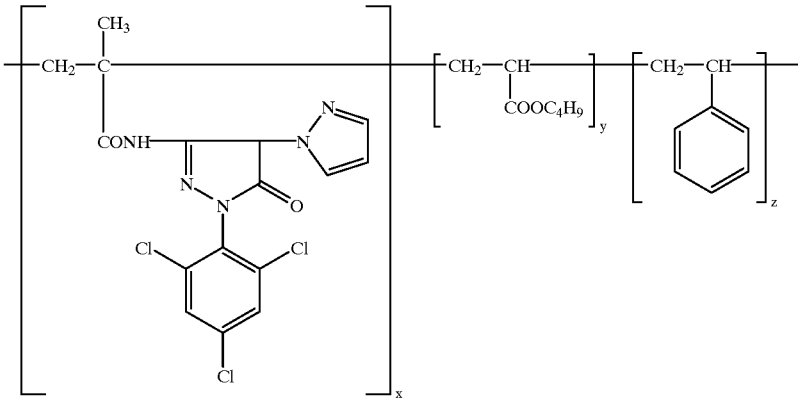
x:y:z = 50:25:25
(by weight ratio)
M-31
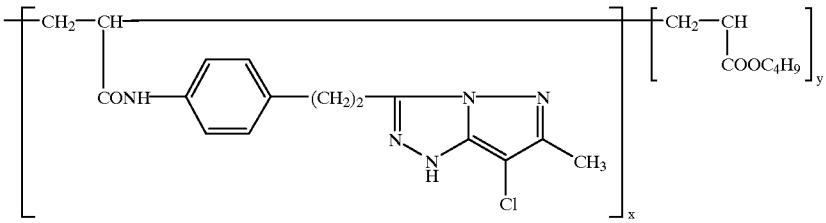
x:y = 50:50
(by weight ratio)
M-32
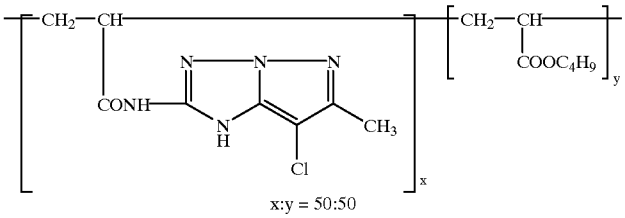
x:y = 50:50
(by weight ratio)
M-33
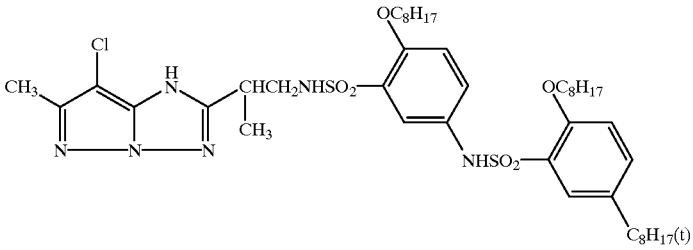
M-34
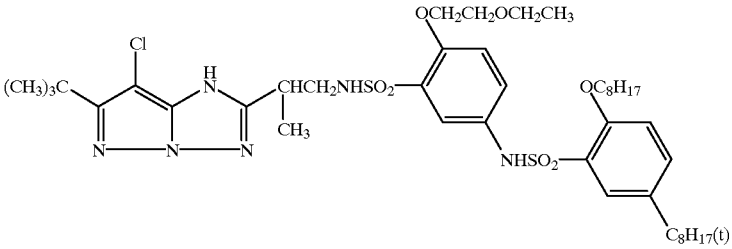

-continued
M-35
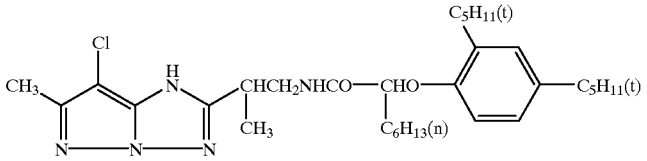
M-36
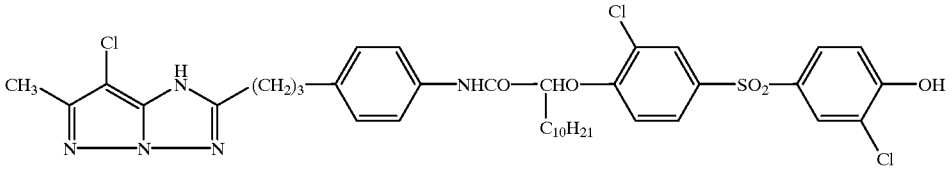
M-37
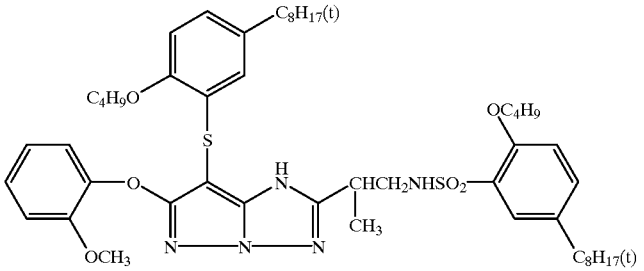
M-38
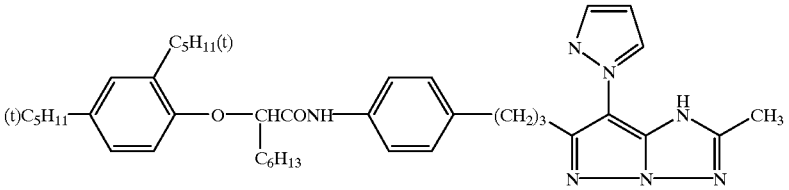
M-39
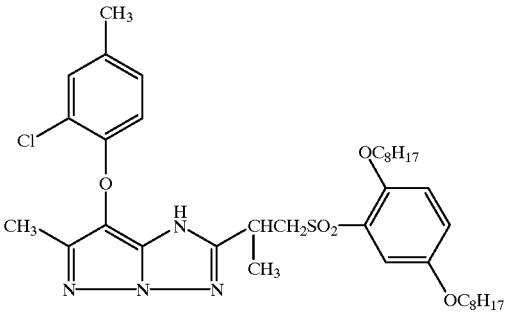
C-1
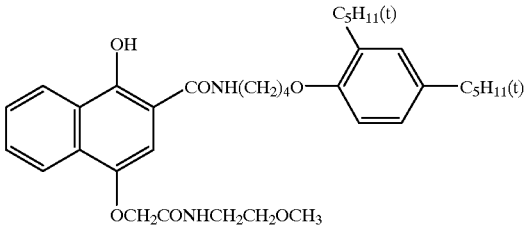

-continued
C-2
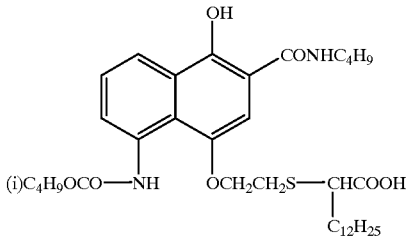
C-3
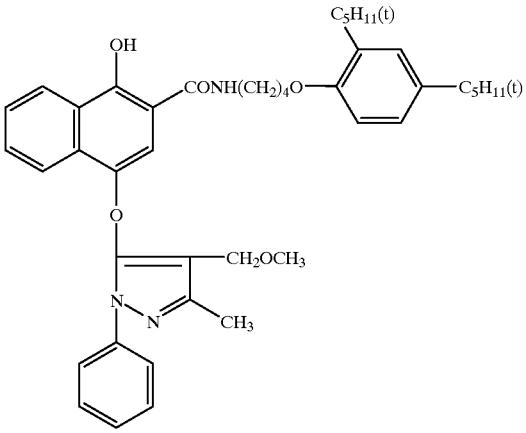
C-4
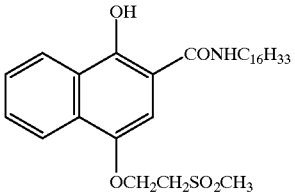
C-5
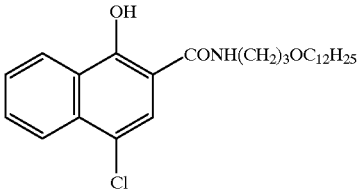
C-6
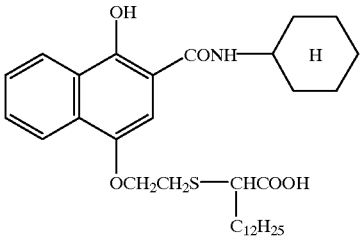
C-7
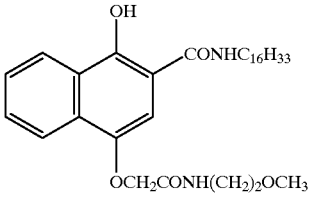

-continued
C-8
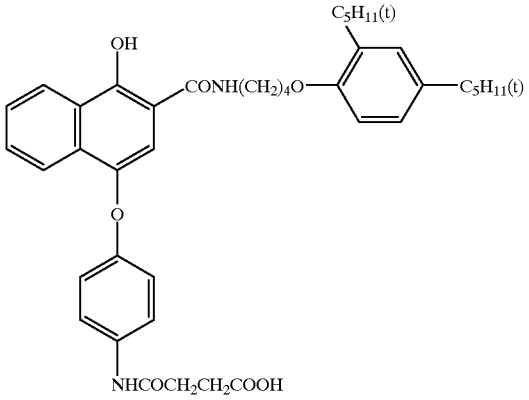
(C-9)
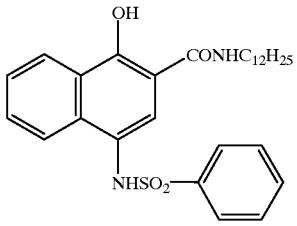
(C-10)
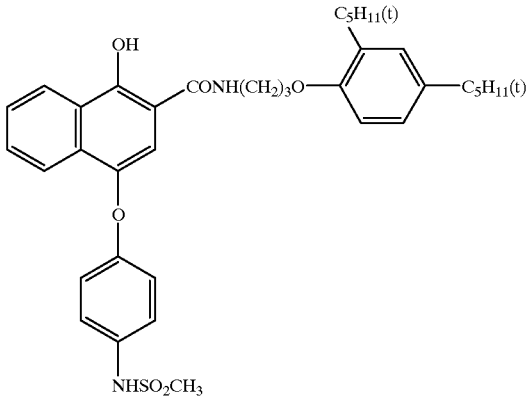
(C-11)
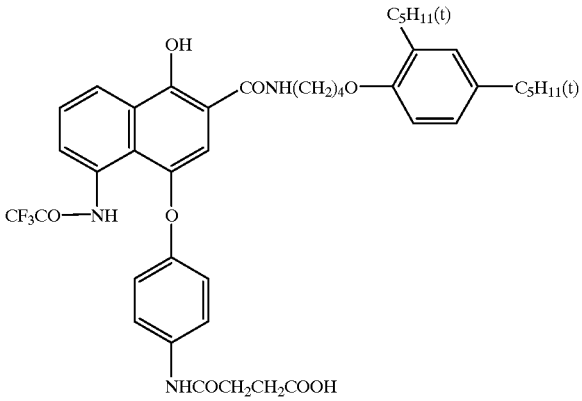

-continued
(C-12)
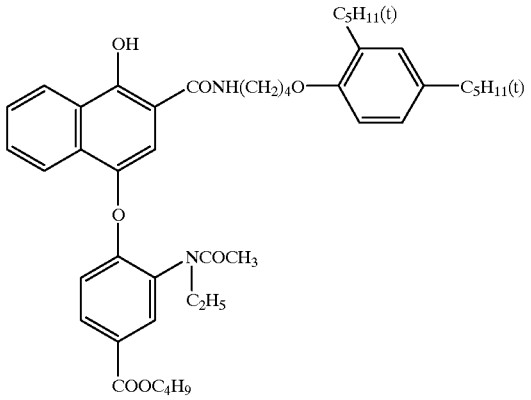
C-13
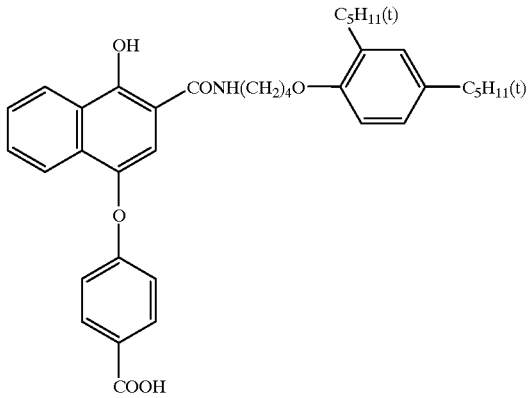
C-14
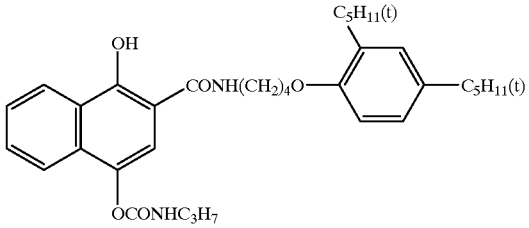
C-15
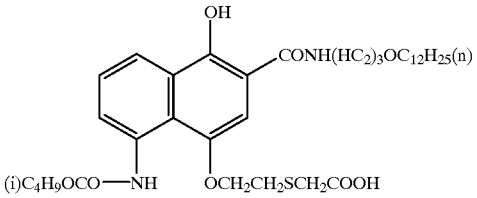
C-16
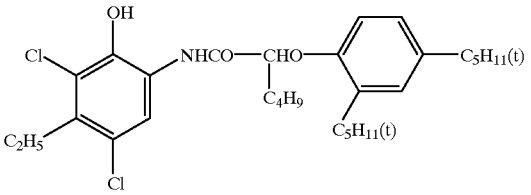

-continued
C-17
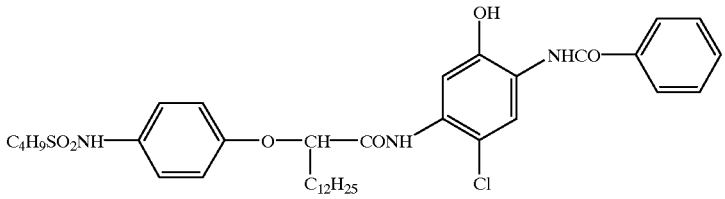
C-18
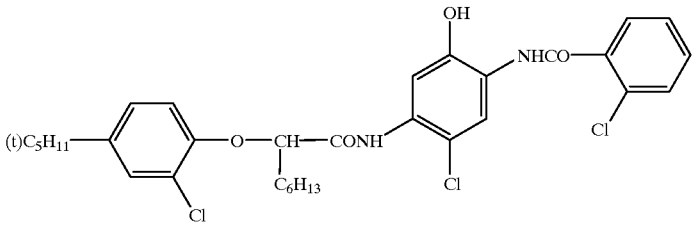
C-19
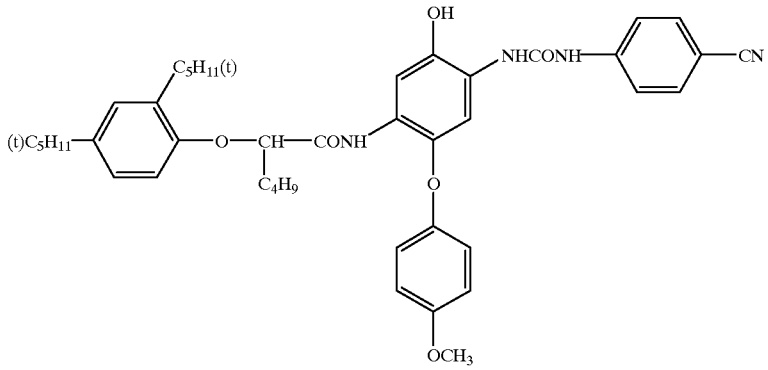
C-20
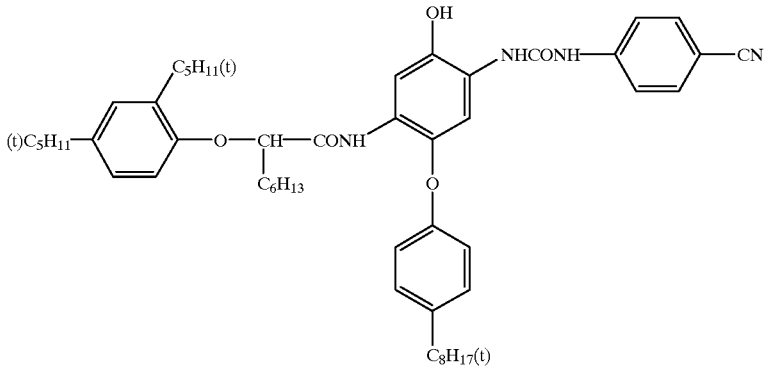
C-21
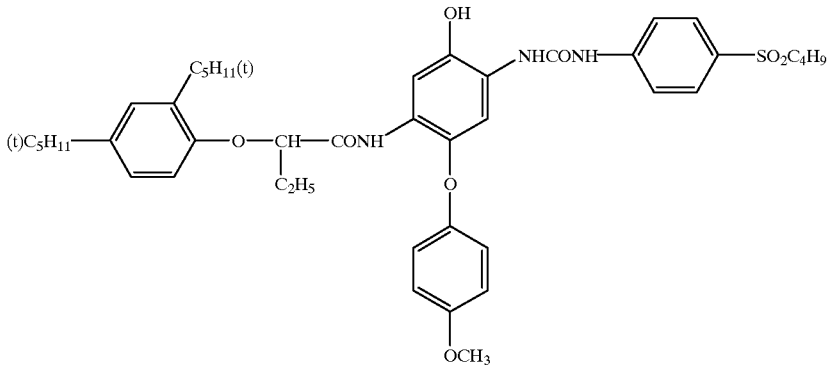

-continued
C-22
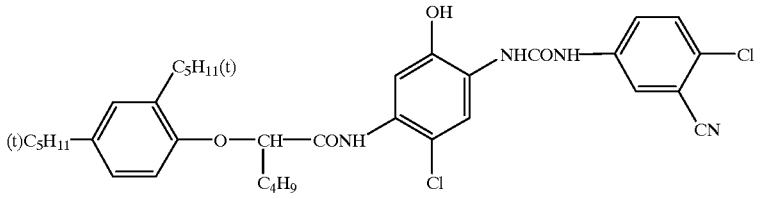
C-23
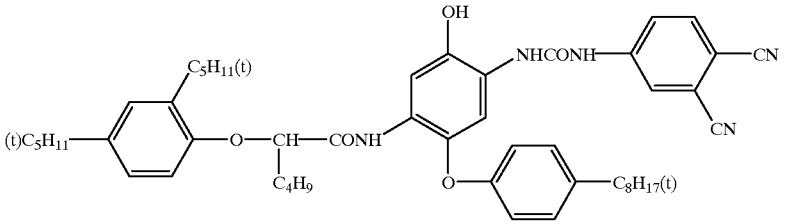
C-24
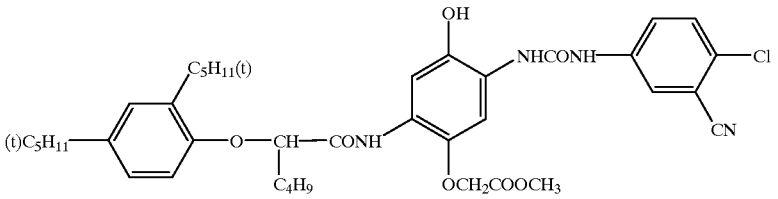
C-25
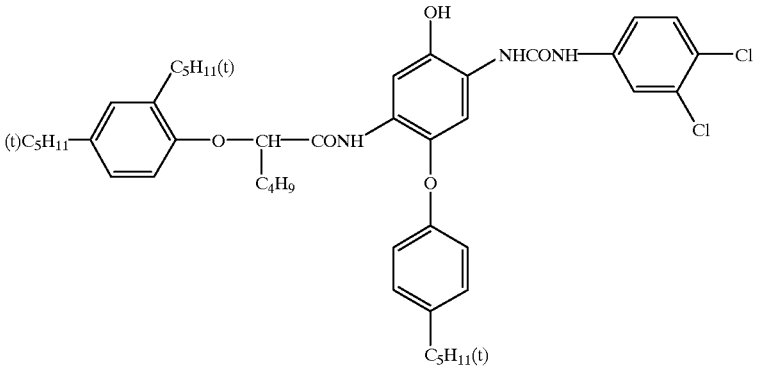
C-26
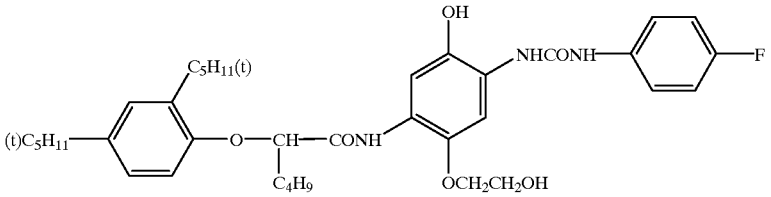

-continued
C-27
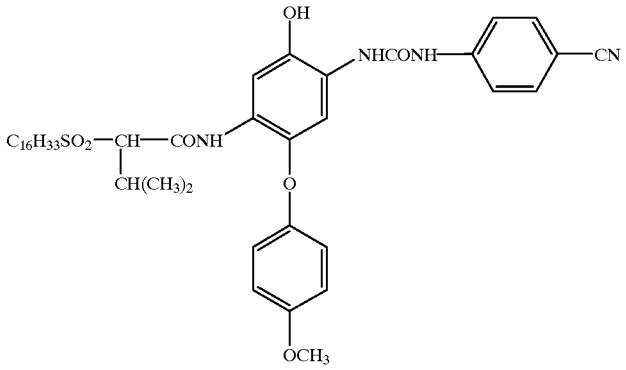
C-28
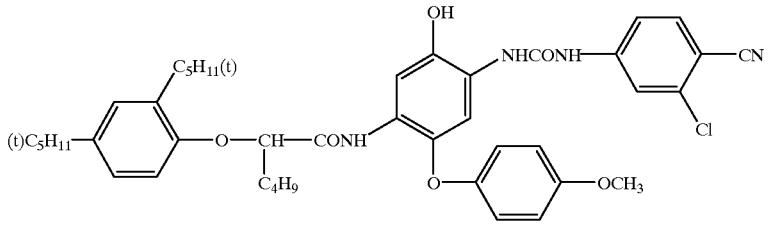
C-29
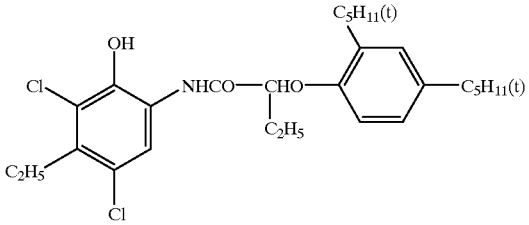
C-30
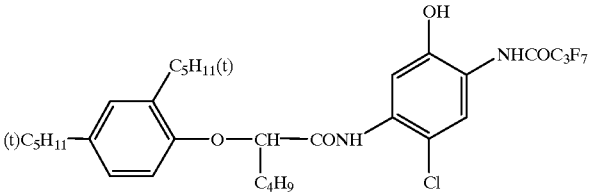
C-31
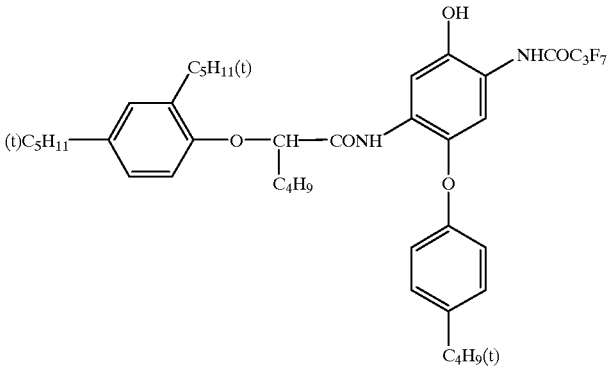

-continued
C-32
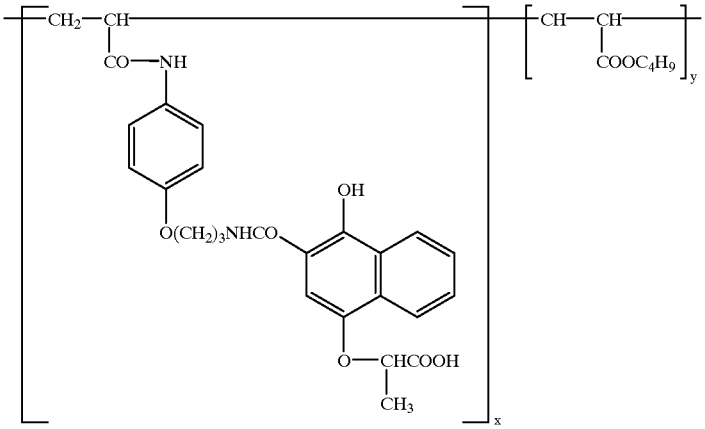
x:y = 40:60
(by weight ratio)
C-33
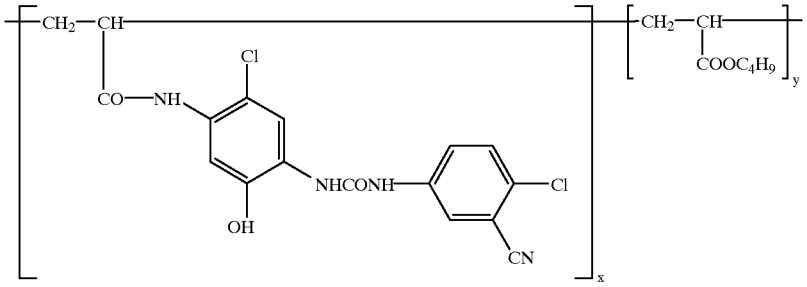
x:y = 50:50
(by weight ratio)
C-34
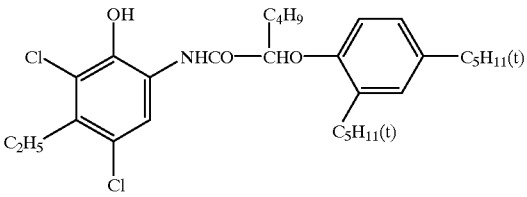
C-35
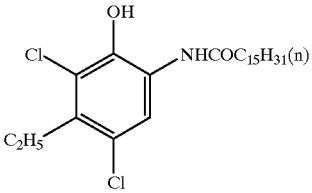
C-36
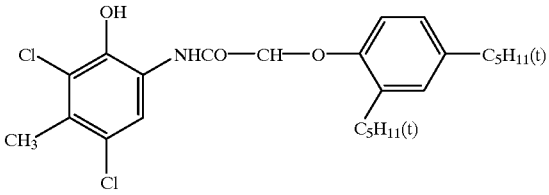

-continued

C-37

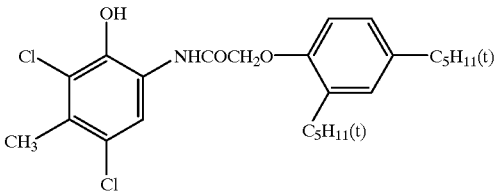

C-38

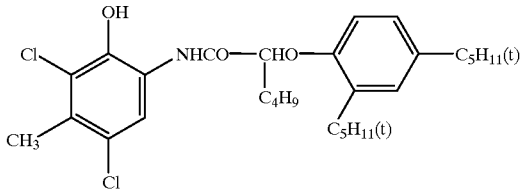

C-39

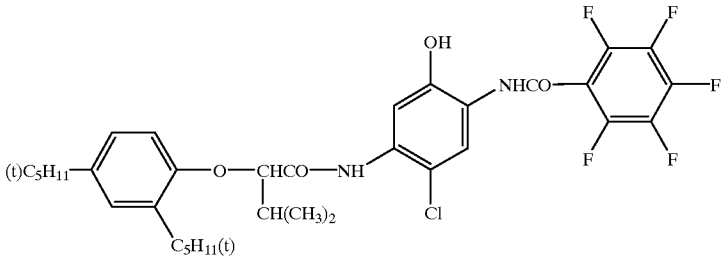

C-40

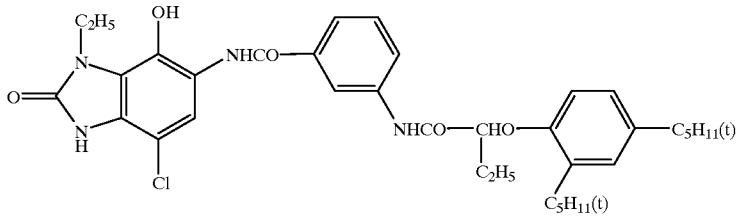

In the infrared-sensitive emulsion layer, the added amount of the two-equivalent yellow coupler is preferably $5\times10^{-5}$ to $2\times10^{-3}$ mol/m$^2$, more preferably $1\times10^{-4}$ to $2\times10^{-3}$ mol/m$^2$ and most preferably $2\times10^{-4}$ to $2\times10^{-3}$ mol/m$^2$. The added amount of the two-equivalent magenta coupler is preferably $2\times10^{-5}$ to $1\times10^{-3}$ mol/m$^2$, most $2\times10^{-5}$ to $1\times10^{-3}$ mol/m$^2$ and specifically more preferably $1\times10^{-4}$ to $1\times10^{-3}$ mol/m$^2$. The added amount of the two-equivalent cyan coupler is preferably $5\times10^{-5}$ to $2\times10^{-3}$ mol/m$^2$, more preferably $1\times10^{-4}$ to $2\times10^{-3}$ mol/m$^2$ and most preferably $2\times10^{-4}$ to $2\times10^{-3}$ mol/m$^2$.

In order to add a coupler to the silver halide emulsion, a coupler is dissolved in a high boiling solvent, together with a low boiling solvent as necessary. The resulting mixture is mixed with an aqueous gelatin solution containing a surfactant. The resulting solution is emulsified to be dissolved by means of a high speed rotation mixer, a colloid mill, a ultrasonic dispersant and a capillary type emulsifying device. The above-mentioned high boiling solvents include carboxylic acid esters, phosphoric acid esters, carboxylic acid amides, ethers and substituted hydrocarbons. Practically, di-n-butylphthanol acid ester, diisooctylphthanolic ester, dimethoxyethylphthanol acid ester, di-n-butyladipinic acid ester, diisooctyladipinic acid ester, tri-n-butylcitric acid ester, butyl lauric acid ester, di-n-sebacic acid ester, tricrezylphosphoric acid ester, tri-n-butylphosphoric acid ester, triisooctyl phosphoric acid ester, N, N-diethyl caprylic acid amide, N, N-dimethyl palmitinic acid amide, n-butylpentadecylphenylether, ethyl-2,4-di-tert-butylphenylether, succinic acid dioctylester and maleic acid dioctylester are cited. As a low boiling solvent, ethyl acetate, butyl acetate, cyclohexane and butylpropionate are cited.

As the colored coupler to be added to the invisible light-sensitive emulsion layer, colored couplers conventional in the field of color photography is usable. The colored coupler has color hue even when unreacted. It may form a dye image such as a yellow, magenta, cyan and black due to coupling reaction with a color developing agent or it may become colorless. Generally, aforesaid colored coupler is referred to as those whose color hue unreacted is different from the color hue after being colored.

A colored coupler preferable in the present invention is at least one selected from a yellow-colored magenta coupler, a magenta-colored cyan coupler or a yellow-colored cyan coupler.

A yellow-colored magenta coupler is defined to have an absorption maximum from 400 nm to 500 nm in the visible absorption region of the coupler and concurrently with this, forms a magenta coupler in which the absorption maximum in the visible absorption region after coupling with an oxidized product of an aromatic group primary amine is from 510 to 580 nm.

In the invention, the yellow-colored magenta coupler is preferably represented by the following Formula XII.

$C_p—N=N—R_1$ Formula XII wherein $C_p$ is a magenta coupler residual group in which an azo group bonds with an active position; and $R_1$ is a substituted or unsubstituted aryl group.

As a magenta coupler residual group represented by $C_p$, coupler residual groups introduced from a 5-pyrazolone magenta coupler and a pyrazolotriazole-containing magenta coupler are preferable. The specifically preferable are residual groups represented by the following Formula XIII.

Formula XIII

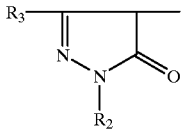

wherein $R_2$ is a substituted or unsubstituted aryl group; $R_3$ is an acylamino group, an anilino group, an ureido group or a carbamoyl group; these may all have a substituent.

As an aryl group represented by $R_2$, the preferable is a phenyl group. As a substituent for an aryl group, a halogen atom, an alkyl group such as a methyl group and an ethyl group, an alkoxy group such as a methoxy group and an ethoxy group, an aryloxy group such as a phenyloxy group and a naphtyloxy group, an acylamino group such as a benzamide group and an α-(2,4-di-t-amylphenoxy) butylamide group, a sulfonylamino group such as a benzenesulfonamido group and an n-hexadecanesulfonamido group, a sulfamoyl group such as a methylsulfamoyl group and a phenylsulfamoyl group, a carbamoyl group such as an n-butylcarbamoyl group and a phenylcarbamoyl group, a sulfonyl group such as a methylsulfonyl group, an n-dodecylsulfonyl group and a benzenesulfonyl group, an acyloxy group, an ester group, a carboxyl group, a sulfo group, a cyano group and a nitro group are cited.

As a practical examples of $R_2$, phenyl, 2,4,6-trichlorophenyl, pentachlorophenyl, pentafluorophenyl, 2,4,6 -trimethylphenyl, 2-chloro-4,6-dimethylphenyl, 2,6-dichloro-4-methylphenyl, 2,4-dichloro-6-methylphenyl, 2,6-dichloro-4-methoxyphenyl, 2,6-dichloro-4-[α-(2,4-di-t-amylphenoxy)acetoamide]phenyl are cited.

As an acylamino group represented by $R_3$, a pivaloylamino, an n-tetradecaneamide, an α-(3-pentadecylphenoxy)butylamide, a 3-[α-(2,4-di-t-amylphenoxy)acetoamide]benzamide, benzamide, a 3-acetoamidebenzamide, a 3-(3-n-dodecylsuccineimide) benzimide and a 3-(4-n-dodecyloxybenzenesulfoneamide) benzamide are cited.

As an anilino group represented by $R_3$, an anilino group, a 2-chloroanilino group, a 2,4-dichloroanilino group, a 2,4-dichloro-5-methoxyanilino group, a 4-cyanoanlino group, a 2-chloro-5-[α-(2,4-di-t-amylphenoxy)butylamide]anilino group, a 2-chloro-5-(3-octadecenylsuccineimide)anilino group, a 2-chloro-5-n-tetradecaneamideanilino group, a 2-chloro-5-[α-(3-t-butyl-4-hydroxyphenoxy) tetradecaneamide]anilino group and 2-chloro-5-n-hexadecanesulfonamide anilino group are cited.

As a ureido group represented by $R_3$, a methylureido group, a phenyl ureido group and a 3-[α-(2,4-di-t-amylphenoxy)butylamide]phenylureido group are cited.

As a carbamoyl group represented by $R_3$, an n-tetradecylcarbamoyl group, a phenylcarbamoyl group and a 3-[α-(2,4-di-t-amylphenoxy)acetoamide]phenyl carbamoyl group are cited.

As an aryl group represented by $R_1$, a phenyl group or a naphthyl group is preferable.

As a substituent of an aryl group represented by $R_1$, a halogen atom, an alkyl group, an alkoxy group, an aryloxy group, a hydroxy group, an acyloxy group, a carboxyl group, an alkoxycarbonyl group, an aryloxycarbonyl group, an alkylthio group, an arylthio group, an alkylsulfonyl group, an arylsulfonyl group, an acyl group, a sulfonamide group, a carbamoyl group and a sulfamoyl group are cited. Specifically preferable substituents are an alkyl group, a hydroxy group, an alkoxy group and an acylamino group.

Hereinafter, practical examples of a yellow-colored magenta coupler will be exhibited.

YCM-1

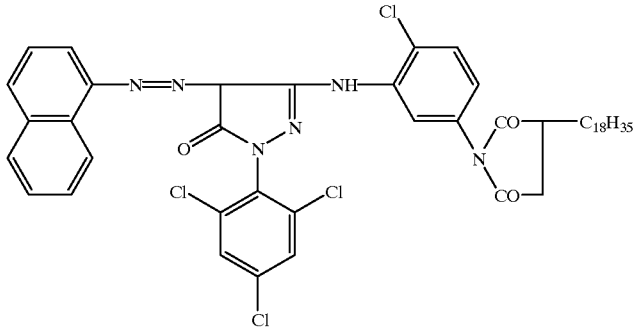

-continued
YCM-2
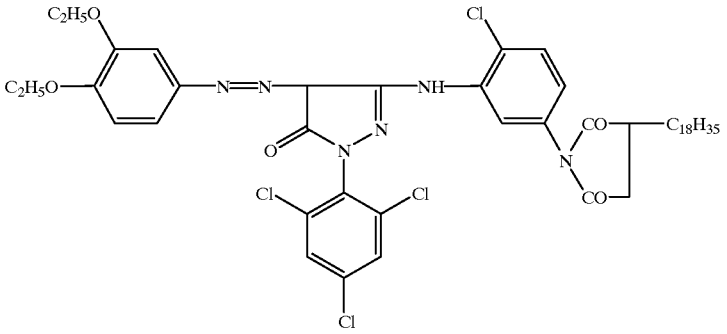
YCM-3
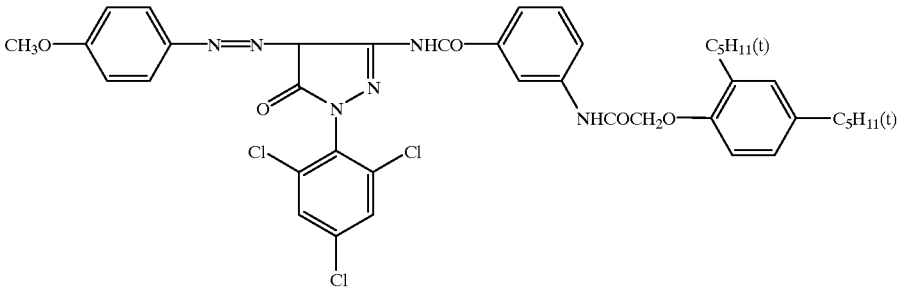
YCM-4
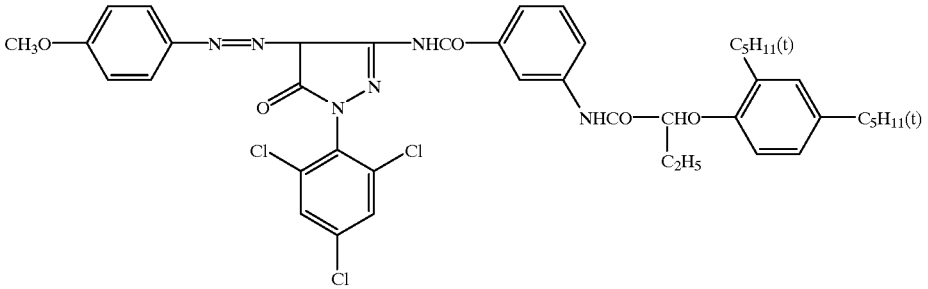
YCM-5
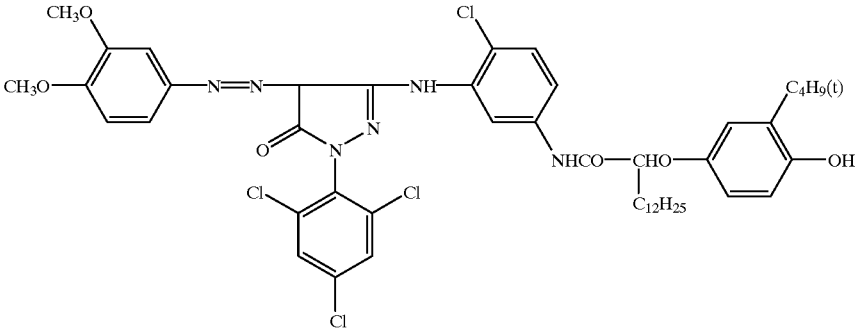

-continued
YCM-6
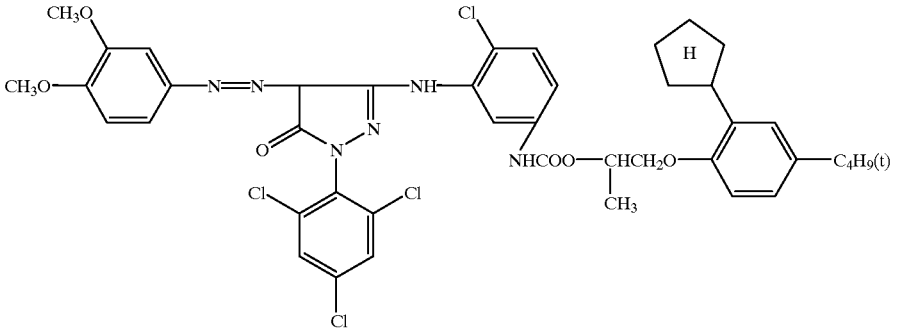
YCM-7
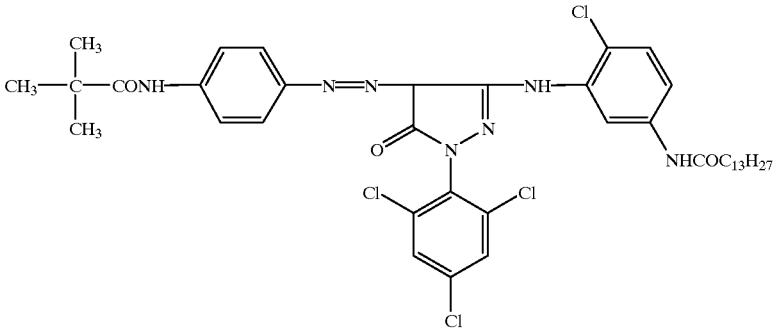
YCM-8
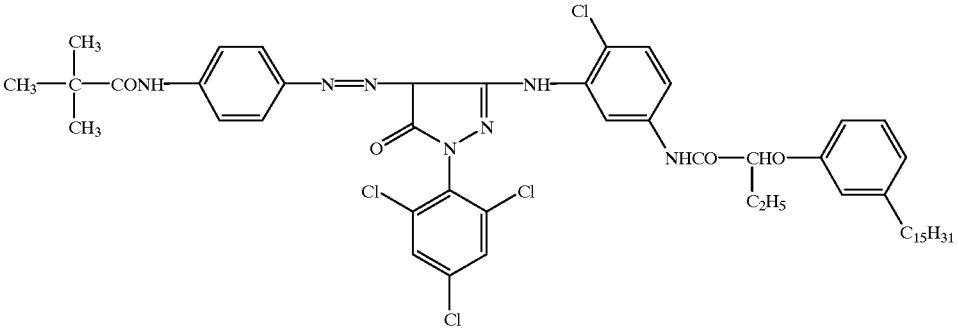
YCM-9
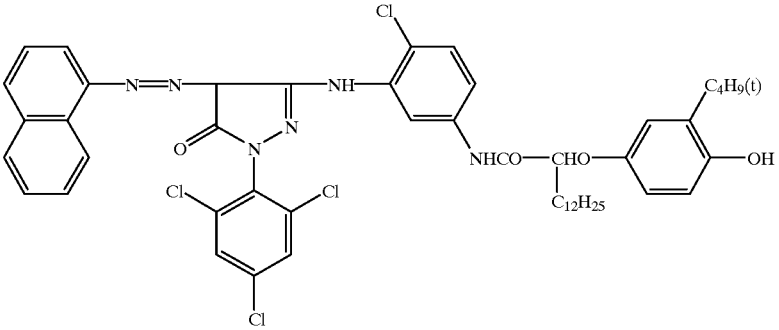

-continued
YCM-10
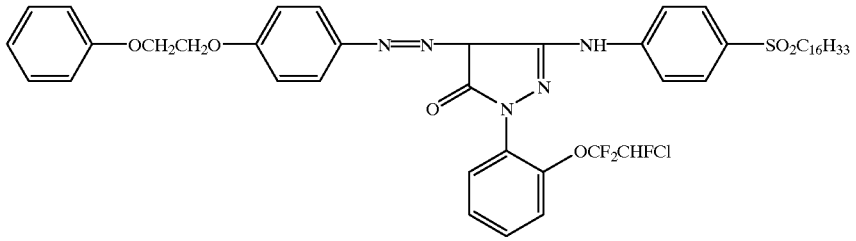
YCM-11
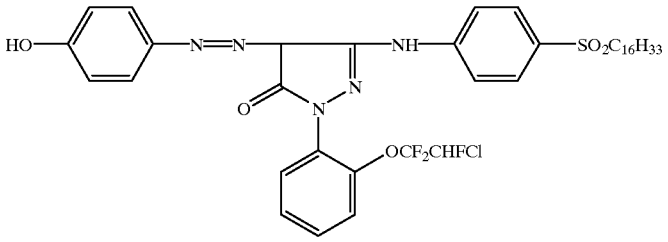
YCM-12
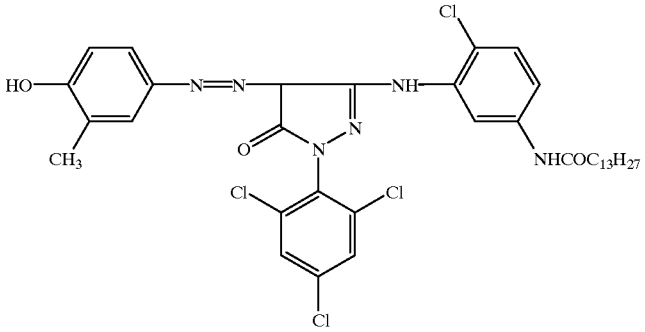
YCM-13
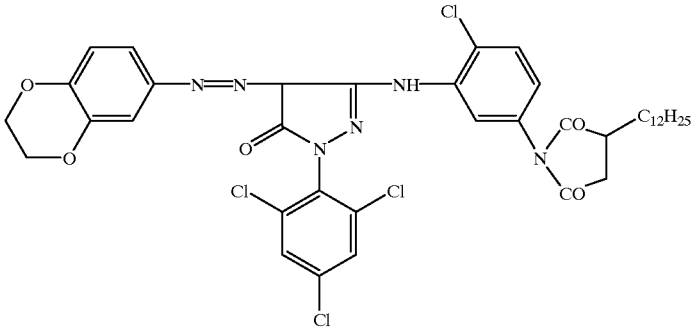
YCM-14
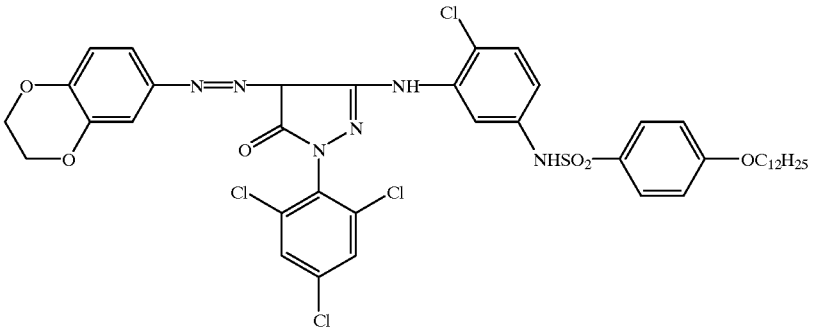

-continued
YCM-15
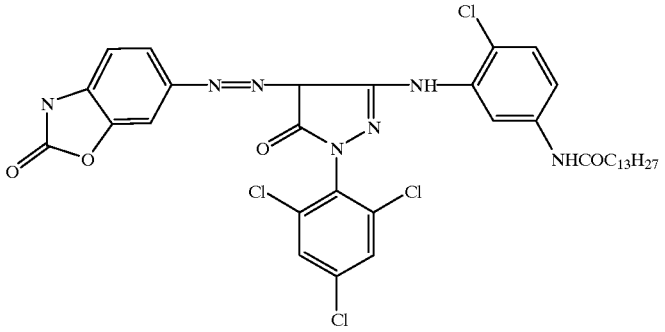
YCM-16
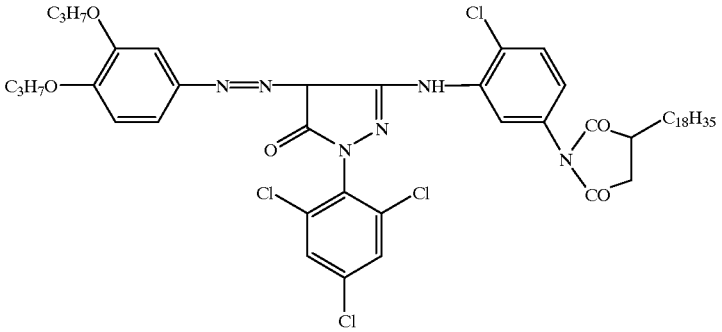
YCM-17
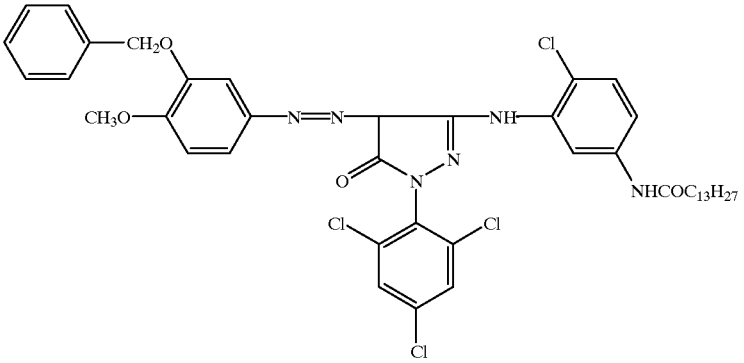
YCM-18
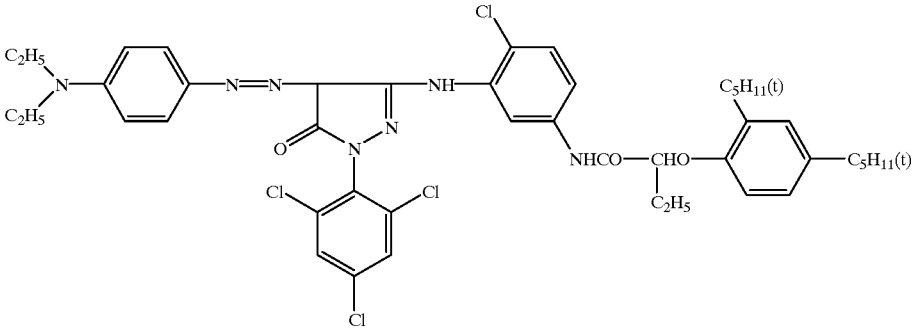

-continued

YCM-19

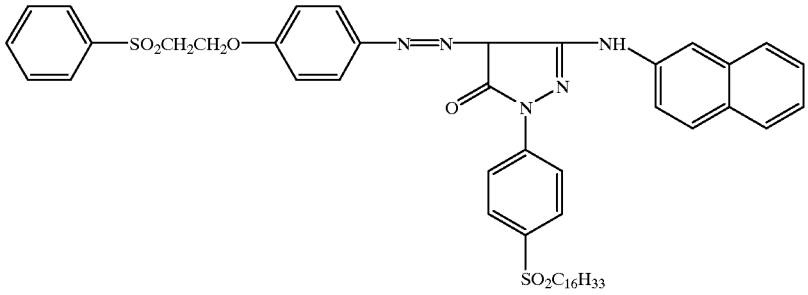

YCM-20

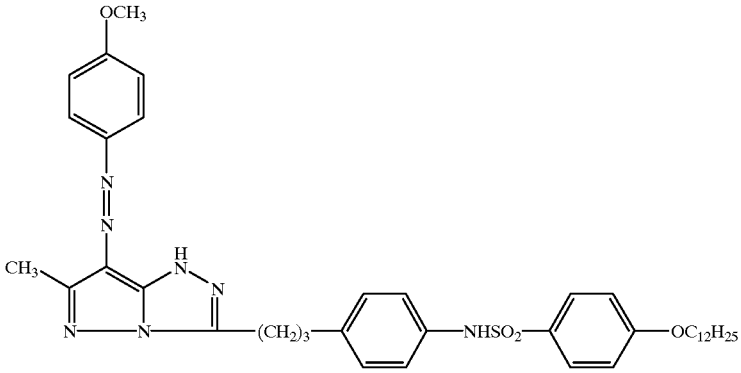

The above-mentioned yellow-colored magenta coupler can be synthesized in reference to methods described in Japanese Patent O.P.I. Publication Nos. 123625/1974, 131448/1974, 42121/1977, 102723/1977, 52532/1979 and 172647/1983 and U.S. Pat. Nos. 2,763,552, 2,801,171 and 3,519,429.

In the present invention, a magenta-colored cyan coupler has an absorption maximum at visible absorption region of a coupler from 500 to 600 mm. Concurrently with this, it forms a cyan dye in which the absorption maximum in the visible absorption region is 630 to 750 nm due to coupling with an oxidized product of an amine color developing agent.

A magenta coupler of the present invention is preferably a compound represented by the following Formula XIV.

Formula XIV

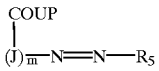

wherein COUP is a cyan coupler residual group; J is a divalent combination group; m is 0 or 1; and $R_5$ is an aryl group.

As a cyan coupler residual group represented by the COUP, a phenol type coupler residual group and a naphthol type coupler residual group are cited. Preferable is a naphthol type coupler residual group.

As a divalent combination group represented by J, those represented by the following Formula XV are preferable.

Formula XV

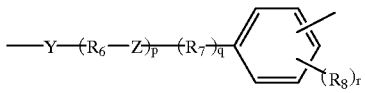

wherein Y represents

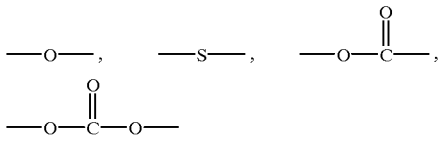

$R_6$ is an alkylene group or an arylene group respectively having 1 to 4 carbon atoms; $R_7$ is an alkylene group having 1 to 4 carbon atoms; an alkylene group represented by $R_6$ and $R_7$ may be substituted by an alkyl group, a carboxyl group, a hydroxy group and a sulfo group.

Z is a —C($R_9$)($R_{10}$)—, an —O—, an —S—, an —SO—, an —$SO_2$—, —$SO_2$NH—, a —CONH—, a —COO—, an —NHCO—, an $NHSO_2$— and an —OCO—; and $R_9$ and $R_{10}$ independently is an alkyl group and an aryl group.

$R_8$ is an alkyl group, an aryl group, a heterocycle, a hydroxy group, a cyano group, a nitro group, a sulfonyl group, an alkoxy group, and aryloxy group, a carboxy group, a sulfo group, a halogen atom, a carbonamide group, a sulfonamide group, a carbamoyl group, an alkoxycarbonyl group or a sulfamoyl group.

p is 0 or a positive integer; q is 0 or 1; r is an integer from 1 to 4. When p is 2 or more, $R_6$ and Z may be the same or different; when r is 2 or more, $R_8$ may be the same or different.

An aryl group represented by $R_5$ is preferably a phenyl group and a naphthyl group when m is 0. The above-mentioned phenyl group and naphthyl group may have a substituent. As aforesaid substituent, a halogen atom, an alkyl group, an alkoxy group, an aryloxy group, a hydroxy group, an acyloxy group, a carboxyl group, an alkoxycarbonyl group, an aryloxycarbonyl group, a mercapto group, an alkylthio group, an alkylsulfonyl group, an arylsulfonyl group, an acyl group, an acylamino group, a sulfonamide group, a carbamoyl group and a sulfamoyl group are cited.

When m is 1, an aryl group represented by $R_5$ is preferably a naphthol group represented by the following Formula XVI.

Formula XVI

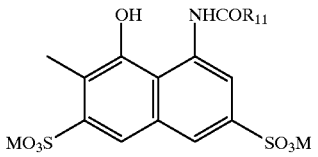

wherein $R_{11}$ is a straight-chain or branched alkyl group (a methyl group, an ethyl group, a propyl group, an isopropyl group, a butyl group, an s-butyl group and a t-butyl group) respectively having 1 to 4 carbons; M is a photographically inactive cation including a cation of a metallic alkali such as a hydrogen atom, a sodium atom and a potassium atom, ammonium, methyl ammonium, ethyl ammonium, diethyl ammonium, triethyl ammonium, ethanol ammonium, diethanol ammonium, pyridinium, piperidium, anilinium, toluidinium, p-nitroanilinium and aninedium.

Hereinafter, practical examples of a magenta-colored cyan coupler represented by Formula XVI will be exhibited.

MCC-1

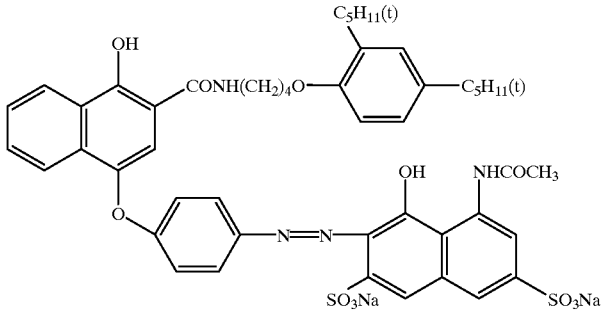

MCC-2

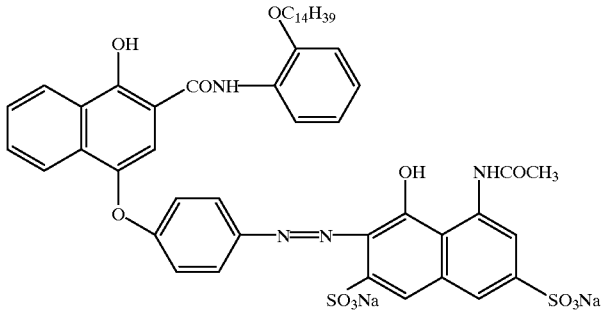

MCC-3

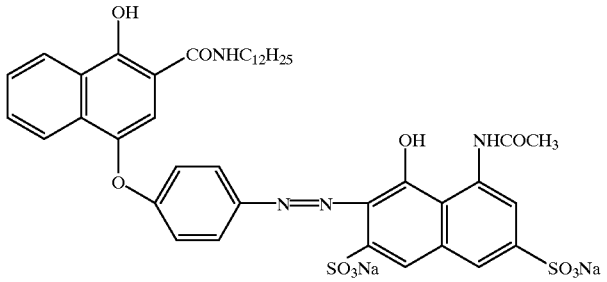

-continued
MCC-4
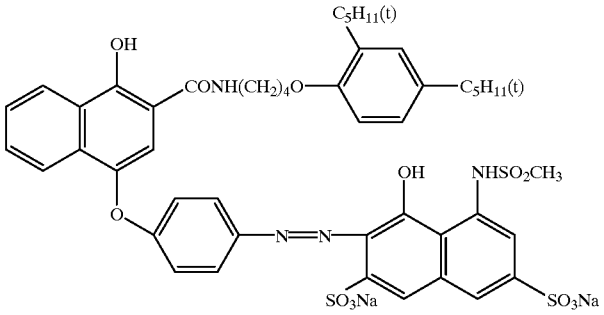
MCC-5
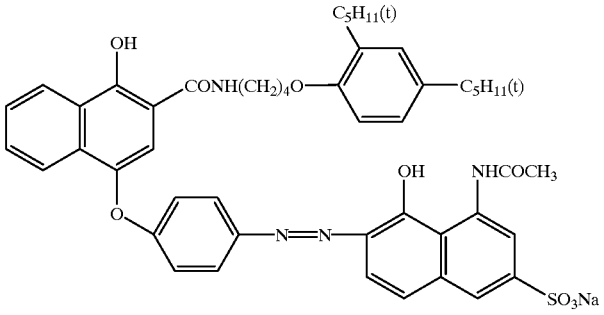
MCC-6
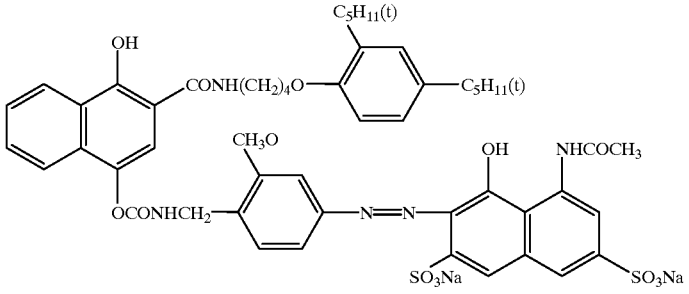
MCC-7
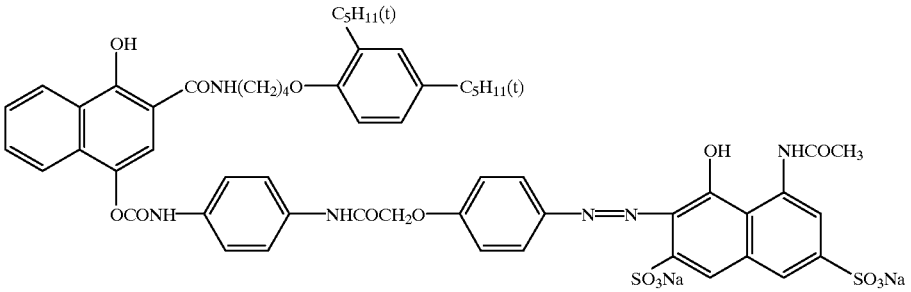
MCC-8
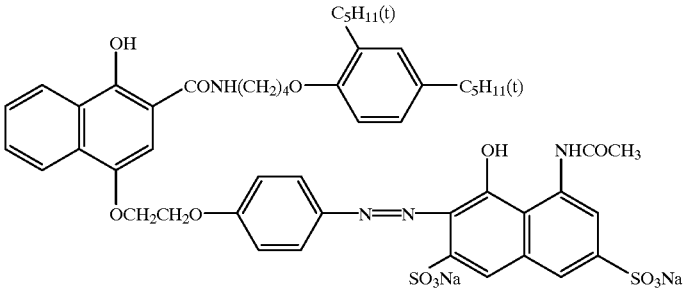

-continued
MCC-9
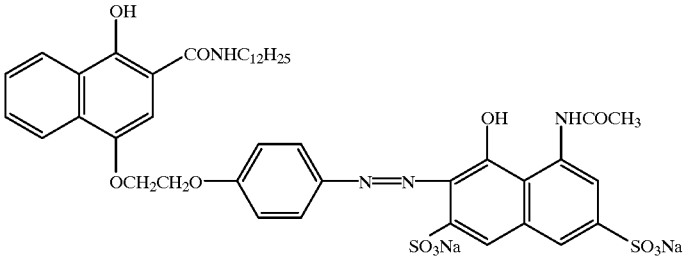
MCC-10
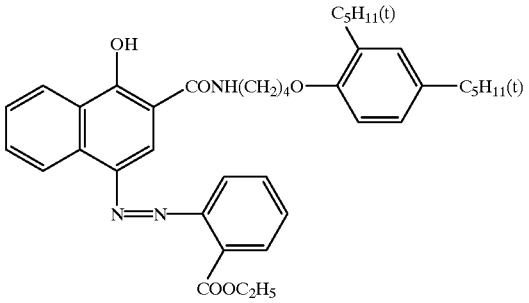
MCC-11
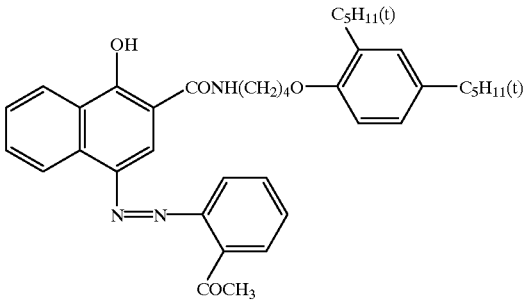
MCC-12
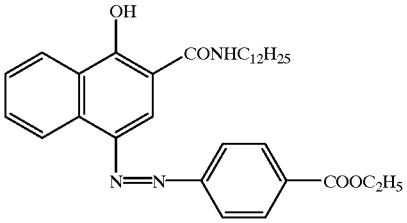
MCC-13
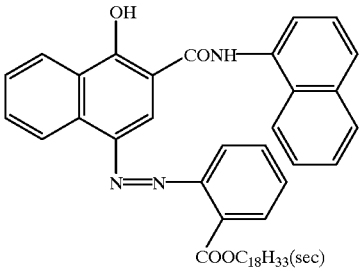

-continued

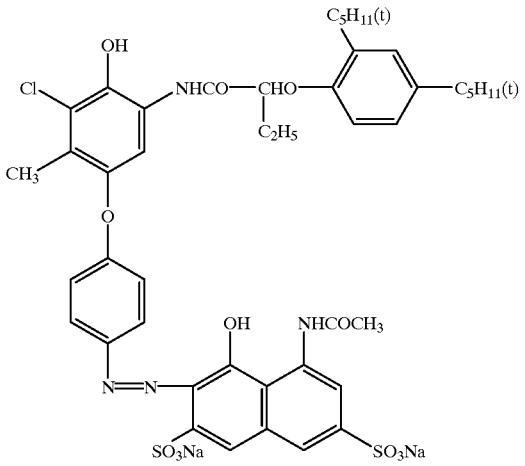

The above-mentioned compounds can be synthesized in reference to methods described in Japanese Patent O.P.I. Publication Nos. 123341/1975, 65957/1980 and 94347/1981 and Japanese Patent Publication Nos. 11304, 32461/1969, 17899/1973 and 34733/1978 and U.S. Pat. No. 3,034,892 and British Patent No. 1,084,480.

In the present invention, a yellow-colored cyan coupler has absorption maximum in the visible absorption region of a coupler from 400 to 500 nm. Concurrently with this, it forms a cyan dye in which the absorption maximum in the visible absorption region is 630 to 750 nm due to coupling with an oxidized product of an amine color developing agent. For example, see the description of couplers in Japanese Patent O.P.I. Publication No. 444/1992, pp. 8 to 26.

As a yellow-colored cyan coupler of the present invention, those represented by the following Formulas XVII through XIX which can release a compound residual group containing a water-soluble 6-hydroxy-2-pyridine-5-ylazo group, a water-soluble pyrazolidone-4-ylazo group, a water-soluble 2-acylaminophenylazo group or a water-soluble 2-sulfonamidephenylazo group due to coupling reaction with an oxidized product of an aromatic primary amine developing agent.

Formula XVII

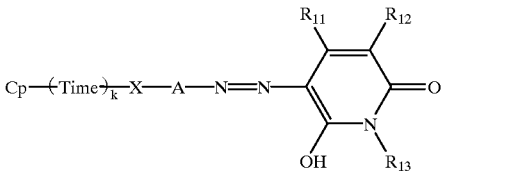

Formula XVIII

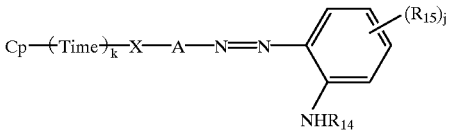

MCC-14

-continued

Formula XIX

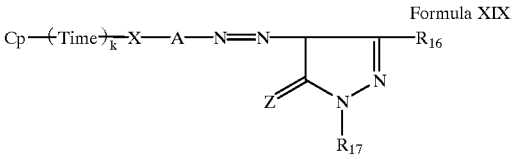

In Formulas XVII through XIX, Cp is a cyan coupler residual group, in which "Time" binds at its coupling position; Time is a timing group; k is an integer of 0 or 1; X includes N, O or S, and binds with $(Time)_k$ by means of N, O or S, and binds A with $(Time)_k$; and A is an arylene group or a divalent heterocycle.

In Formula XVII, $R_{11}$ and $R_{12}$ independently represent a hydrogen atom, a carboxyl group, a sulfo group, a cyano group, an alkyl group, a cycloalkyl group, an aryl group, a heterocycle, a carbamoyl group, a sulfamoyl group, a carbonamido group, a sulfonamido group or an alkylsulfonyl group. $R_{13}$ is a hydrogen atom, an alkyl group, a cycloalkyl group, an aryl group or a heterocycle, provided that at least one of Time, X, A, $R_{11}$, $R_{12}$ or $R_{13}$ includes a water-soluble group, for example, a hydroxyl group, a carboxyl group, a sulfo group, an ammoniumyl group, a phosphono group, a phosphino group and a hydroxysulfonyloxy group.

In Formula XVIII, $R_{14}$ is an acyl group or a sulfonyl group; $R_{15}$ is a group capable of being substituted. i is an integer of 0 through 4; when j is an integer of 2 or more, $R_{15}$ may be the same or different, provided that at least one of Time, X, A, $R_{11}$, $R_{14}$ or $R_{15}$ includes a water-soluble group, for example, a hydroxyl group, a carboxyl group, a sulfo group, a phosphono group, a phosphino group, a hydroxysulfonyloxy group, an amino group or an ammoniumyl group.

In Formula XIX, $R_{16}$ independently represent a hydrogen atom, a carboxyl group, a sulfo group, a cyano group, an alkyl group, a cycloalkyl group, an aryl group, an alkoxy group, a cycloalkyloxy group, an aryloxy group, a heterocycle, a carbamoyl group, a sulfamoyl group, a carbonamide group, a sulfonamide group or an alkylsulfonyl group. $R_{17}$ is a hydrogen atom, an alkyl group, a cycloalkyl group, an aryl group or a heterocycle, provided that at least one of Time, X, A, $R_{16}$ includes a water-soluble group, for example, a hydroxyl group, a carbamoyl group, a sulfo group, a phosphono group, a phosphino group, a hydroxysulfonyloxy group, an amino group and an ammoniumyl group. Z is O or NH.
Next, practical examples of yellow-colored cyan couplers will be exhibited.
YCC-1
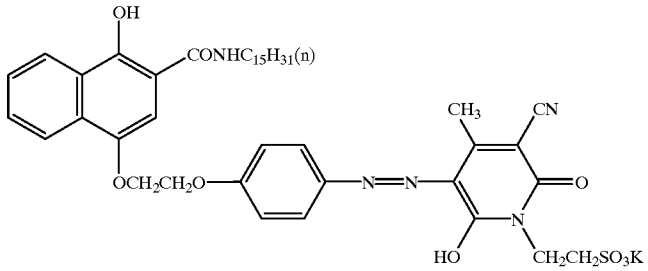
YCC-2
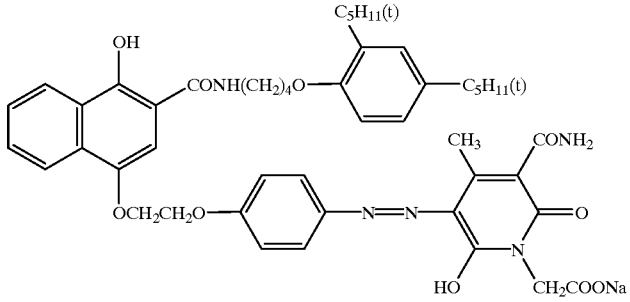
YCC-3
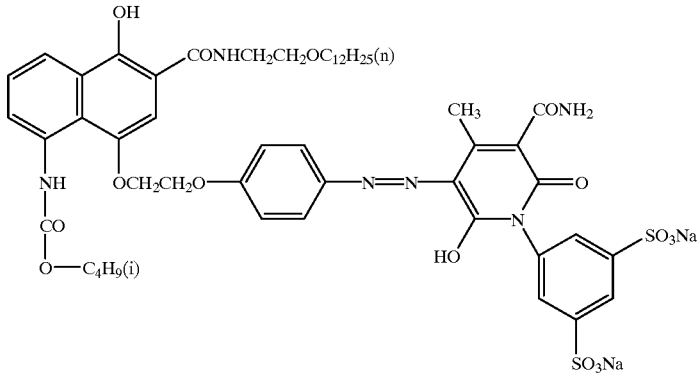
YCC-4
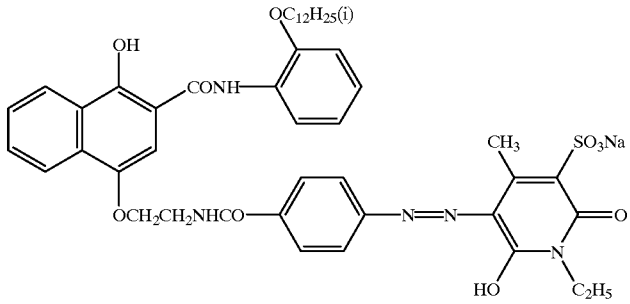

-continued
YCC-5
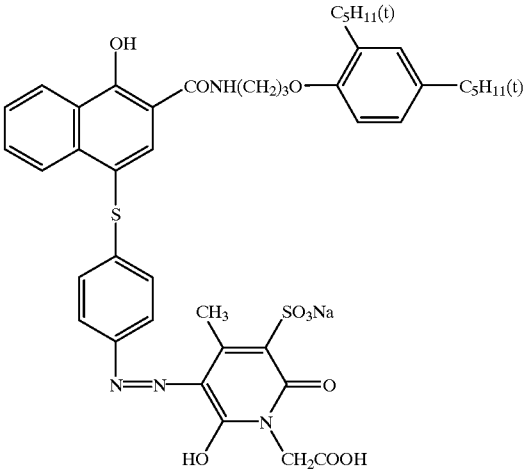
YCC-6
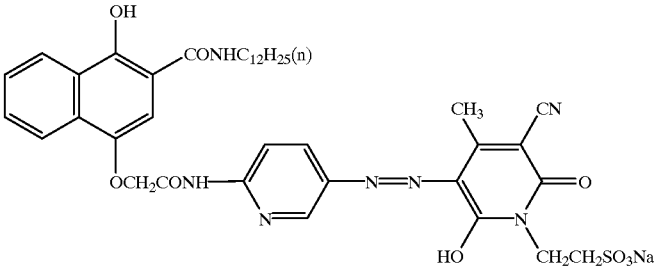
YCC-7
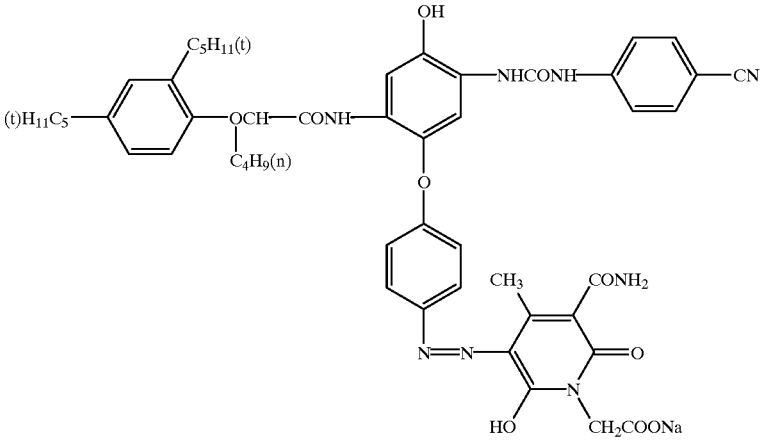
YCC-8
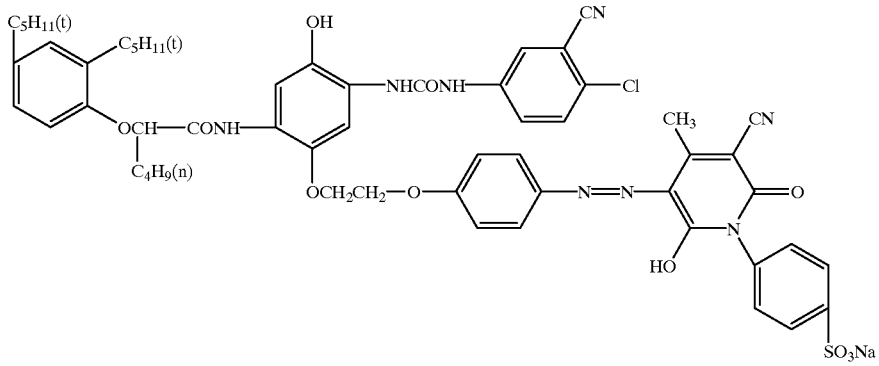

-continued
YCC-9
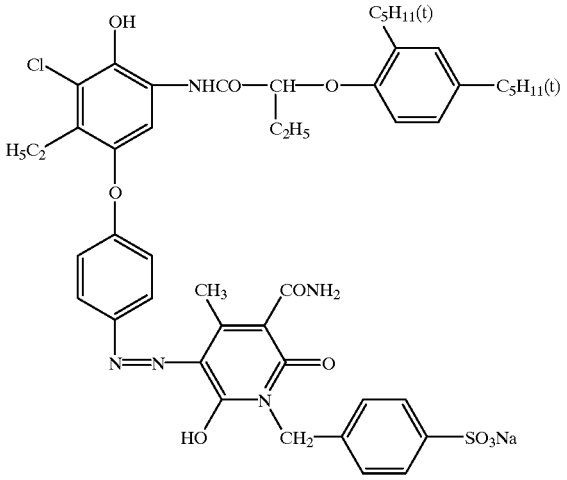
YCC-10
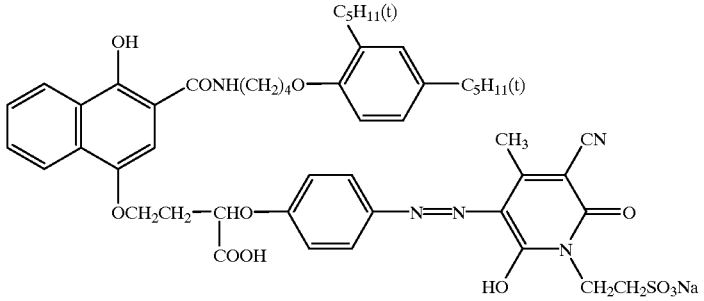
YCC-11
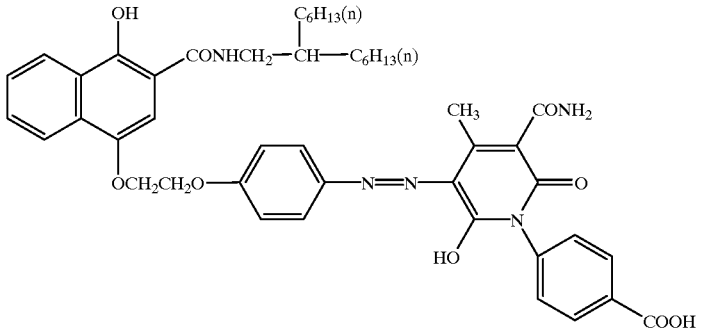
YCC-12
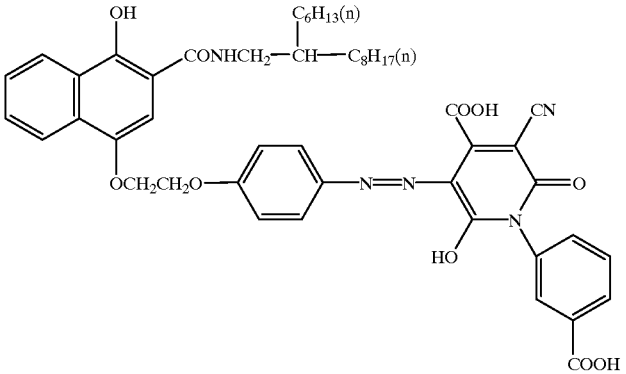

-continued
YCC-13
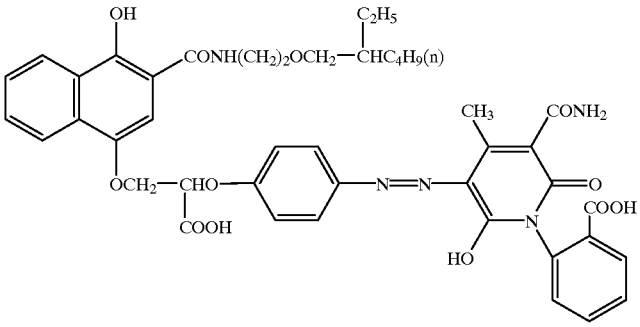
YCC-14
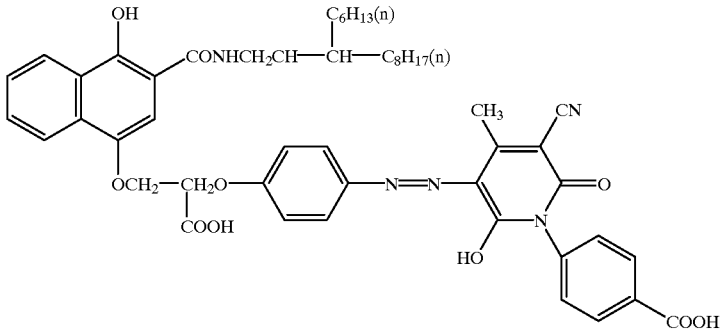
YCC-15
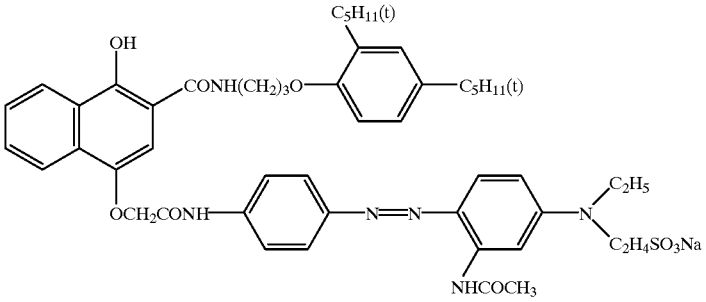
YCC-16
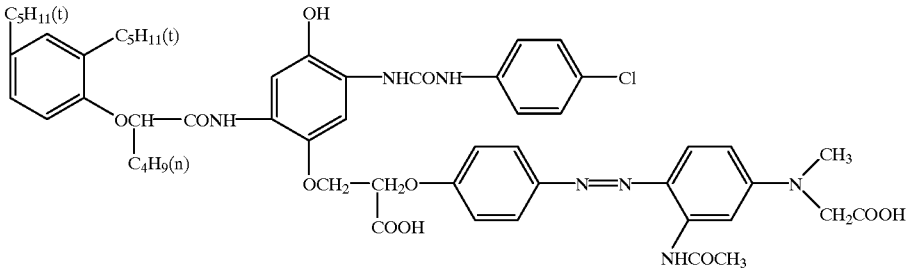

-continued
YCC-17
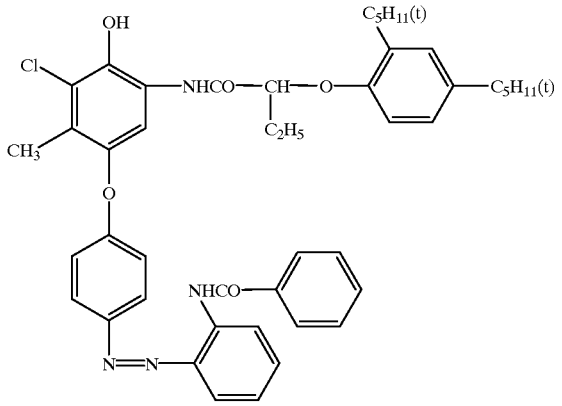
YCC-18
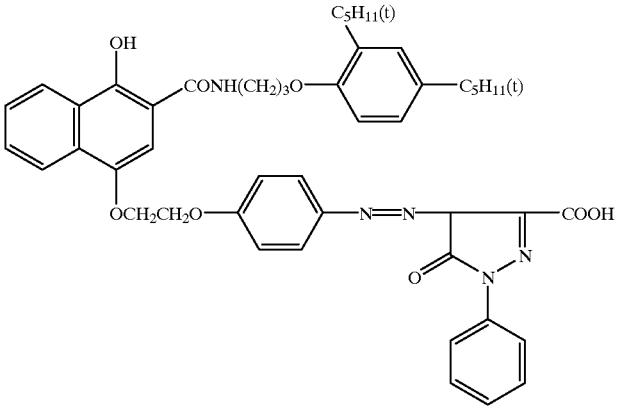
YCC-19
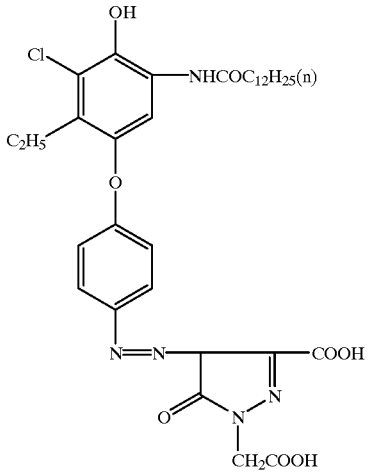

-continued

YCC-20

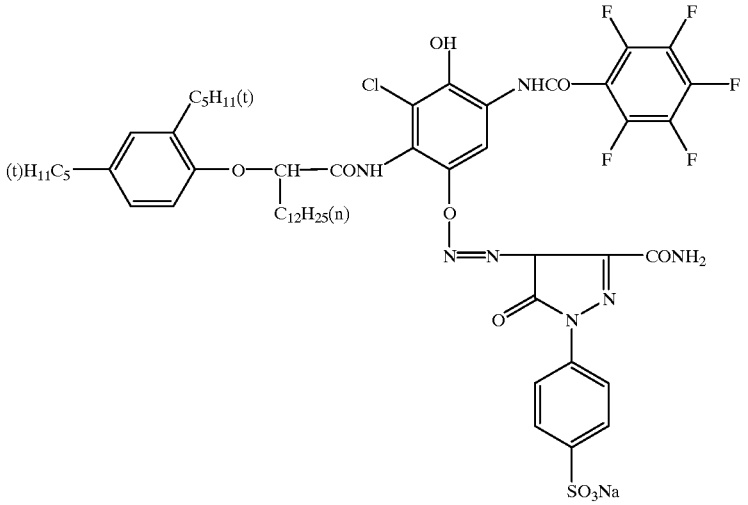

The above-mentioned yellow-colored cyan couplers can be synthesized in reference to methods described in Japanese Patent Publication No. 52827/1986, U.S. Pat. Nos. 3,763,170 and 4,004,929 and JP O.P.I. Publication Nos. 72244/1986, 273543/1986, 444/1992 and 151655/1992.

In the invention the amount of the above-mentioned colored coupler to be added to the infrared-sensitive emulsion layer is preferably 0.005 moles to 0.1 moles, more preferably 0.01 moles to 0.05 moles, per mole of silver halided contained in the infrared-sensitive emulsion layer.

The DIR compound usable in the invisible light-sensitive emulsion layer is a compound usually used in an ordinary silver halide color light-sensitive material as a DIR compound As is well known in the field of color photographic material, the DIR compound is a compound capable of releasing a development inhibitor upon coupling reaction with the oxidation product of a color developing agent. Typical examples of the DIR compound are ones represented by the following Formula XX or XXI described in U.S. Pat. No. 4,500,633.

Formula XX

A-TIME-Z

Formula XXI

A-Z

In the above formulas, A is a coupling component capable of reacting with oxidation product of a color developing agent to release the -TIME-Z group or -Z group, in which -TIME- is a timing group and -Z is a development inhibitor. Complete examples of the DIR compound are described in this publication. Among such the compounds, a diffusive DIR compound is preferably used in the invisible light-sensitive layer according to the invention. The diffusive DIR compound is a DIR compound capable of releasing a diffusible development inhibitor upon reaction with the oxidation product of a color developing agent.

The diffusive DIR compounds to be preferably used in the present invention are those described in U.S. Pat. No. 5,156,944. The diffusibility of the color development inhibitor after releasing from the DIR compound can be determined by the method described in U.S. Pat. No. 5,156,944.

The diffusive DIR compounds of the present invention are represented by Formula XXII shown below.

Formula XXII $A-(Y)_m$ wherein A represents a coupler component, m represents 1 or 2 and Y is a group which is bonded to the 40 coupler component A at its coupling position and releasable through the reaction with the oxidized product of a color developing agent, representing a developing inhibitor with great diffusibility or a compound capable of releasing a developing inhibitor.

The group A may have the properties of a coupler and is not necessarily required to form a dye through coupling.

In the present invention, the diffusive compounds 5C having the group Y in the above Formula XXII represented by the following formula 1A to 1E or 2 to 4 may preferably be employed. More preferred is the compound in which the releasable group Y is represented by Formula 1A, 1B, 1E or 3, and particularly preferred is those represented by Formula 1B, 1E or 3.

Formula 1A

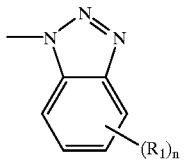

Formula 1B

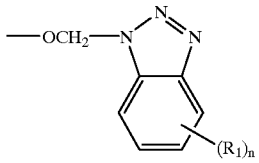

Formula 1C

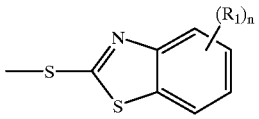

-continued

Formula 1D

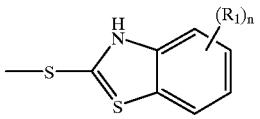

Formula 1E

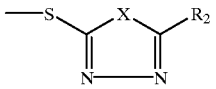

Formula 2

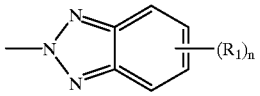

Formula 3

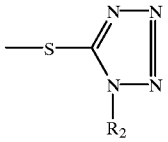

Formula 4

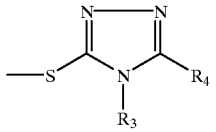

In the above Formulas 1A to 1D and 2, $R_1$ is an alkyl group, an alkoxy group, an acylamino group, a halogen atom, an alkoxycarbonyl group, a thiazolylideneamino group, an aryloxycarbonyl group, an acyloxy group, a carbamoyl group, an N-alkylcarbamoyl group, an N,N-dialkylcarbamoyl group, a nitro group, an amino group, an N-arylcarbamoyloxy group, a sulfamoyl group, an N-alkylcarbamoyloxy group, a hydroxy group, an alkoxycarbonylamino group, an alkylthio group, an arylthio group, an aryl group, a heterocyclic group, a cyano group, an alkylsulfonyl group or an aryloxycarbonylamino group. n is 1 or 2 and, when n is 2, $R_1$ may be the same or different, and the total number of carbon atoms contained in $R_1$ in number of n may be 0 to 10.

$R_2$ in the above Formula 1E has the same meaning as $R_1$ in 2A to 2D, X is an oxygen atom or a sulfur atom, and $R_2$ in Formula 3 is an alkyl group, an aryl group or a heterocyclic group.

In Formula 4, $R_3$ represents a hydrogen atom, an alkyl group, an aryl group or a heterocyclic group; R4 represents a hydrogen atoms, an alkyl group, an aryl group, a halogen atom, an acylamino group, an alkoxycarbonylamino group, an aryloxycarbonylamino group, an alkanesulfonamide group, a cyano group, a heterocyclic group, an alkylthio group or an amino group.

When $R_1$, $R_2$, $R_3$ or $R_4$ is an alkyl group, it may be either substituted or unsubstituted, straight or branched, or it may also be a cyclic alkyl. The substituents may include a halogen atom, a nitro group, a cyano group, an aryl group, an alkoxy group, an aryloxy group, an alkoxycarbonyl group, an aryloxycarbonyl group, a sulfamoyl group, a carbamoyl group, a hydroxy group, an alkanesulfonyl group, an arylsulfonyl group, an alkylthio group or an arylthio group.

When $R_1$, $R_2$, $R_3$ or $R_4$ is an aryl group, the aryl group may be substituted. The substituents may include an alkyl group, an alkenyl group, an alkoxy group, an alkoxycarbonyl group, a halogen atom, a nitro group, an amino group, a sulfamoyl group, a hydroxy group, a carbamoyl group, an aryloxy-carbonylamino group, an alkoxycarbonylamino group, an acylamino group, a cyano group or a ureido group.

When $R_1$, $R_2$, $R_3$ or $R_4$ represents a heterocyclic group, it represents a 5- or 6-member monocyclic or fused ring containing nitrogen atom, oxygen atom or sulfur atom as the hetero atom, selected from a pyridyl group, a quinolyl group, a furyl group, a benzothiazolyl group, an oxazolyl group, an imidazolyl group, a thiazolyl group, a triazolyl group, a benzotriazolyl group, an imido group, an oxazine group and the like, and these may be further substituted with substituents as enumerated above for the aryl group.

In Formulas 1E and 3, $R_2$ may have 1 to 15 carbon atoms.

In the above Formula 4, the total number of carbon atoms contained in $R_3$ and $R_4$ is 1 to 15.

In the above formula 1, Y is the following Formula 5,

-INHIBIT Formula 5 wherein -TIME group is a group which is bonded to the coupler at its coupling position, can be cleaved through 5 the reaction with a color developing inhibition, and can release the -INHIBIT group after cleavage from the coupler with moderate control; and INHIBIT group is a development inhibitor.

In Formula 5, -TIME-INHBIT group can be shown by the following formulas 6 to 12:

Formula 6

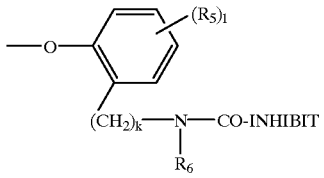

Formula 7

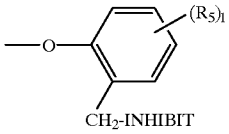

Formula 8

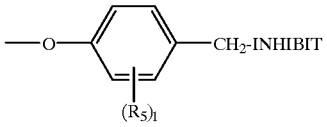

Formula 9

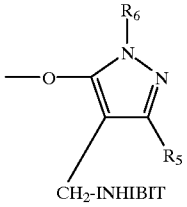

Formula 10

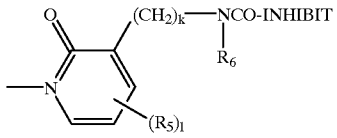

-continued

Formula 11

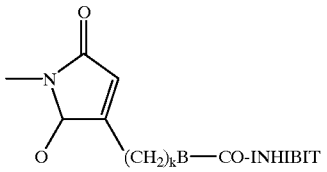

Formula 12

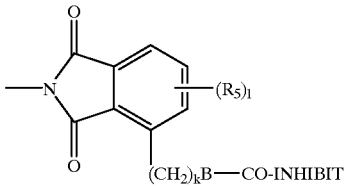

In Formulas 6 to 12, $R_5$ represents a hydrogen atom, a halogen atom, an alkyl group, an alkenyl group, an aralkyl group, an alkoxy group, an alkoxycarbonyl group, an anilino group, an acylamino group, a ureido group, a cyano group, a nitro group, a sulfonamide group, a sulfamoyl group, a carbamoyl group, an aryl group, a carboxy group, a sulfo group, a hydroxy group or an alkanesulfonyl group.

In Formulas 6, 7, 8, 10 and 12, l is 1 or 2.

In Formulas 6, 10, 11 and 12, k is an integer of from 0 to 2.

In Formulas 6, 9 and 10, $R_6$ represents an alkyl group, an alkenyl group, an aralkyl group, a cycloalkyl group or an aryl group.

In Formulas 11 and 12, B is an oxygen atom or

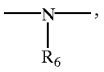

$R_6$ has the same meaning as defined above).

INHIBIT group Is the same meaning as defined for Formulas 1A, 1B, 2, 3 and 4 except for the carbon number.

However, in Formulas 1A, 1B and 2, the total number of carbon atoms contained in each $R_1$ in one molecule is 1 to 32, while the number of carbon atoms contained in R2 in Formula 3 is 1 to 32 and the total number of carbon atoms contained in $R_3$ and $R_4$ in Formula 4 is 0 to 32.

When $R_5$ and $R_6$ represent alkyl groups, they may be either substituted or unsubstituted, straight or cyclic. Substituents may include those as enumerated for the alkyl groups of $R_1$ to $R_4$.

When $R_5$ and $R_6$ represent aryl groups, the aryl group may be substituted. Substituents may include those as enumerated for the aryl groups of $R_1$ to $R_1$.

Of the diffusive DIR compounds as mentioned above, those having releasable groups represented by Formula 1A, 1B, 1E or 4 are particularly preferred.

As the yellow color image forming coupler residue represented by A in Formula XXII, there may be included the coupler residues of pivaloylacetanilide type, benzoylacetanilide type, malondiester type, malondiamide type, dibenzoylmethane type, benzothiazolylacetamide type, malonestermoncamide type, benzothiazolyl acetate type, benzoxazolylacetamide type, benzoxazolyl acetate type, malondiester type, benzimidazolylacetamide type or benzimidazolyl acetate type; the coupler residues derived from heterocyclic substituted acetamide or heterocyclic substituted acetate included in U.S. Pat. No. 3,841,880; coupler residues derived from acylacetamides disclosed in U.S. Pat. No. 3,770,446, U.K. Patent No. 1,459,171, West German OLS No. 2,503,099, Japanese Provisional Patent Publication No. 139738/1975 or Research Disclosure No. 15737; or the heterocyclic coupler residue as disclosed in U.S. Pat. No. 4,046,574.

The magenta color image forming coupler residue represented by A may preferably be a coupler residue having a 5-oxo-2-pyrazoline nucleus, pyrazolone-[1,5a]-benzimidazole nucleus or a cyanoacetophenone type coupler residue.

The cyano color image forming coupler residue represented by A may preferably be a coupler residue having a phenol nucleus, an o-naphthol nucleus, indazolone type or pyrazolotriazole type coupler residue.

Further, even if substantially no dye is formed after release of the developing inhibitor by coupling of the coupler with the oxidized product of a developing agent, the effect as the DIR coupler is the same. This type of coupler residue represented by A may include the coupler residues disclosed in U.S. Pat. Nos. 4,052,213, 4,088,491, 3,632,345, 3,958,993 or 3,961,959.

In the following, specific examples of the diffusive DIR compounds of the present invention are enumerated low, but these are not limitative of the present invention.

D-1

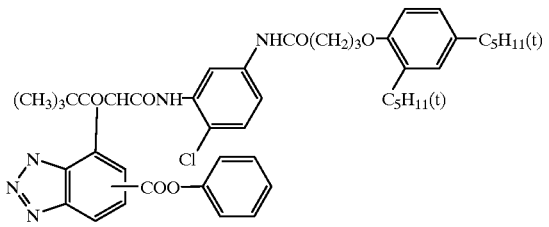

D-2

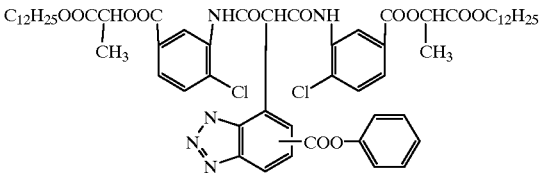

D-3

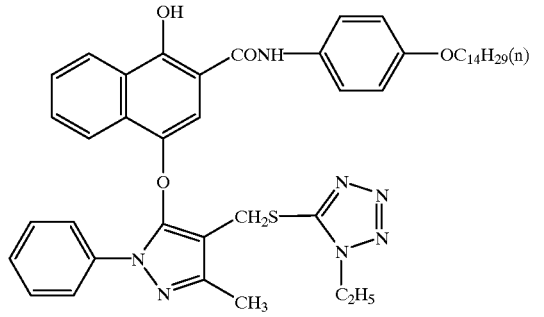

-continued
D-4
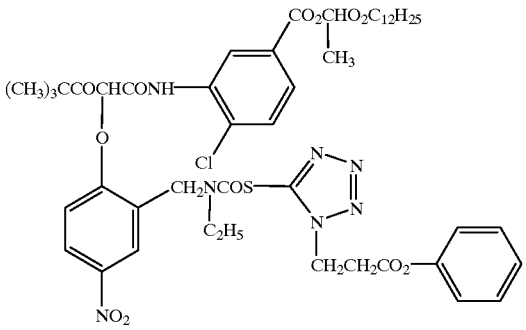
D-6
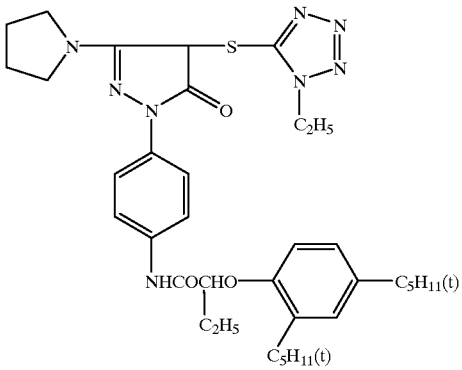
D-7
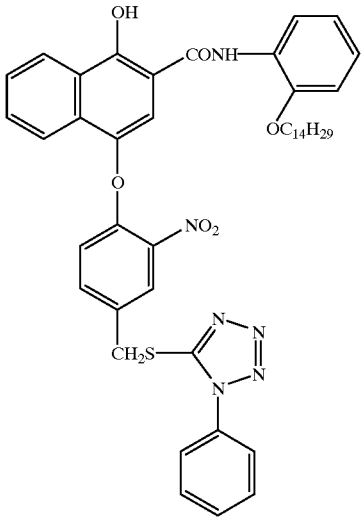
D-8
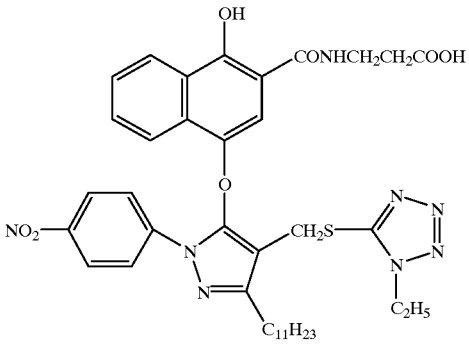
-continued
D-9
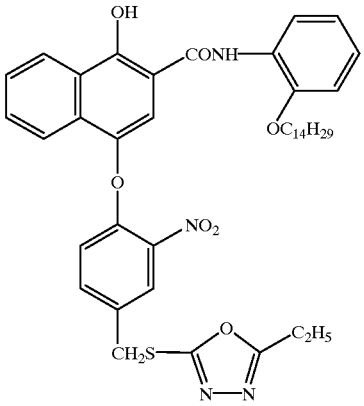
D-10
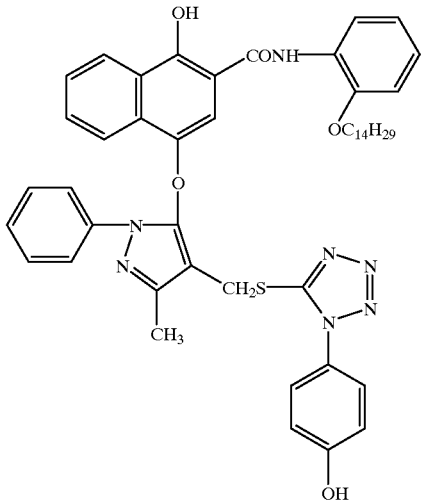
D-11
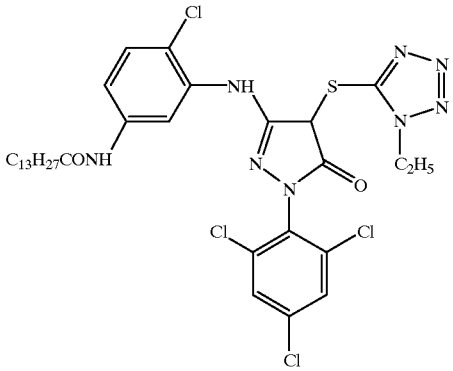

-continued
D-12
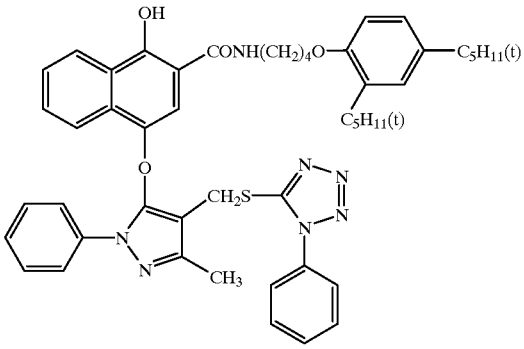
D-13
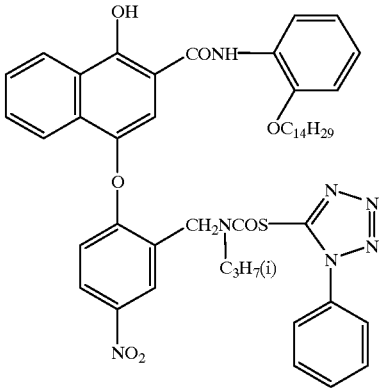
D-14
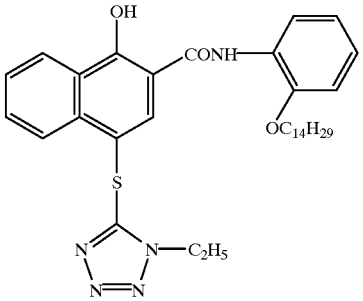
D-15
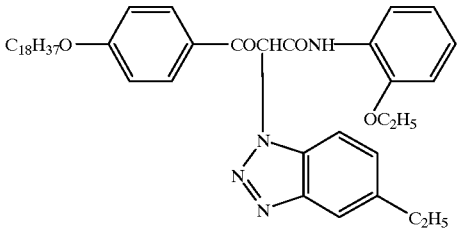
-continued
D-16
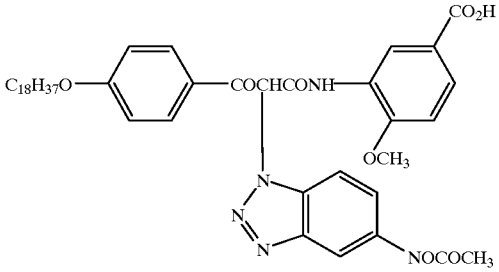
D-17
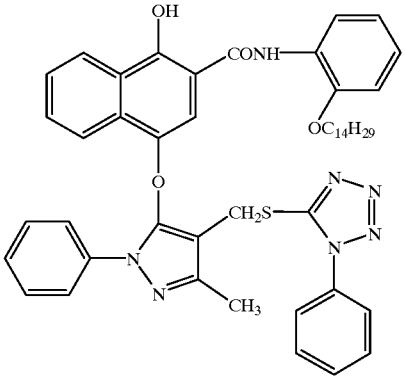
D-18
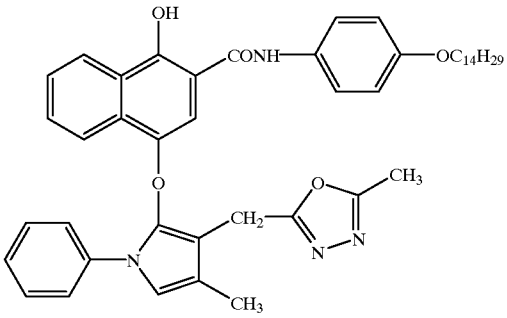
D-19
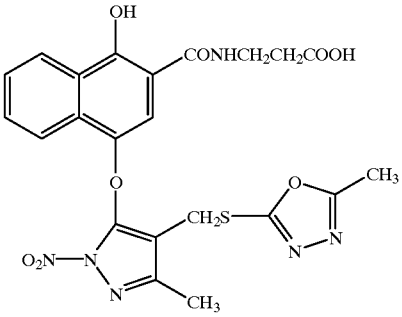

-continued

D-20

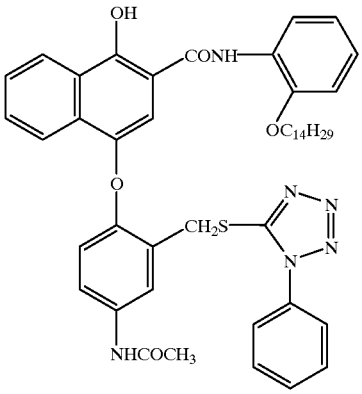

D-21

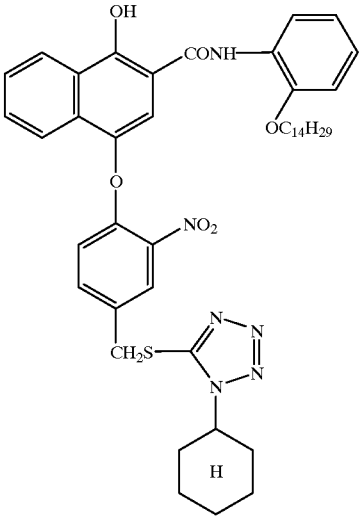

These compounds can be synthesized easily according to the methods as disclosed in U.S. Pat. Nos. 4,234,678, 3,227,554, 3,617,291, 3,958,993, 4,149,886 and blot 3,933, 500; Japanese Provisional Patent Publication No. 56837/1982; Japanese Patent Publication No. 13239/1976; U.K. Patents No. 2,072,363 and No. 3 2,070,266; and Research Disclosure No. 21228, December, 1981.

Generally, an amount of the diffusive DIR compound of the present invention is preferably $2\times10^{-4}$ to $5\times10^{-1}$ moles, more preferably $5\times10^{-4}$ to $1\times10^{-1}$ moles per mole of silver in the emulsion layer.

Furthermore, concrete examples of the DIR compound include, for example, D-1 to D-34 described in JP O.P.I. No. 4-114153. In the invention, such the compounds are preferably usable.

Concrete example of the diffusive DIR compound usable in the invention also include those described in U.S. Pat. Nos. 4,234,678, 3,227554, 3,647,291, 3,958,993, 4,419,886 and 3,933,500, and JP O.P.I. Nos. 57-56837 and 51-13239, U.S. Pat. Nos. 2,072,363 and 2,070,266 and Research Disclosure 21228, December 1981.

In the light-sensitive material of the invention. various kinds can be used as the transparent support. As usable transparent supports, for example, a polyester film such as polyethylene terephthalate, polyethylene naphthalate, a cellulose triacetate film, a cellulose diacetate film, a polycarbonate film, a polystyrene film, and a polyolefin film can be mentioned.

There is no specific limit with respect to polyester supports. For example, condensation polymers of aromatic dicarboxylic acid such as terephthalic acid, isophthalic acid, phthalic acid, naphthalene dicarboxylic acid, and alkylene glycols such as ethylene glycol, 1,3-propanediol, 1,4-butanediol, for example, poly(ethylene terephthalate), poly (ethylene 2,6-dinaphthalate), poly(propylene terephthalate), poly(butylene terephthalate), and copolymers thereof can be mentioned.

Particularly in light of property of anti-stay-curl after development, it is preferable to use polyesters having high moisture content such as those disclosed in Japanese Patent O.P.I. Publication Nos. 1-244446, 1-291248, 1-298350, 2-89045, 2-93641. 2-181749 and 2-214852.

These polyesters may contain a polar group or other substituent groups.

Among the above-mentioned supports, polyethylene terephthalate or polyethylene naphthalate is preferably used in the invention as the transparent support.

For the purpose of satisfying mechanical strength as a film support, dimensional stability, the above-mentioned polyesters are preferably stretched by 4–16 times in an area ratio. Further, it is preferable for the above-mentioned films to be subjected to thermal treatment or annealing treatment as disclosed in Japanese Patent O.P.I. Publication No. 51-16358 after film-formation.

There may be incorporated in the transparent support a matting agent, an anti-static agent, a lubricating agent, a surface active agent, a stabilizer, a dispersant, a plasticizer, an ultraviolet-ray absorbent, electro-conductive substance, a thickening agent, a softening agent, a fluidity-providing material, viscosity-increasing agent, and anti-oxidant.

The support may contain a dye for the purpose of neutralizing hue of the minimum density portion of the film, or preventing light piping or edge fogging caused when light comes in from the edge of the film support having thereon photographic constituent layers or halation.

There is no specific limit as to the kind of dyes. In the case where a polyester film is used as the support, one having excellent a heat resisting property is preferable. For example, anthraquinone-type dyes can be mentioned. For color hue of the dye, in the case when prevention of light piping is aimed at, as is the case in the popular light sensitive materials, gray dye is preferable. The dye may be employed either singly or in combination thereof. For example, "Diaresin", a product of Mitsubishi Chemical Co., Ltd. and "MACROLEX", a product of Bayer, Ltd. may be used singly or in combination.

In the light-sensitive material of the invention, it is preferred that the sensitivity of the infrared-sensitive emulsion layer is lower than those of the red-sensitive, green-sensitive and blue-sensitive emulsion layers. When the sensitivity of the infrared-sensitive emulsion layer is higher than that of the visible light-sensitive layers, the reproduced color of the object tends to become unnatural since the color compensation effect of the infrared-sensitive layer affects excessively It is preferred that the sensitivity of the infrared-sensitive layer is not more than 80%, preferably not more than 50%, more preferably 1 to 40%, of the sensitivity of a visible light-sensitive emulsion layer having the lowest sensitivity among the red-, green- and blue-sensitive emulsion layers. In the above-mentioned, the sensitivity is based on the light amount of the exposure necessary to obtain an image density of 0.1 on the minimum density of the light-sensitive material.

In the invention, silver halide emulsions described in Research Disclosure No. 308119, hereinafter referred to RD308119, are usable.

The position of the description is shown below.

| Item | Page in RD308119 |
|---|---|
| Composition of silver iodide | 993 I-A |
| Production method | 993 I-A and 994 E |
| Crystal habit, Regular crystal | 993 I-A |
| Twined crystal | 993 I-A |
| Epitaxial | 993 I-A |
| Halide composition, Uniform | 993 I-B |
| Non-uniform | 993 I-B |
| Halogen conversion | 994 I-C |
| Halogen substitution | 994 I-C |
| Metal doping | 994 I-D |
| Monodisperse | 995 I-F |
| Addition of solvent | 995 I-F |
| Position of latent image formation, Surface | 995 I-G |
| Interior | 995 I-G |
| Application for negative film | 995 I-H |
| Positive (including inner fogged grain) | 995 I-H |
| Emulsion mixing | 995 I-J |
| Desaltation | 995 II-A |

In the invention, a silver halide emulsion physically and chemically ripened and spectrally sensitized is used. Additives usable in these processes are described in Research Disclosure Nos. 17643, 18716 and 308119, hereinafter each referred to RD17643, RD18716 and RD308119. The positions of the descriptions are shown below.

| Item | Page in RD308119 | RD17643 | RD18716 |
|---|---|---|---|
| Chemical sensitizer | 996 III-A | 23 | 648 |
| Spectral sensitizer | 996 IV-A-A, B, C, D, H, I, J | 23–24 | 638–649 |
| Super sensitizer | 996 IV-A-E, J | 23–24 | 648–649 |
| Fog inhibitor | 998 VI | 24–25 | 649 |
| Stabilizer | 998 VI | 24–25 | 649 |

Known photographic additives usable in the invention are also described in the above-mentioned Research Disclosure. The positions of the descriptions relating to the additives are shown below.

| Item | Page in RD308119 | RD17643 | RD18716 |
|---|---|---|---|
| Color contamination preventing agent | 1002 VII-I | 25 | 650 |
| Dye image stabilizer | 1001 VII-J | 25 | |
| Whitening agent | 998 V | 24 | |
| UV absorbent | 1003 VIII-I, VIII-C | 25–26 | |
| Light absorbent | 1003 VIII | 25–26 | |
| Light scattering agent | 1003 VIII | | |
| Filter dye | 1003 VIII | 25–26 | |
| Binder | 1003 IX | 26 | 651 |
| Antistatic agent | 1006 XIII | 27 | 650 |
| Hardener | 1004 X | 26 | 651 |
| Plasticizer | 1006 XII | 27 | 650 |
| Lubricant | 1006 XII | 27 | 650 |
| Surfactant, Coating aid | 1005 XI | 26–27 | 650 |
| Matting agent | 1007 XVI | | |
| Developing agent contained in light-sensitive material | 1001 XX B | | |

In the invention, various couplers can be used, examples of them are described in Research Disclosure. The positions of the descriptions relating to the couplers are shown below.

| Item | Page in RD308119 | RD17643 |
|---|---|---|
| Yellow coupler | 1001 VII-D | VIIC-G |
| Magenta coupler | 1001 VII-D | VIIC-G |
| Cyan coupler | 1001 VII-D | VIIC-G |
| Colored coupler | 1002 VII-G | VIIG |
| DIR compound | 1001 VII-F | VIIF |
| BAR coupler | 1002 VII-F | |
| Effective residue releasing coupler other than the above | 1001 VII-F | |
| Alkali-soluble coupler | 1001 VII-E | |

The additives usable in the invention can be added according to a dispersion method such as that described in RD308119 XIV.

In the invention, a support described in RD17643, p. 28, RD18716, p.p. 647 to 648, and RD308119, XIX.

The light-sensitive material of the invention has a non-light-sensitive layer usually provided in a silver halide color photographic material such as a protective layer, a filter layer, an interlayer or an anti-halation layer. As to the non-light-sensitive layer, description in RD308119 VII-K can be referred.

In the light-sensitive material of the invention, a variety of layer constitutions such as an ordinary layer order, a reverse layer order or a unit layer constitution described in RD308119 VII-K.

For developing the silver halide color photographic light-sensitive material of the invention, known developing agents are usable, which are described in, for example, T. H. James, The Theory of the Photographic Process, Fourth Edition, p.p. 291–334, and Journal of the American Chemical Society, 73, No. 3, p. 100, 1951. The light-sensitive material can be processed by an ordinary method described in RD17643, p.p. 28–29, RD18716, p. 615 and RD308119 XIX.

EXAMPLES

Example 1

A sample of multi-layered color light-sensitive material Sample 101 was prepared by coating the following composition on a subbed cellulose triacetate film support.

In all the examples described below, the adding amount of the component in the silver halide photographic light-sensitive material is described in gram per square meter except the case accompanied with a specific description. The amount of silver halide and colloidal silver are described in terms of silver and the amount of sensitizing dye is described in number of moles per mole of silver.

| | |
|---|---|
| First layer: Antihalation layer | |
| Black colloidal silver | 0.18 |
| UV absorbent UV-1 | 0.30 |
| High-boiling organic solvent Oil-2 | 0.17 |
| Gelatin | 1.59 |
| Second layer: Interlayer | |
| High-boiling organic solvent Oil-2 | 0.01 |
| Gelatin | 1.27 |
| Third layer: Low speed red-sensitive layer | |
| Silver iodobromide emulsion A | 0.80 |
| Sensitizing dye SD-1 | $5.0 \times 10^{-5}$ |

-continued

| | |
|---|---|
| Sensitizing dye SD-2 | $9.0 \times 10^{-5}$ |
| Sensitizing dye SD-3 | $1.9 \times 10^{-5}$ |
| Sensitizing dye SD-4 | $2.0 \times 10^{-4}$ |
| Sensitizing dye SD-5 | $2.8 \times 10^{-4}$ |
| Cyan coupler C-E1 | 0.42 |
| Colored cyan coupler CC-E1 | 0.02 |
| High-boiling solvent Oil-1 | 0.35 |
| Gelatin | 1.02 |
| Fourth layer: Medium speed red-sensitive layer | |
| Silver iodobromide emulsion E | 0.40 |
| Sensitizing dye SD-3 | $1.8 \times 10^{-5}$ |
| Sensitizing dye SD-4 | $2.4 \times 10^{-4}$ |
| Sensitizing dye SD-5 | $4.5 \times 10^{-4}$ |
| Cyan coupler C-E1 | 0.26 |
| Colored cyan coupler CC-E1 | 0.05 |
| DIR compound D-E1 | 0.01 |
| High-boiling solvent Oil-1 | 0.31 |
| Gelatin | 0.78 |
| Fifth layer: High speed red-sensitive layer | |
| Silver iodobromide emulsion G | 1.51 |
| Sensitizing dye SD-3 | $1.8 \times 10^{-5}$ |
| Sensitizing dye SD-4 | $3.1 \times 10^{-4}$ |
| Sensitizing dye SD-5 | $2.7 \times 10^{-4}$ |
| Cyan coupler C-E2 | 0.11 |
| Colored cyan coupler CC-E1 | 0.02 |
| DIR compound D-E2 | 0.04 |
| High-boiling solvent Oil-1 | 0.17 |
| Gelatin | 1.15 |
| Sixth layer: Interlayer | |
| Yellow coupler Y-E1 | 0.02 |
| Yellow coupler Y-E2 | 0.06 |
| High-boiling organic solvent Oil-2 | 0.02 |
| High-boiling organic solvent Oil-1 | 0.17 |
| Gelatin | 0.69 |
| Seventh layer: Interlayer | |
| Gelatin | 0.80 |
| Eighth layer: Low speed green-sensitive layer | |
| Silver iodobromide emulsion B | 0.21 |
| Sensitizing dye SD-1 | $5.9 \times 10^{-5}$ |
| Sensitizing dye SD-6 | $3.1 \times 10^{-4}$ |
| Sensitizing dye SD-9 | $1.8 \times 10^{-4}$ |
| Sensitizing dye SD-11 | $5.6 \times 10^{-5}$ |
| Magenta coupler M-E1 | 0.20 |
| Colored magenta coupler CM-E1 | 0.05 |
| DIR compound D-E1 | 0.02 |
| High-boiling organic solvent Oil-2 | 0.27 |
| Gelatin | 1.34 |
| Ninth layer: Medium speed green-sensitive layer | |
| Silver iodobromide emulsion E | 0.82 |
| Sensitizing dye SD-1 | $5.0 \times 10^{-5}$ |
| Sensitizing dye SD-6 | $2.7 \times 10^{-4}$ |
| Sensitizing dye SD-9 | $1.7 \times 10^{-4}$ |
| Sensitizing dye SD-11 | $4.8 \times 10^{-5}$ |
| Magenta coupler M-E1 | 0.21 |
| Colored magenta coupler CM-E1 | 0.05 |
| DIR compound D-E4 | 0.02 |
| High-boiling organic solvent Oil-2 | 0.33 |
| Gelatin | 0.89 |
| Tenth layer: High speed green-sensitive layer | |
| Silver iodobromide emulsion D | 0.99 |
| Sensitizing dye SD-6 | $3.6 \times 10^{-4}$ |
| Sensitizing dye SD-7 | $7.0 \times 10^{-5}$ |
| Sensitizing dye SD-8 | $4.8 \times 10^{-5}$ |
| Sensitizing dye SD-11 | $6.2 \times 10^{-5}$ |
| Magenta coupler M-E1 | 0.05 |
| Magenta coupler M-E2 | 0.06 |
| Colored magenta coupler CM-E2 | 0.03 |
| High-boiling organic solvent Oil-2 | 0.25 |
| Gelatin | 0.88 |
| Eleventh layer: Interlayer | |
| High-boiling organic solvent Oil-1 | 0.25 |

-continued

| | |
|---|---|
| Gelatin | 0.50 |
| Twelfth layer: Yellow filter layer | |
| Yellow colloidal silver | 0.11 |
| Color stain preventing agent SC-1 | 0.12 |
| High-boiling solvent Oil-2 | 0.16 |
| Gelatin | 1.00 |
| Thirteenth layer: Interlayer | |
| Gelatin | 0.36 |
| Fourteenth layer: Low speed blue-sensitive layer | |
| Silver iodobromide emulsion B | 0.37 |
| Sensitizing dye SD-10 | $5.6 \times 10^{-4}$ |
| Sensitizing dye SD-11 | $2.0 \times 10^{-4}$ |
| Sensitizing dye SD-13 | $9.8 \times 10^{-5}$ |
| Yellow coupler Y-E1 | 0.39 |
| Yellow coupler Y-E2 | 0.14 |
| DIR compound D-E5 | 0.03 |
| High-boiling organic solvent Oil-2 | 0.11 |
| Gelatin | 1.02 |
| Fifteenth layer: Medium speed blue-sensitive layer | |
| Silver iodobromide emulsion D | 0.46 |
| Silver iodobromide emulsion F | 0.10 |
| Sensitizing dye SD-10 | $5.3 \times 10^{-4}$ |
| Sensitizing dye SD-11 | $1.9 \times 10^{-4}$ |
| Sensitizing dye SD-13 | $1.1 \times 10^{-5}$ |
| Yellow coupler Y-E1 | 0.28 |
| Yellow coupler Y-E2 | 0.10 |
| DIR compound D-E5 | 0.05 |
| High-boiling organic solvent Oil-2 | 0.08 |
| Gelatin | 1.12 |
| Sixteenth layer: High speed blue-sensitive layer | |
| Silver iodobromide emulsion D | 0.04 |
| Silver iodobromide emulsion G | 0.28 |
| Sensitizing dye SD-11 | $8.4 \times 10^{-5}$ |
| Sensitizing dye SD-12 | $2.3 \times 10^{-4}$ |
| Yellow coupler Y-E1 | 0.04 |
| Yellow coupler Y-E2 | 0.12 |
| High-boiling organic solvent Oil-2 | 0.03 |
| Gelatin | 0.85 |
| Seventeenth layer: First protective layer | |
| Iodobromide emulsion (average grain diameter: 0.04 $\mu$m, silver iodide content: 4.0 mole-%) | 0.30 |
| UV absorbent UV-2 | 0.03 |
| UV absorbent UV-3 | 0.015 |
| UV absorbent UV-4 | 0.015 |
| UV absorbent UV-5 | 0.015 |
| UV absorbent UV-6 | 0.10 |
| High-boiling organic solvent Oil-1 | 0.44 |
| High-boiling organic solvent Oil-3 | 0.07 |
| Gelatin | 1.35 |
| Eighteenth layer: Second protective layer | |
| Alkali-soluble matting agent PM-1 (Average particle diameter: 2 $\mu$m) | 0.15 |
| Polymethyl methacrylate (Average particle diameter: 3 $\mu$m) | 0.04 |
| Lubricant WAX-1 | 0.02 |
| Gelatin | 0.54 |

Other than the above-mentioned, compounds SU-1, SU-2, SU-3 and SU-4, thickener V-1, hardeners H-1 and H-2, stabilizer ST-1, antifoggants AF-1, AF-2 and two kinds of AF-3 each having a weight average molecular weight of 10,000 and 1,100,000, respectively, dyes AI-1, AI-2 and AI-3, compounds FS-1 and FS-2 and preservative DI-1 were optionally added to the layers.

Al-1
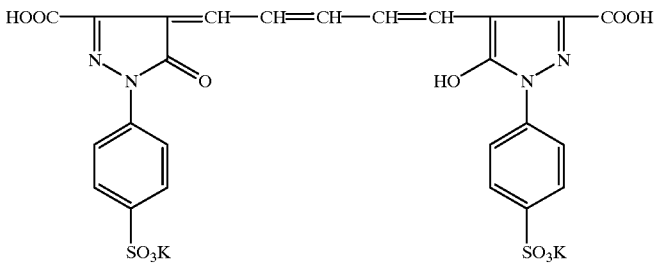
Al-2
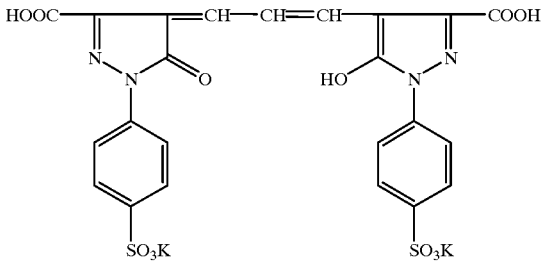
Al-3
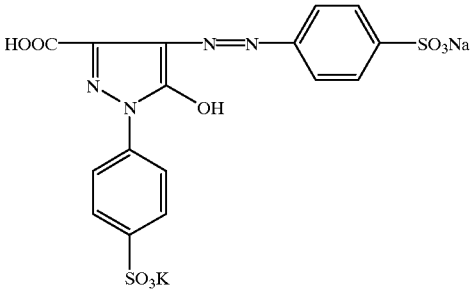
V-1
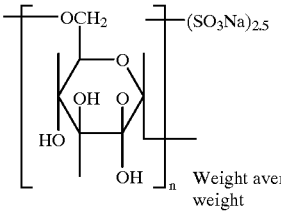
Weight average molecular weight
MW: 120,000
C-E1
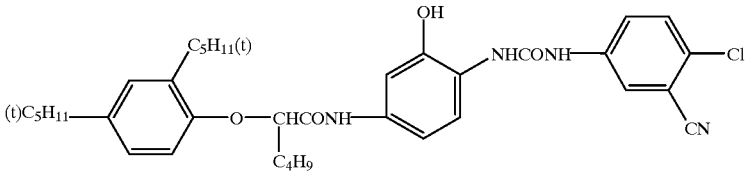
C-E2
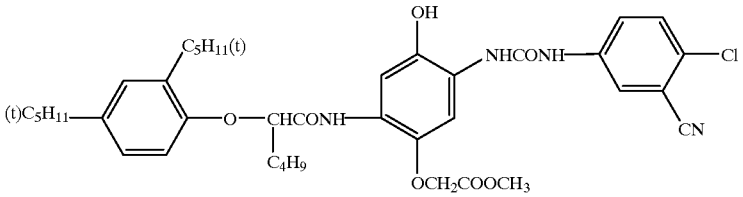

-continued
M-E1
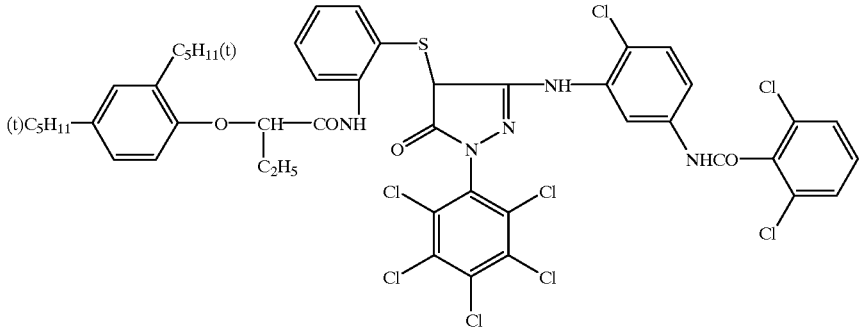
M-E2
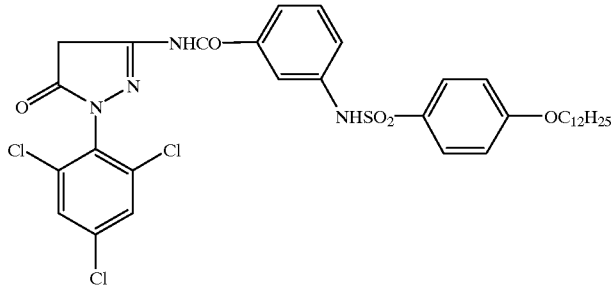
Y-E1
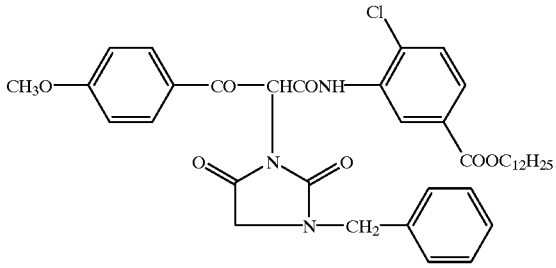
Y-E2
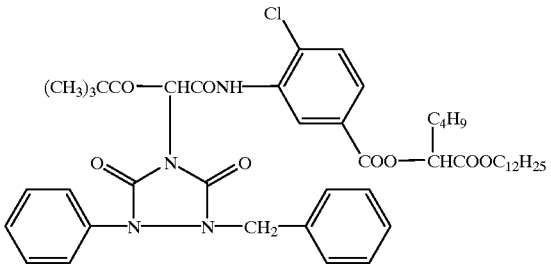
YCC-E1
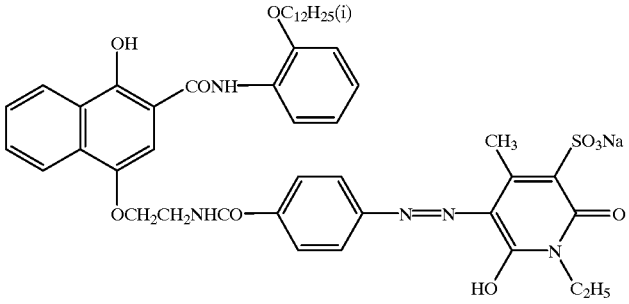

-continued
CC-E1
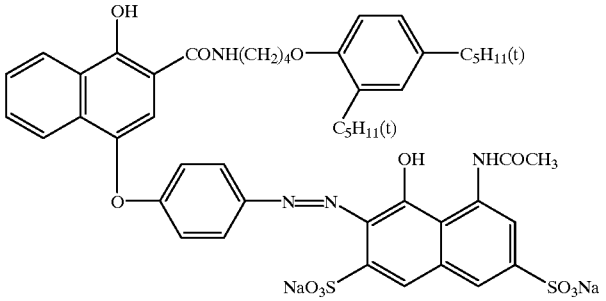
CM-E1
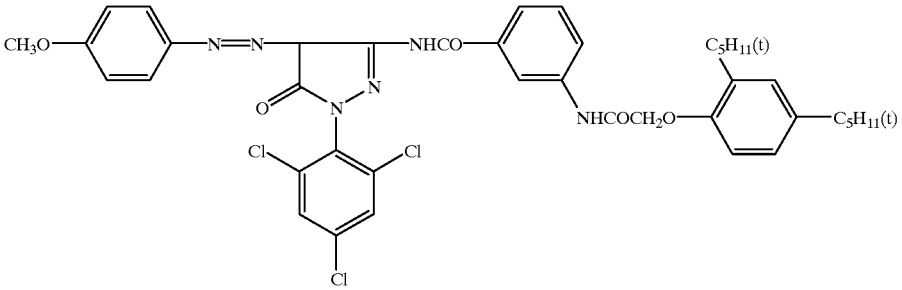
CM-E2
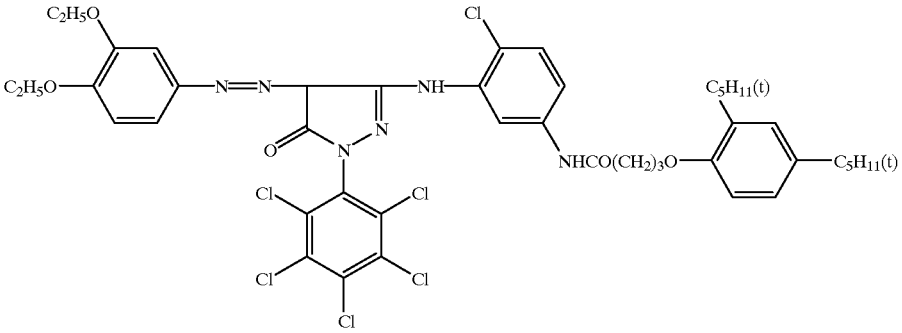
D-E1
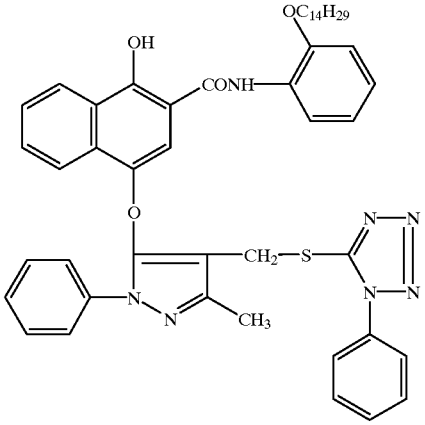

-continued
D-E2
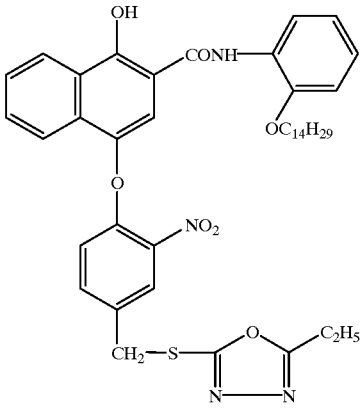
D-E4
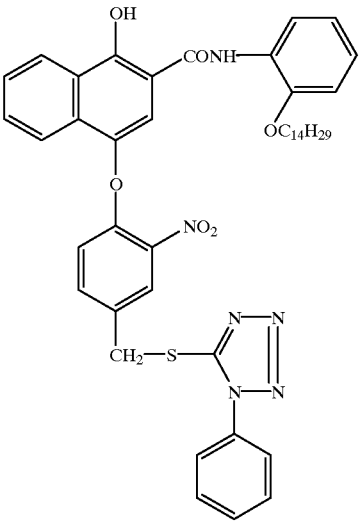
D-E5
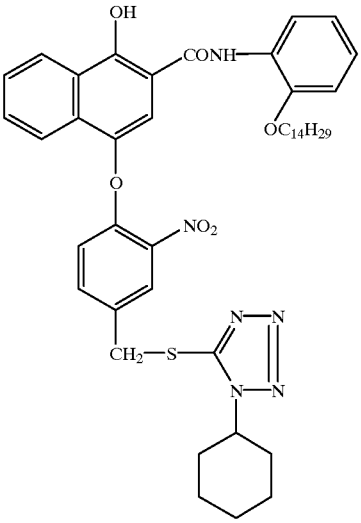
Oil-1
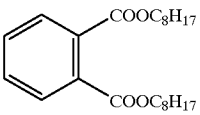

-continued
Oil-2
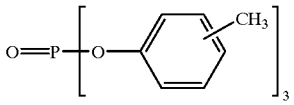
Oil-3
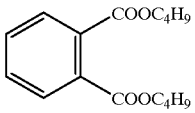
SC-1
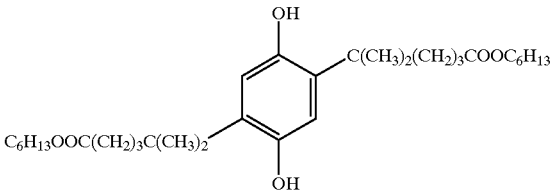
SD-1
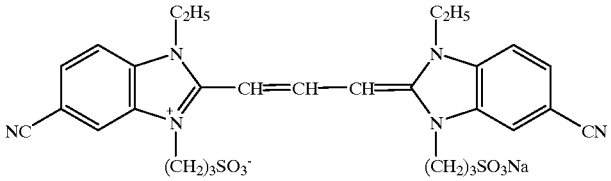
SD-2
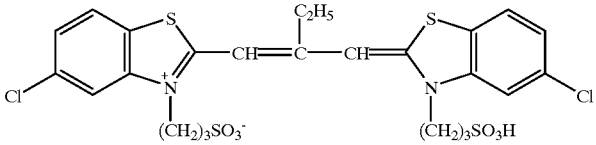
SD-3
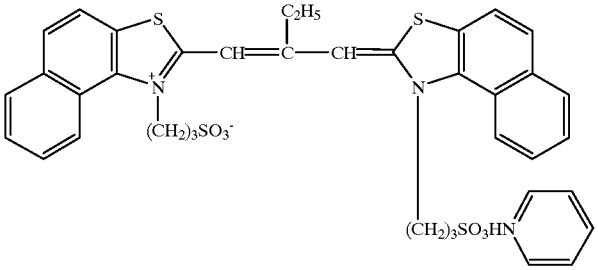
SD-4
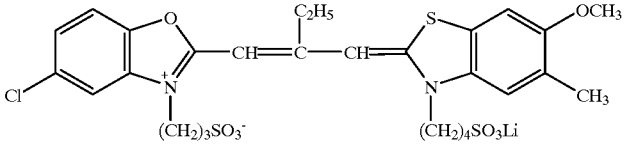
SD-5
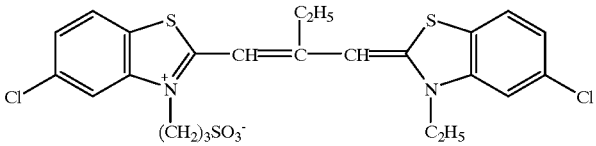

-continued
SD-6
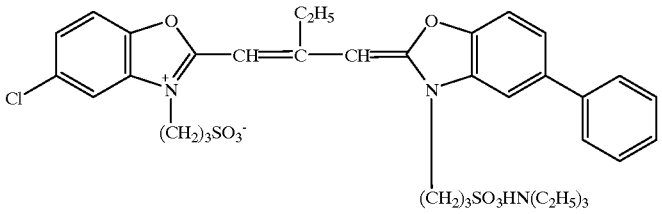
SD-7
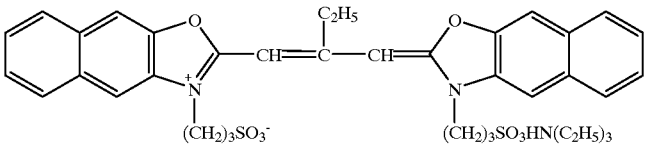
SD-8
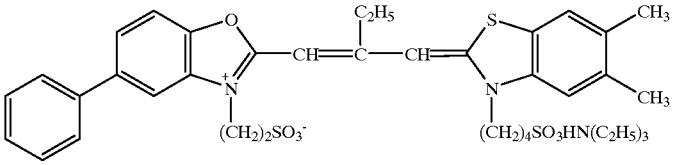
SD-9
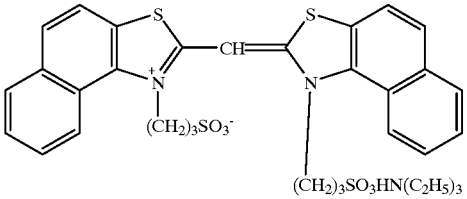
SD-10
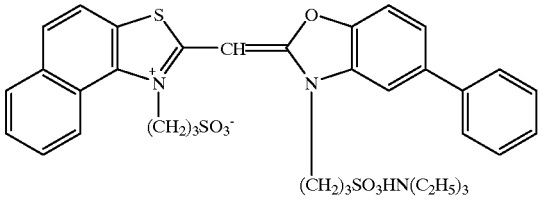
SD-11
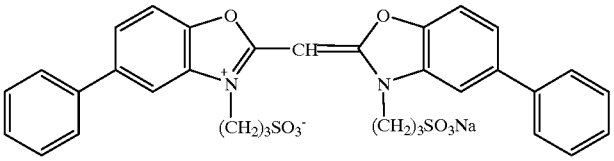
SD-12
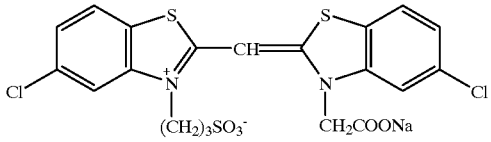
SD-13
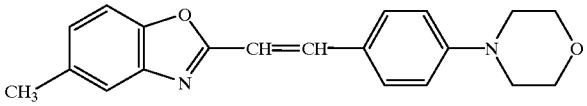

UV absorbent

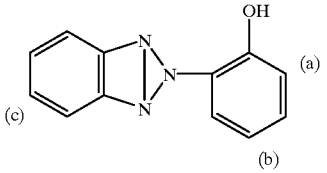

| | (a) | (b) | (c) |
|---|---|---|---|
| UV-1 | —$C_{12}H_{25}$ | —$CH_3$ | —H |
| UV-2 | —H | —(t)$C_4H_9$ | —H |
| UV-3 | —(t)$C_4H_9$ | —(t)$C_4H_9$ | —H |
| UV-4 | —(t)$C_4H_9$ | —$CH_3$ | —Cl |
| UV-5 | —(t)$C_4H_9$ | —(t)$C_4H_9$ | —Cl |

UV-6

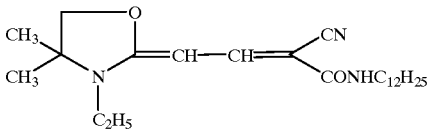

WAX-1

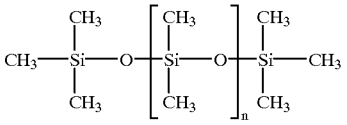

Weight average molecular weight
MW: 3,000

PM-1

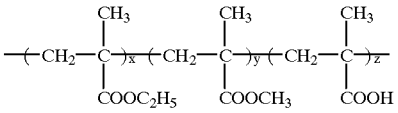

X:Y:Z = 3:2:4

SU-1

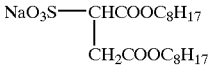

SU-2

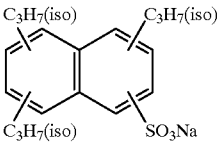

SU-3

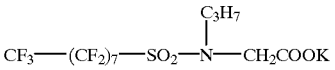

SU-4

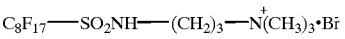

FS-1

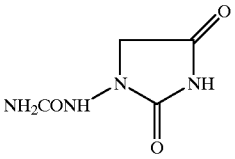

FS-2

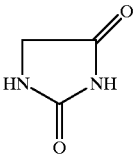

-continued

H-1

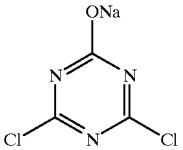

H-2

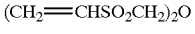

ST-1

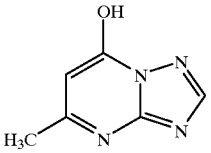

AF-1

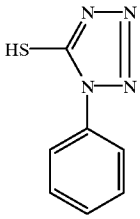

AF-2

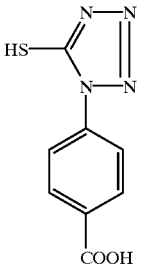

AF-3

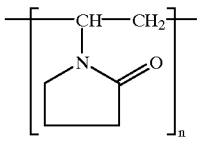

Weight average moleular weight:
10,000

Weight average molecular weight:
1,100,000

D1-1

(Mixture of the following 3 components)

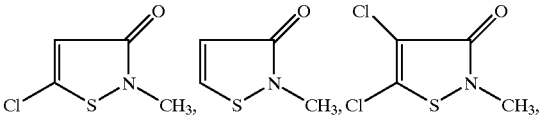

(Component A) (Component B) (Component C)

A : B : C = 50 : 46 : 4 in molar ratio

The emulsions used in the above-mentioned sample were as follows. The average grain diameter is described in terms of that of cubic grain. The emulsions were each optimally sensitized by gold, sulfur and selenium sensitization.

| Emulsion | Average AgI content (mole-%) | Average grain diameter (μm) | Crystal habit | Diameter/ thickness |
|---|---|---|---|---|
| Silver iodobromide emulsion A | 2.0 | 0.32 | Regular | 1.0 |
| Silver iodobromide emulsion B | 6.0 | 0.42 | Twinned tabular | 4.0 |
| Silver iodobromide emulsion D | 8.0 | 0.70 | Twinned tabular | 5.0 |
| Silver iodobromide emulsion E | 6.0 | 0.60 | Twinned tabular | 4.0 |
| Silver iodobromide emulsion F | 2.0 | 0.42 | Twinned tabular | 4.0 |
| Silver iodobromide emulsion G | 8.0 | 0.90 | Twinned tabular | 3.0 |

Silver iodobromide emulsions A, B and F each contained $1\times10^{-7}$ moles per mole of silver of iridium, respectively.

Sample 102 was prepared in the same manner as in Sample 101 except that a infrared-sensitive nineteenth layer having the following composition was provided between the second layer and the third layer.

| Nineteenth layer: Infrared-sensitive layer | |
|---|---|
| Silver iodobromide emulsion E | 0.15 |
| Silver iodobromide emulsion G | 0.70 |
| Sensitizing dye 1-10 | $2.0 \times 10^{-4}$ |
| Magenta coupler M-E1 | 0.20 |

-continued

| Nineteenth layer: Infrared-sensitive layer | |
|---|---|
| High-boiling organic solvent Oil-1 | 0.34 |
| Gelatin | 0.90 |

Sample 103 was prepared in the same manner as in Sample 102 except that the amount of magenta coupler M-E1 in the eighth layer was changed to 0.17, the amount of magenta coupler M-E1 in the ninth layer was changed to 0.18, and the amount of magenta coupler M-E1 and that of magenta coupler M-E2 in the tenth layer were each changed to 0.04 and 0.05, respectively.

Procedure for Determining the Maximum Sensitive Wavelength of Infrared-Sensitive Layer A sample in which magenta coupler M-E1 was replaced by 0.12 of yellow coupler Y-E2 was prepared. Pieces of thus obtained sample were each exposed to a prescribed amount of light of wavelength in 5 nm increment from 600 nm to 900 nm, respectively, and processed by a color processing system CNK-4, manufactured by Konica Corporation. The spectral sensitivity curve of the infrared-sensitive layer was drawn based on the light amount necessary to a density of the minimum density plus 0.3 measured by blue light. The wavelength of light, at which the sensitivity of the infrared-sensitive layer was highest, was determined based on the spectral sensitivity curve.

In Samples 102 and 103, the relation of the sensitivities of each emulsion layers were blue-sensitive layer>green-sensitive layer>red-sensitive layer>infrared-sensitive layer, and the sensitivity of the infrared-sensitive layer was 5% of the red-sensitive layer.

Samples 101 to 103 were each slit to 135 standard size and packed in a cartridge. A scene including a man having a 18% gray chart and green leaves of tree as a background was photographed by the samples using a camera, Konica Hexar, manufactured by Konica Corporation, under sunlight. The samples were processed by the color processing system CNK-4, and dried to obtain processed film samples.

Thus obtained negatives were printed on Konica Color Paper Type QAA6 by an enlarger Chromega. The sheets of the color paper were processed by a color paper processing system CPK-2-21, manufactured by Konica Corporation, to obtain finished prints. The printing condition was adjusted so that the color of the 18% gray chart was reproduced to be gray. L*, a* and b* of the reproduced colors of the green leaves and the skin were determined according to the chromaticity diagram system of CIE 1976 by calorimeter CMS-1200 manufactured by Murakami Color Laboratory. Thus obtained results are shown in Table 1.

TABLE 1

| | Reproduction of green leaves of trees | | | | Reproduction of skin color | | | | Maximum sensitive |
|---|---|---|---|---|---|---|---|---|---|
| Sample No. | Rank | L* | a* | b* | Rank | L* | a* | b* | wavelength[1] |
| 101 (c) | D | 44.8 | −10.5 | 18.0 | C | 73.5 | 9.0 | 16.0 | — |
| 102 (i) | B | 46.0 | −13.5 | 20.0 | C | 73.7 | 9.8 | 16.5 | 750 nm |
| 103 (i) | A | 47.2 | −15.5 | 23.0 | B | 75.0 | 10.5 | 17.7 | 750 nm |

(c): Comparative sample
(i): Inventive sample
[1]Maximum sensitive wavelength of the infrared-sensitive emulsion layer In the reproduction of the green color of tree leaves, it is preferable that the value of L* is higher, and the absolute values of a* and b* are higher. In the reproduction of the skin color, a higher value of L* is preferred a little, and higher absolute values of a* and b* are preferred. Further a higher value of C* calculated by the following equation, which is corresponding to the distance from the point of the color to the origin in the chromaticity diagram, is preferred since the higher value of C* indicates a vividly reproduced color.

$$C* = \sqrt{(a*)^2 + (b*)^2}$$

In the reproduction of skin color, a higher value of L* and higher absolute value of a* and b* are preferred. A color having a higher C* value is preferred since the reproduced color is vivid.

In Table 1, the reproduction of the green leaves of trees and that of the skin color were evaluated according to the following rankings.

Reproduction of green color of tree leaves

D: Darkened

C: Darkened a little

B: Vividly reproduced

A: Brightly and vividly reproduced

Reproduction of skin color

C: Insufficient in redness

B: Naturally reproduced

A: Naturally and brightly reproduced

Besides, the prints prepared by Samples 101 to 103 were subjectively evaluated by twenty observers. As a results, all the observers answered that the print using Sample 103 was preferred.

The above-mentioned example relates to

"A silver halide color photographic light-sensitive material having an invisible light-sensitive color reproducibility improving layer"

"A method for improving color reproducibility by an invisible light-sensitive color reproducibility improving layer"

"A silver halide color photographic light-sensitive material having an invisible light-sensitive color reproducibility improving layer capable of forming a visible image"

"A silver halide color photographic light-sensitive material having an invisible light-sensitive color reproducibility improving layer containing a magenta coupler" and "A silver halide color photographic light-sensitive material having an invisible light-sensitive color reproducibility improving layer for improving the reproducibility of green color of vegetation".

Example 2

Sample 201 was prepared in the same manner as in Sample 101 of example 1 except that an infrared-sensitive layer, nineteenth layer, having the following composition was provided between the second layer and the third layer.

| Nineteenth layer: Infrared-sensitive layer | |
|---|---|
| Silver iodobromide emulsion E | 0.15 |
| Silver iodobromide emulsion G | 0.70 |
| Sensitizing dye 3-3 | $1.7 \times 10^{-4}$ |
| Yellow Coupler Y-E1 | 0.28 |
| Magenta coupler M-E1 | 0.15 |
| Cyan coupler C-E1 | 0.30 |
| High-boiling solvent Oil-1 | 0.60 |
| Gelatin | 1.80 |

Sample 202 was prepared in the same manner as in Sample 101 except that the adding amounts of the couples in the 3rd, 4th, 5th, 8th, 9th, 10th, 14th, 15th and 16th layers were changed as follows:

| | | Adding amount | |
|---|---|---|---|
| Layer | Coupler | Sample 201 | Sample 202 |
| 3rd | C-E1 | 0.42 | 0.36 |
| 4th | C-E1 | 0.26 | 0.22 |
| 5th | C-E2 | 0.11 | 0.09 |
| 8th | M-E1 | 0.20 | 0.17 |
| 9th | M-E1 | 0.21 | 0.17 |
| | M-E1 | 0.05 | 0.04 |
| 10th | M-E2 | 0.06 | 0.05 |
| | Y-E1 | 0.39 | 0.33 |
| 14th | Y-E2 | 0.14 | 0.12 |
| | Y-E1 | 0.28 | 0.24 |
| 15th | Y-E2 | 0.10 | 0.08 |
| | Y-E1 | 0.04 | 0.03 |
| 16th | Y-E2 | 0.12 | 0.10 |

Procedure for Determining the Maximum Sensitive Wavelength of Infrared-Sensitive Layer Samples in each of which the coupler in the infrared-sensitive layer was replaced by yellow coupler Y-E1 were prepared and the maximum sensitive wavelength of infrared-sensitive layer of each of the samples were determined in the same manner as in Example 1.

In Samples 201 and 202, the relation of the sensitivities of each emulsion layers were blue-sensitive layer>green-sensitive layer>red-sensitive layer>infrared-sensitive layer, and the sensitivity of the infrared-sensitive layer was 3% of the red-sensitive layer.

Thus obtained samples were slit to 135 standard size and packed in cartridges. A scene including a distant view of mountains, green leaves of trees and a 18% gray chart was photographed by the samples using a camera, Konica Hexar, manufactured by Konica Corporation, under clear sky. The samples were processed by a color processing system CNK-4, manufactured by Konica Corporation, and dried to obtain processed samples.

Thus obtained negatives were printed on Konica Color Paper Type QAA6 by an enlarger Chromega. The sheets of the color paper were processed by a color paper processing system CPK-2-21, manufactured by Konica Corporation, to obtain finished prints. The printing condition was adjusted so that the color of the 18% gray chart was reproduced to be gray. L*, a* and b* were determined in the same manner as in Example 1. The landscape depiction ability was evaluated by the fluctuation of green density ΔD measured by green light in the image of the distant mountains measured by scanning by a microdensitometer. Thus obtained results are shown in Table 2.

TABLE 2

| Sample | Reproduction of green leaves of trees | | | | Distant | Landscape depiction ability | Maximum sensitive wave- |
|---|---|---|---|---|---|---|---|
| No. | Rank | L* | a* | b* | mountains | (ΔD) | lenght[1] |
| 101 (c) | D | 44.0 | −10.8 | 19.0 | D | 0.47 | — |
| 201 (i) | B | 45.8 | −13.5 | 20.9 | B | 0.58 | 780 nm |
| 202 (i) | A | 47.0 | −16.5 | 24.0 | A | 0.66 | 780 nm |

(c): Comparative sample
(i): Inventive sample
[1]Maximum sensitive wavelength of the infrared-sensitive emulsion layer In Table 2, the evaluation was carried out according to the following rankings.

Reproduction of green color of tree leaves

D: Darkened

C: Darkened a little

B: Vividly reproduced

A: Brightly and vividly reproduced

Reproduction of distant mountains

D: Hazy

C: Hazy a little, outline of the mountains is unclear.

B: Outline of mountains is reproduced brightly and clearly.

A: Mountains are brightly reproduced and color of sky is deeply expressed, outline of mountains is very clear.

Landscape depiction ability

C: Depicting ability is low, and image is flat.

B: Image has contrast and depicting ability is recognized.

A: Image has natural contrast and a sufficient depicting ability is observed.

In the reproduction of the green leaves, a higher value of L*, a higher absolute values of a* and b* and a higher value of C* are preferable. As to the depiction ability of landscape, a higher value of ΔD is preferred.

Besides, the prints prepared by Samples 101 and 102 were subjectively evaluated by twenty observers. As a results, all the observers answered that the print using Sample 202 was preferred.

Example 3

Sample 301 was prepared in the same manner as in Sample 101 of Example 1 except that an infrared-sensitive layer, nineteenth layer, was provided between the second layer and the third layer.

| Nineteenth layer: Infrared-sensitive layer | |
|---|---|
| Silver iodobromide emulsion E | 0.15 |
| Silver iodobromide emulsion G | 0.70 |
| Sensitizing dye 3-4 | $1.7 \times 10^{-4}$ |
| Colored magenta coupler CM-E1 | 0.09 |
| High-boiling solvent Oil-1 | 0.10 |
| Gelatin | 0.50 |

Samples 302 through 306 were prepared in the same manner as in Sample 301 except that the amounts of colored magenta coupler CM-E1, high-boiling solvent Oil-1 and gelatin were changed as follows:

| 19th layer | Colored coupler | Amount of colored coupler | Amount of Oil-1 | Amount of gelatin |
|---|---|---|---|---|
| 301 | CM-E1 | 0.09 | 0.10 | 0.30 |
| 302 | CC-E1 | 0.08 | 0.09 | 0.20 |
| 303 | YCC-E1 | 0.09 | 0.09 | 0.20 |
| 304 | CM-E1 | 0.08 | 0.14 | 0.28 |
| | CC-E1 | 0.07 | | |
| 305 | CM-E1 | 0.08 | 0.15 | 0.29 |
| | YCC-E1 | 0.08 | | |
| 306 | CM-E1 | 0.06 | 0.16 | 0.31 |
| | CC-E1 | 0.05 | | |
| | YCC-E1 | 0.06 | | |

Procedure for Determining the Maximum Sensitive Wavelength of Infrared-Sensitive Layer Samples in each of which the coupler in the infrared-sensitive layer was replaced by yellow coupler Y-E1 was prepared and the maximum sensitive wavelength of infrared-sensitive layer was determined in the same manner as in Example 1.

In samples 301 to 306, the relation of the sensitivities of each emulsion layers were blue-sensitive layer>green-sensitive layer>red-sensitive layer>infrared-sensitive layer, and the sensitivity of the infrared-sensitive layer was 4% of the red-sensitive layer.

Thus obtained samples were slit to 135 standard size and backed in cartridges. A scene including magenta-red and yellow tulip flowers, a 18% gray chart and a lake surrounded by mountains as the background was photographed by the samples using a camera, Konica Hexar, manufactured by Konica Corporation, under clear sky. The samples were processed by a color processing system CNK-4, manufactured by Konica Corporation, and dried to obtain processed samples.

Thus obtained negatives were printed on Konica Color Paper Type QAA6 by an enlarger Chromega. The sheets of the color paper were processed by a color paper processing system CPK-2-21, manufactured by Konica Corporation, to obtain finished prints.

The printing condition was adjusted so that the color of the 18% gray chart was reproduced to be gray. L*, a* and b* of the reproduced colors of the green leaves, blue sky magenta-red flower, yellow flower and blue sea surface were measured in the same manner as in Example 1. On the other hand, the reproduced color was visibly evaluated and ranked. Thus obtained results are shown in Table 3.

TABLE 3

| Sample | Reproduction of green tree leaves | | | | Reproduction of blue sky | | | |
|---|---|---|---|---|---|---|---|---|
| No. | Rank | L* | a* | b* | Rank | L* | a* | b* |
| 101(c) | D | 44.3 | −10.6 | 18.5 | D | 69.2 | −2.2 | −8.9 |
| 301(i) | A | 47.1 | −16.5 | 24.0 | B | 59.9 | −7.6 | −24.0 |
| 302(i) | C | 45.8 | −13.2 | 20.1 | C | 64.8 | −6.7 | −18.1 |
| 303(i) | C | 45.7 | −12.8 | 19.8 | A | 51.1 | −5.1 | −29.2 |
| 304(i) | C | 46.0 | −13.2 | 19.8 | B | 60.0 | −8.0 | −23.5 |
| 305(i) | C | 46.0 | −12.5 | 19.5 | B | 58.9 | −7.5 | −24.0 |
| 306(i) | C | 45.7 | −13.5 | 19.6 | A | 51.2 | −6.5 | −28.2 |

| Sample | Reproduction of magenta-red flower | | | | Reproduction of yellow flower | | | |
|---|---|---|---|---|---|---|---|---|
| No. | Rank | L* | a* | b* | Rank | L* | a* | b* |
| 101(c) | D | 56.9 | 39.8 | −5.2 | D | 75.5 | 4.0 | 67.9 |
| 301(i) | C | 55.5 | 42.0 | −6.0 | C | 77.3 | 2.0 | 69.1 |
| 302(i) | A | 51.6 | 49.9 | −15.2 | C | 77.1 | 2.2 | 68.9 |
| 303(i) | C | 55.0 | 41.0 | −5.9 | C | 76.8 | 2.4 | 69.0 |
| 304(i) | C | 55.0 | 42.5 | −6.0 | C | 77.1 | 1.9 | 69.3 |
| 305(i) | C | 55.8 | 42.7 | −5.5 | A | 79.0 | 0.2 | 72.1 |
| 306(i) | C | 55.2 | 41.5 | −5.5 | C | 77.2 | 2.2 | 69.5 |

| Sample | Reproduction of blue sea surface | | | | Maximum sensitive wave- |
|---|---|---|---|---|---|
| No. | Rank | L* | a* | b* | length[1)] |
| 101(c) | D | 67.0 | 0.8 | −13.1 | — |
| 301(i) | B | 58.9 | 1.9 | −16.6 | 790 nm |
| 302(i) | B | 58.5 | 1.0 | −15.8 | 790 nm |
| 303(i) | B | 59.0 | 1.5 | −16.5 | 790 nm |
| 304(i) | A | 54.7 | 1.9 | −18.3 | 790 nm |
| 305(i) | B | 56.5 | 0.9 | −16.9 | 790 nm |
| 306(i) | A | 54.5 | 0.8 | −18.0 | 790 nm |

(c): Comparative sample
(i): Inventive sample
[1)]Maximum sensitive wavelength of the infrared-sensitive emulsion layer In Table 3, the visible evaluation of the reproduced color was carried out by 20 observers, and the result of the evaluation was ranked A to D according to the following norm.

A: 15 or more of the observers recognized that the color was preferably reproduced.

B: 10 to 14 of the observers recognized that the color was preferably reproduced.

C: 5 to 9 of the observers recognized that the color was preferably reproduced.

D: 4 or less of the observers recognized that the color was preferably reproduced.

In the reproduction of magenta-red color, it is preferred that a negative the value of b* and a higher value of C* are preferred. As to reproduction of the yellow flower color, a lower value of a* and a higher value of C* are preferred.

Besides, the prints prepared by Samples 101 and 301 were subjectively evaluated by twenty observers. As a results, all the observers answered that the print using Sample 301 was preferred.

Example 4

A sample was prepared in the same manner as in Sample 102 of Example 1 except that magenta coupler M-E1 in the nineteenth layer was replaced by cyan coupler C-E1, and slit to the same manner as in Example 1. A scene of red leaves was photographed by the sample and printed. As a result, a preferable print was obtained, in which red of the red leaves were more vividly reproduced compared to that in a comparative print using Sample 101.

Example 5

A sample was prepared in the same manner as in Sample 102 of Example 1 except that magenta coupler M-E1 in the nineteenth layer was replaced by yellow coupler Y-E1, and slit to the same manner as in Example 1. A bluish purple flower of clematis was photographed by the sample and printed. As a result, a print was obtained, in which the color of the flower was more accurately reproduced compared to the color in a comparative print using Sample 101.

Example 6

Sample 601 was prepared in the same manner as in Sample 102 of Example 1 except that an infrared-sensitive layer, nineteenth layer, having the following composition was provided between the second layer and the third layer.

| Nineteenth layer: Infrared-sensitive layer | |
|---|---|
| Silver iodobromide emulsion E | 0.15 |
| Silver iodobromide emulsion G | 0.70 |
| Sensitizing dye 3-1 | $2.0 \times 10^{-4}$ |
| Magenta coupler M-E1 | 0.20 |
| Colored cyan coupler CC-E1 | 0.08 |
| High-boiling solvent Oil-1 | 0.25 |
| Gelatin | 0.68 |

Samples 602 through 604 were prepared in the same manner as in Sample 601 except that the coupler, colored coupler, high-boiling solvent and gelatin were changed as shown in Table 4.

TABLE 4

| Sample | Coupler | | Colored coupler | | Amount of | Amount of |
|---|---|---|---|---|---|---|
| No. | Kind | Amount | kind | Amount | Oil-1 | gelatin |
| 601 | M-E1 | 0.20 | CC-E1 | 0.08 | 0.25 | 0.68 |
| 602 | M-E1 | 0.20 | CM-E1 | 0.09 | 0.27 | 0.70 |
| 603 | Y-E1 | 0.25 | CC-E1 | 0.08 | 0.62 | 0.90 |
| | M-E1 | 0.14 | | | | |
| | C-E1 | 0.27 | | | | |
| 604 | Y-E1 | 0.25 | CM-E1 | 0.08 | 0.80 | 1.05 |

TABLE 4-continued

| Sample | Coupler | | Colored coupler | | Amount of | Amount of |
|---|---|---|---|---|---|---|
| No. | Kind | Amount | kind | Amount | Oil-1 | gelatin |
| | M-E1 | 0.14 | CC-E1 | 0.07 | | |
| | C-E1 | 0.27 | | | | |

Procedure for Determining the Maximum Sensitive Wavelength of Infrared-Sensitive Layer Samples in each of which the coupler in the infrared-sensitive layer was replaced by yellow coupler Y-E1, were prepared and the maximum sensitive wavelength of infrared-sensitive layer was determined in the same manner as in Example 1.

In Samples 601 and 604, the relation of the sensitivities of each emulsion layers were blue-sensitive layer>green-sensitive layer>red-sensitive layer>infrared-sensitive layer, and the sensitivity of the infrared-sensitive layer was 3% of the red-sensitive layer.

Thus obtained samples were slit to 135 standard size and backed in cartridges. A scene including green leaves of trees, red and yellow flowers of tulip and blue sky at the upper portion of the scene was photographed by the samples using a camera Konica Hexar, manufactured by Konica Corporation, under clear sky. The samples were processed by a color processing system CNK-4, manufactured by Konica Corporation, and dried to obtain processed samples.

Thus obtained negatives were printed on Konica Color Paper Type QAA6 by an enlarger Chromega. The sheets of the color paper were processed by a color paper processing system CPK-2-21, manufactured by Konica Corporation, to obtain finished prints.

The printing condition was adjudged so that the color of the 18% gray chart was reproduced to be gray. The measurements of L*, a* and b* were carried out in the same manner as in Example 1. Thus obtained results are shown in Table 5.

TABLE 5

| Sample | Reproduction of green tree leaves | | | | Reproduction of blue sky | | | | Reproduction of red tulip | | | | Reproduction of blue sea surface | | | | Maximum sensitive |
|---|---|---|---|---|---|---|---|---|---|---|---|---|---|---|---|---|---|
| No. | Rank | L* | a* | b* | Rank | L* | a* | b* | Rank | L* | a* | b* | Rank | L* | a* | b* | wavelength[1] |
| 101 (c) | D | 44.5 | −10.7 | 18.2 | C | 69.0 | −2.0 | −8.0 | C | 44.4 | 38.1 | 24.0 | C | 75.5 | 4.0 | 67.8 | — |
| 601 (i) | B | 46.2 | −12.1 | 17.5 | B | 60.5 | −1.5 | −9.4 | C | 44.8 | 38.1 | 24.5 | C | 75.6 | 3.8 | 68.2 | 820 nm |
| 602 (i) | A | 47.5 | −13.2 | 20.2 | C | 63.7 | −2.0 | −8.2 | C | 44.3 | 38.5 | 23.5 | B | 78.5 | 0.1 | 72.5 | 820 nm |
| 603 (i) | B | 47.7 | −12.1 | 17.2 | B | 57.6 | −3.0 | −12.2 | B | 42.8 | 41.2 | 22.2 | C | 75.4 | 3.6 | 68.5 | 820 nm |
| 604 (i) | B | 48.0 | −12.5 | 18.2 | B | 53.5 | −4.5 | −15.2 | B | 43.0 | 41.2 | 21.0 | B | 78.6 | 0.5 | 71.2 | 820 nm |

(c): Comparative sample
(i): Inventive sample
[1]Maximum sensitive wavelength of the infrared-sensitive emulsion layer In Table 5, the evaluation is carried out as followings.

Green of tree leaves

D: Darkened

C: Darkened a little

B: Vividly reproduced

C: Brightly and vividly reproduced

Blue of sky

C: Normally reproduced

B: Vividly reproduced

Red tulip

C: Normally reproduced

B: Vividly reproduced

Yellow tulip

C: Normally reproduced

B: Vividly reproduced

In the reproduction of the red tulip flower, a lower value of a* and a higher value of C* are preferred.

Besides, the prints prepared by Samples 101 and 604 were subjectively evaluated by twenty observers. As a results, all the observers answered that the print using Sample 604 was preferred.

Example 7

Sample 701 was prepared in the same manner as in Sample 102 of Example 1 except that an infrared-sensitive layer, nineteenth layer, having the following composition was provided between the second layer and the third layer.

| Nineteenth layer: Infrared-sensitive layer | |
|---|---|
| Silver iodobromide emulsion E | 0.15 |
| Silver iodobromide emulsion G | 0.70 |
| Sensitizing dye 3-4 | $5.6 \times 10^{-4}$ |
| Magenta coupler M-E1 | 0.20 |
| DIR compound D-E2 | 0.05 |
| High-boiling solvent Oil-1 | 0.24 |
| Gelatin | 0.60 |

Samples 702 and 703 were prepared in the same manner as in Sample 701 except that the coupler, DIR compound, high-boiling solvent Oil-1 and gelatin in the nineteenth layer were changed as shown in Table 6.

TABLE 6

| Sample | Coupler | | DIR compound | | Amount of | Amount of |
|---|---|---|---|---|---|---|
| No. | Kind | Amount | Kind | Amount | oil | gelatin |
| 701 | M-E1 | 0.20 | D-E2 | 0.05 | 0.24 | 0.60 |
| 702 | M-E1 | 0.20 | D-E4 | 0.06 | 0.25 | 0.60 |
| 703 | Y-E1 | 0.25 | | | | |
| | M-E1 | 0.14 | D-E2 | 0.06 | 0.70 | 1.05 |
| | C-E1 | 0.27 | | | | |

Procedure for Determining the Maximum Sensitive Wavelength of Infrared-Sensitive Layer Samples in each of which the coupler in the infrared-sensitive layer was replaced by yellow coupler Y-E1 was prepared and the maximum sensitive wavelength of infrared-sensitive layer was determined in the same manner as in Example 1.

In Samples 701 to 703, the relation of the sensitivities of each emulsion layers were blue-sensitive layer>green-sensitive layer>red-sensitive layer>infrared-sensitive layer, and the sensitivity of the infrared-sensitive layer was 3% of the red-sensitive layer.

Thus obtained samples were slit to 135 standard size and backed in cartridges. A scene including green leaves of trees in daylight, green leaves of trees, a yellow flower of tulip and a 18% gray chart in shade, and blue sky at the upper portion was photographed by the samples using a camera Konica Hexar, manufactured by Konica Corporation, under clear sky. The samples were processed by a color processing system CNK-4, manufactured by Konica Corporation, and dried to obtain processed samples.

Thus obtained negatives were printed on Konica Color Paper Type QAA6 by an enlarger Chromega. The sheets of the color paper were processed by a color paper processing system CPK-2-21, manufactured by Konica Corporation, to obtain finished prints.

The printing condition was adjudged so that the color of the 18% gray chart was to be gray. L*, a* and b* of the reproduced colors were measured by the same manner as in Example 1. Thus obtained results are shown in Table 7.

TABLE 7

| Sample | Reproduction of green tree leaves in sunlight | | | | Reproduction of green leaves in shadow | | | | Reproduction of blue sky | | | | Reproduction of yellow flower | | | | Maximum sensitive |
|---|---|---|---|---|---|---|---|---|---|---|---|---|---|---|---|---|---|
| No. | Rank | L* | a* | b* | Rank | L* | a* | b* | Rank | L* | a* | b* | Rank | L* | a* | b* | wavelength[1] |
| 101 (c) | D | 44.2 | −10.7 | 18.3 | D | 40.6 | −6.5 | 12.2 | C | 59.4 | −2.2 | −9.0 | C | 75.8 | 3.5 | 68.1 | — |
| 701 (i) | B | 46.0 | −13.2 | 19.8 | A | 42.5 | −9.1 | 17.8 | C | 58.0 | −1.8 | −11.0 | C | 76.0 | 2.8 | 69.0 | 790 nm |
| 702 (i) | B | 46.2 | −13.5 | 19.7 | B | 41.8 | −7.6 | 13.5 | B | 55.0 | −6.2 | −16.9 | C | 76.2 | 2.6 | 69.2 | 790 nm |
| 703 (i) | B | 47.2 | −13.0 | 19.5 | B | 41.9 | −7.9 | 14.0 | B | 54.5 | −7.5 | 17.5 | B | 78.0 | 0.3 | 71.1 | 790 nm |

(c): Comparative sample
(i): Inventive sample
[1]Maximum sensitive wavelength of the infrared-sensitive emulsion layer Green of tree leaves
D: Darkened
B: Vivid
C: Bright and vivid
Blue of sky
C: Normal
B: Vivid
Yellow flower
C: Normal
B: Vivid Besides, the prints prepared by Samples 101 and 703 were subjectively evaluated by twenty observers. As a results, all the observers answered that the print using Sample 703 was preferred.

Example 8

Sample 801 was prepared in the same manner as in Sample 102 of Example 1 except that an infrared-sensitive layer, nineteenth layer, having the following composition was provided between the second layer and the third layer.

| Nineteenth layer: Infrared-sensitive layer (Infrared-sensitive donor layer) | |
|---|---|
| Silver iodobromide emulsion E | 0.15 |
| Silver iodobromide emulsion G | 0.70 |
| Sensitizing dye 2-23 | $5.6 \times 10^{-4}$ |
| DIR compound D-E1 | 0.06 |
| High-boiling solvent Oil-1 | 0.07 |
| Gelatin | 0.20 |

Procedure for Determining the Maximum Sensitive Wavelength of Spectral Sensitivity Curve of Infrared-Sensitive Layer The wavelength at which the sensitivity of the infrared-sensitive layer is highest was determined in the same manner as in Example 1.

In Sample 801, the relation of the sensitivities of each emulsion layers were blue-sensitive layer>green-sensitive layer>red-sensitive layer>infrared-sensitive layer, and the sensitivity of the infrared-sensitive layer was 4% of the red-sensitive layer.

Thus obtained samples were slit to 135 standard size and backed in cartridges. The upper part of the bodies of a male and a female and a red flower of tulip were photographed using a strobe flush light in a studio by the samples using a camera Konica Hexar, manufactured by Konica Corporation. The samples were processed by a color processing system CNK-4, manufactured by Konica Corporation, and dried to obtain processed samples. Thus obtained negatives were printed on Konica Color Paper Type QAA6 by an enlarger Chromega. The sheets of the color paper were processed by a color paper processing system CPK-2-21, manufactured by Konica Corporation, to obtain finished prints. The printing condition was adjudged so that the color of the female skin color was aptly printed. L*, a* and b* of the reproduced colors were measured by the same manner as in Example 1. The gradation in the petal of the red tulip flower is evaluation by measuring the density fluctuation of the density measured by green light AD in the reproduced image of it, by scanning by a microdensitometer.

Thus obtained results are shown in Table 8.

TABLE 8

| Sample | Reproduction of color of red tulip | | | | |
|---|---|---|---|---|---|
| No. | Visual evaluation | L* | a* | b* | ΔD |
| 101 (c) | The color saturation was high but the gradation was lost. | 44.5 | 38.6 | 24.5 | 0.03 |
| 801 (i) | The color saturation is high a little and the gradation is aptly reproduced | 44.3 | 38.1 | 24.0 | 0.06 |

| Sample | Reproduction of color of male skin | | | |
|---|---|---|---|---|
| No. | Visual evaluation | L* | a* | b* |
| 101 (c) | Not preferable since the color was excessively reddish. | 67.8 | 11.9 | 20.6 |
| 801 (i) | Naturally reproduced | 68.5 | 11.1 | 22.6 |

TABLE 8-continued

| Sample No. | Maximum sensitive wave length of red-sensitive layer | Maximum sensitive wave length of infrared-sensitive layer |
|---|---|---|
| 101 (c) | 632 nm | — |
| 801 (i) | 630 nm | 685 nm |

As to gradation reproduction of the red tulip, a higher value of ΔD is preferred. In the reproduction of the color of male skin, a higher value of b* is preferable.

Besides, the prints prepared by Samples 101 and 803 were subjectively evaluated by twenty observers. As a results, all the observers answered that the print using Sample 801 was preferred.

Example 9

Sample 901 was prepared by coating an infrared-sensitive layer, nineteenth layer, having the following composition between the second layer and the third layer of Sample 101.

| Nineteenth layer: Infrared-sensitive layer (Infrared-sensitive donor layer) | |
|---|---|
| Silver iodobromide emulsion E | 0.15 |
| Silver iodobromide emulsion G | 0.70 |
| Sensitizing dye 3-3 | $1.7 \times 10^{-4}$ |
| Yellow coupler Y-E1 | 0.20 |
| Magenta coupler M-E1 | 0.10 |
| High-boiling solvent Oil-1 | 0.25 |
| Gelatin | 0.75 |

Thus obtained sample was slit to 135 standard size and packed in a cartridge. A scene including distant mountains backed with blue sky and a 18% gray chart was photographed by the sample using a camera Konica Hexar, manufactured by Konica Corporation. Then the sample was processed by a color processing system CNK-4, manufactured by Konica Corporation, and dried to obtain a processed sample.

Thus obtained negatives were printed on Konica Color Paper Type QAA6 by an enlarger Chromega. The sheets of the color paper were processed by a color paper processing system CPK-2-21, manufactured by Konica Corporation, to obtain finished prints.

The printing condition was adjudged so that the color of the 18% gray chart was reproduced to be gray. In the print using Sample 901, the color of blue sky was reproduced more deeply and vividly compared to that in the print using Sample 101.

Example 10

A sample was prepared the same as Sample 901 of Example 9 except that magenta coupler M-E1 in the nineteenth layer was replaces by the equi-molar of cyan coupler C-E1, and slit to the same manner as in Example 9. A pink flower of tulip was photographed by the sample and printed. Thus a print was obtained in which the color of the flower was more accurately and clearly compared reproduced to that in a comparative print using Sample 101.

Example 11

A sample was prepared the same as Sample 901 of Example 9 except that yellow coupler Y-E1 in the nineteenth layer was replaces by the equi-molar of cyan coupler C-E1, and slit to the same manner as in Example 9. A yellow flower of tulip was photographed by the sample and printed. Thus a print was obtained in which the color of the flower was more accurately and clearly reproduced compared to that in a comparative print using Sample 101.

What is claimed is:

1. A silver halide color photographic light-sensitive material comprising a transparent support having, on one side thereof, a red-sensitive silver halide emulsion layer containing a cyan dye-forming coupler, a green-sensitive silver halide emulsion layer containing a magenta dye-forming coupler, a blue-sensitive silver halide emulsion layer containing a yellow dye-forming coupler, a non-light-sensitive hydrophilic colloid layer, and an additional silver halide layer sensitive to invisible light containing at least one compound selected from the group consisting of a dye-forming coupler, a colored coupler, and a DIR compound, thereby to provide an imagewise color reproduction effect to at least one of said red-sensitive layer, said green-sensitive layer, and said blue-sensitive layer.

2. The light-sensitive material of claim 1, wherein said additional silver halide emulsion layer is an infrared-sensitive silver halide emulsion layer.

3. The light-sensitive material of claim 2 wherein the infrared-sensitive silver halide emulsion layer is sensible to infrared rays within the range of from 680 nm to 850 nm.

4. The light-sensitive material of claim 2 wherein said infrared-sensitive silver halide emulsion layer contains at least one of the following (a), (b) and (c);

(a) not more than two of a yellow dye-forming coupler, a magenta dye-forming coupler and a cyan dye-forming coupler, (b) a colored coupler, and (c) a DIR compound.

5. The light-sensitive material of claim 2 wherein said infrared-sensitive silver halide emulsion layer contains a yellow dye-forming coupler.

6. The light-sensitive material of claim 2 wherein said infrared-sensitive silver halide emulsion layer contains a magenta dye-forming coupler.

7. The light-sensitive material of claim 2 wherein said infrared-sensitive silver halide emulsion layer contains a cyan dye-forming coupler.

8. The light-sensitive material of claim 2 wherein said infrared-sensitive silver halide emulsion layer contains at least two of a yellow magenta dye-forming coupler and a cyan dye-forming coupler.

9. The light-sensitive material of claim 2 wherein said infrared-sensitive silver halide emulsion layer contains a colored coupler.

10. The light-sensitive material of claim 2 wherein said infrared-sensitive silver halide emulsion layer contains a colored coupler and at least one of a yellow dye-forming coupler, magenta dye-forming coupler and cyan dye-forming coupler.

11. The light-sensitive material of claim 2 wherein said infrared-sensitive silver halide emulsion layer contains a DIR compound.

12. The light-sensitive material of claim 2 wherein said infrared-sensitive silver halide emulsion layer contains a DIR compound and at least one of a yellow dye-forming coupler, magenta dye-forming coupler and cyan dye-forming coupler.

13. The light-sensitive material of claim 2 wherein said infrared-sensitive silver halide emulsion layer contains a colored coupler and a DIR compound.

14. The light-sensitive material of claim 2 wherein the red-light-sensitive silver halide emulsion layer, the green-light-sensitive silver halide emulsion layer, and the blue-light-sensitive silver halide emulsion layer are arranged in this order from the support and said infrared-sensitive layer is provided between the support and the red-sensitive silver halide emulsion layer.

15. The light-sensitive material of claim 2 wherein the red-light-sensitive silver halide emulsion layer, the green-light-sensitive silver halide emulsion layer, and the blue-light-sensitive silver halide emulsion layer are arranged in this order from the support and said infrared-sensitive layer is provided between the red-sensitive silver halide emulsion layer and the green-sensitive silver halide emulsion layer.

16. The light-sensitive material of claim 2 wherein the sensitivity of said infrared-sensitive silver halide emulsion layer is not less than 50% of the sensitivity of the silver halide emulsion layer having the lowest sensitivity among the red-sensitive silver halide emulsion layer, the green-sensitive silver halide emulsion layer and the blue-sensitive silver halide emulsion layer.

17. The light-sensitive material of claim 1 wherein said imagewise color reproduction effect is an inter-image effect.

18. The light-sensitive material of claim 1 wherein said red-sensitive layer, said green-sensitive layer, and said blue-sensitive layer each contain a silver iodobromide emulsion.

19. A method for forming a color image comprising:

exposing a silver halide photographic material to light by one time exposure, said silver halide photographic material comprising a transparent support and, on one side thereof, a red-sensitive silver halide emulsion layer containing a cyan dye-forming coupler, a green-sensitive silver halide emulsion layer containing a magenta dye-forming coupler, a blue-sensitive silver halide emulsion layer containing a yellow dye-forming coupler, a non-light-sensitive hydrophilic colloid layer, and an additional silver halide emulsion layer sensitive to invisible light containing at least one compound selected from the group consisting of a dye-forming coupler, a colored coupler, and a DIR compound, and developing said silver halide photographic material whereby said additional silver halide emulsion layer imagewise affects color reproduction of an image formed by at least one of said red-sensitive silver halide emulsion layer, said green-sensitive silver halide emulsion layer, and said blue-sensitive silver halide emulsion layer to form said color image.

* * * * *